US007412929B2

(12) United States Patent
Walsh

(10) Patent No.: US 7,412,929 B2
(45) Date of Patent: Aug. 19, 2008

(54) DIVERSIONARY DEVICE

(75) Inventor: Robert Walsh, Goose Creek, SC (US)

(73) Assignee: Law Enforcement Technologies, Inc., Colorado Springs, CO (US)

( * ) Notice: Subject to any disclaimer, the term of this patent is extended or adjusted under 35 U.S.C. 154(b) by 0 days.

(21) Appl. No.: 11/236,378

(22) Filed: Sep. 27, 2005

(65) Prior Publication Data

US 2006/0081147 A1 Apr. 20, 2006

Related U.S. Application Data

(60) Provisional application No. 60/613,142, filed on Sep. 27, 2004.

(51) Int. Cl.
*F42B 12/46* (2006.01)
*F42B 4/18* (2006.01)
*F42B 27/00* (2006.01)

(52) U.S. Cl. ..... 102/368; 102/355; 102/482

(58) Field of Classification Search ..... 102/367, 102/368, 335, 355, 369, 482, 486
See application file for complete search history.

(56) References Cited

U.S. PATENT DOCUMENTS

| | | | | |
|---|---|---|---|---|
| 2,899,106 | A | 8/1959 | Weinert | |
| 3,656,435 | A * | 4/1972 | Barr et al | 102/368 |
| 3,831,520 | A | 8/1974 | Bowen et al. | |
| 3,983,817 | A | 10/1976 | Tucker | |
| 4,444,111 | A | 4/1984 | Luebbers | |
| 4,932,328 | A | 6/1990 | Pinkney | |
| 4,947,753 | A | 8/1990 | Nixon | |
| 4,976,201 | A | 12/1990 | Hamilton | |
| 5,069,134 | A | 12/1991 | Pinkney | |
| 5,085,147 | A | 2/1992 | Gold | |
| 5,122,298 | A * | 6/1992 | Fry et al. | 516/2 |
| 5,351,623 | A | 10/1994 | Kissel | |
| 5,511,978 | A | 4/1996 | Sellers, Jr. et al. | |
| 5,654,523 | A | 8/1997 | Brun | |
| 5,764,134 | A | 6/1998 | Carr | |
| 5,824,945 | A | 10/1998 | Barlog | |
| 6,253,680 | B1 | 7/2001 | Grubelich | |
| 6,470,806 | B1 | 10/2002 | Murray | |
| 6,543,364 | B2 | 4/2003 | Wes et al. | |

FOREIGN PATENT DOCUMENTS

| | | |
|---|---|---|
| GB | 1354307 | 5/1974 |

* cited by examiner

*Primary Examiner*—Bret Hayes
(74) *Attorney, Agent, or Firm*—Baker & Daniels LLP

(57) ABSTRACT

A diversion device capable of generating a disorientating flash and a disorientating sound without an explosion has a housing with a cavity containing an inert gas, a piston and a powder. The powder creates the flash via ignition after exiting the device. The device also includes a mechanism configured to ensure the powder encompasses the device upon exit and does is not dispersed in a substantially horizontal plane. In addition, the device may include devices capable of creating a disorientating sound as the inert gas escapes the device.

38 Claims, 67 Drawing Sheets

DIVERSIONARY DEVICE

BACKGROUND OF THE INVENTION

This invention relates to diversionary devices used in a variety of military and law enforcement situations. Specifically, the device provides a mechanism to disorientate an adversary without inflicting permanent damage or harm. The device accomplishes this by producing a disorientating flash of light and a confusingly loud noise. Devices of this sort are often referred to as "stun grenades" or "flash grenades."

Several patents disclose hand held diversionary devices. For example, U.S. Pat. No. 4,947,753 granted to Nixon discloses a "stun grenade" configured to produce non-lethal explosions. The disclosed stun grenade includes an elongated body having a hollow interior with an explosive substance located therein. The stun grenade further includes an igniter fuse attached to the grenade body for creating an ignition spark. The ignition spark causes the explosive substance to explode in a non-lethal manner.

U.S. Pat. No. 5,654,523 granted to Brunn also teaches a "stun grenade." The stun grenade generates an explosion accompanied by light and/or blaring sound. The stun grenade comprises a housing having an interior cavity defined by a base and a cover. A cartridge including an explosive charge is also located within the housing. The housing further includes a plurality of vents angularly offset from the longitudinal axis of the cavity. The orientation of the vents with respect to the longitudinal axis of the cavity allows for the radial discharge of the explosive. In some embodiments, the explosives are connected to a tear gas container allowing for the dispersal of tear gas when the explosives discharge.

U.S. Pat. No. 6,253,680 granted to Grubelich teaches a "diversionary device." The disclosed diversionary device includes a housing with an opening. The housing contains a non-explosive propellant and a quantity of fine powder located intermediate the propellant and the opening. The device also includes means of activating the propellant, which in turn, drives the fine powder through the opening. In addition, the device further includes an igniter capable of igniting the fine powder, as the powder travels through the opening in order to create a diversionary flash and bang.

It is an object of the invention to provide embodiments of a diversionary device that provides a large flash and a distracting noise in order to create a diversion.

SUMMARY OF THE INVENTION

The diversion device of the present invention includes a housing including a cavity. The cavity contains an inert gas, a piston, and a powder. The first end of the housing is attached to a firing mechanism, and the second end of the housing is attached to a dispersal mechanism. The firing mechanism acts upon the inert gas causing the gas to drive the piston. The driving piston forces the powder through the dispersal mechanism allowing the powder to encompass the device.

In an embodiment of the invention, the device includes a piezoelectric device capable of making a spark when contacted by the piston. The spark is of sufficient magnitude to ignite the powder causing the powder to ignite. The ignition of the powder creates a disorientating flash.

In an embodiment of the invention, the device includes acoustical devices capable of creating a disorientating sound when the inert gas escapes the device.

In an embodiment of the invention, the device includes a printed circuit board for controlling the delay of the firing mechanism. The printed circuit board interacts with an actuator, comprising a solenoid in an embodiment of the invention. Activation of the actuator by the printed circuit board causes the inert gas to drive the piston.

An embodiment of the invention includes a firing device for use in a diversionary device. The diversionary device includes a dispersal mechanism, a gas canister containing pressurized gas positioned within a cavity and a powder. The powder is positioned intermediate the gas canister and the dispersal mechanism.

The firing device includes a puncture component, a central gear and a motor assembly. The puncture component is capable of puncturing the gas canister. Rotation of the central gear results in the relative movement of the gas canister and the puncture component in order to release the pressurized gas of the canister and force the powder from the device.

DETAILED DESCRIPTION OF EMBODIMENTS OF THE INVENTION

Figure 1:
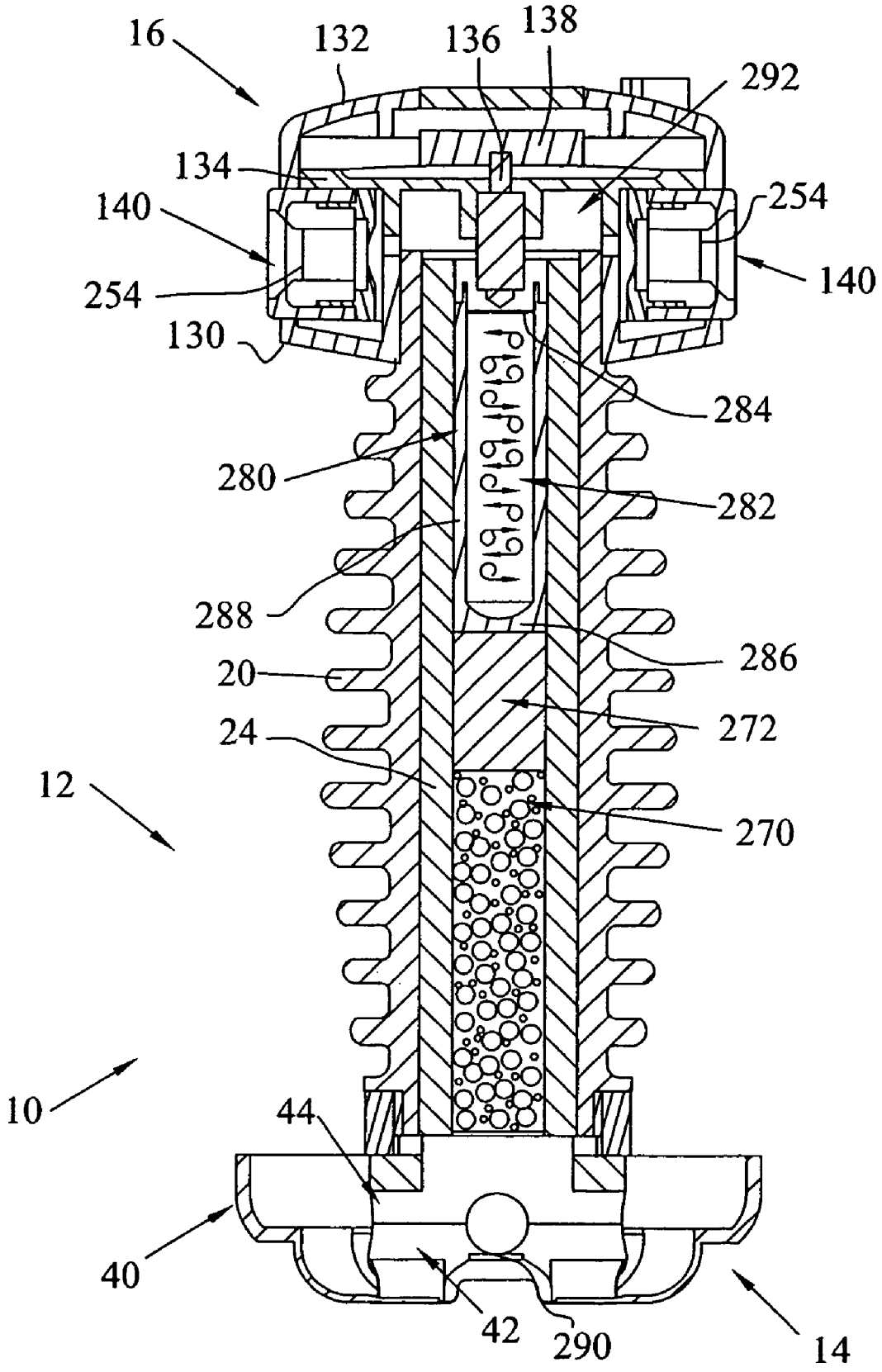
FIG. 1 is a section view of an embodiment of a diversion device of the present invention.

Referring first to FIG. 1, numeral 10 generally indicates a device for creating a diversion. In the relevant art, devices in the same family as device 10 are commonly referred to as "flash" grenades or "stun" grenades. Device 10 includes a housing, generally indicated by numeral 12, a dispersal mechanism, generally indicated by numeral 14, and a firing mechanism, generally indicated by numeral 16.

Figure 2:
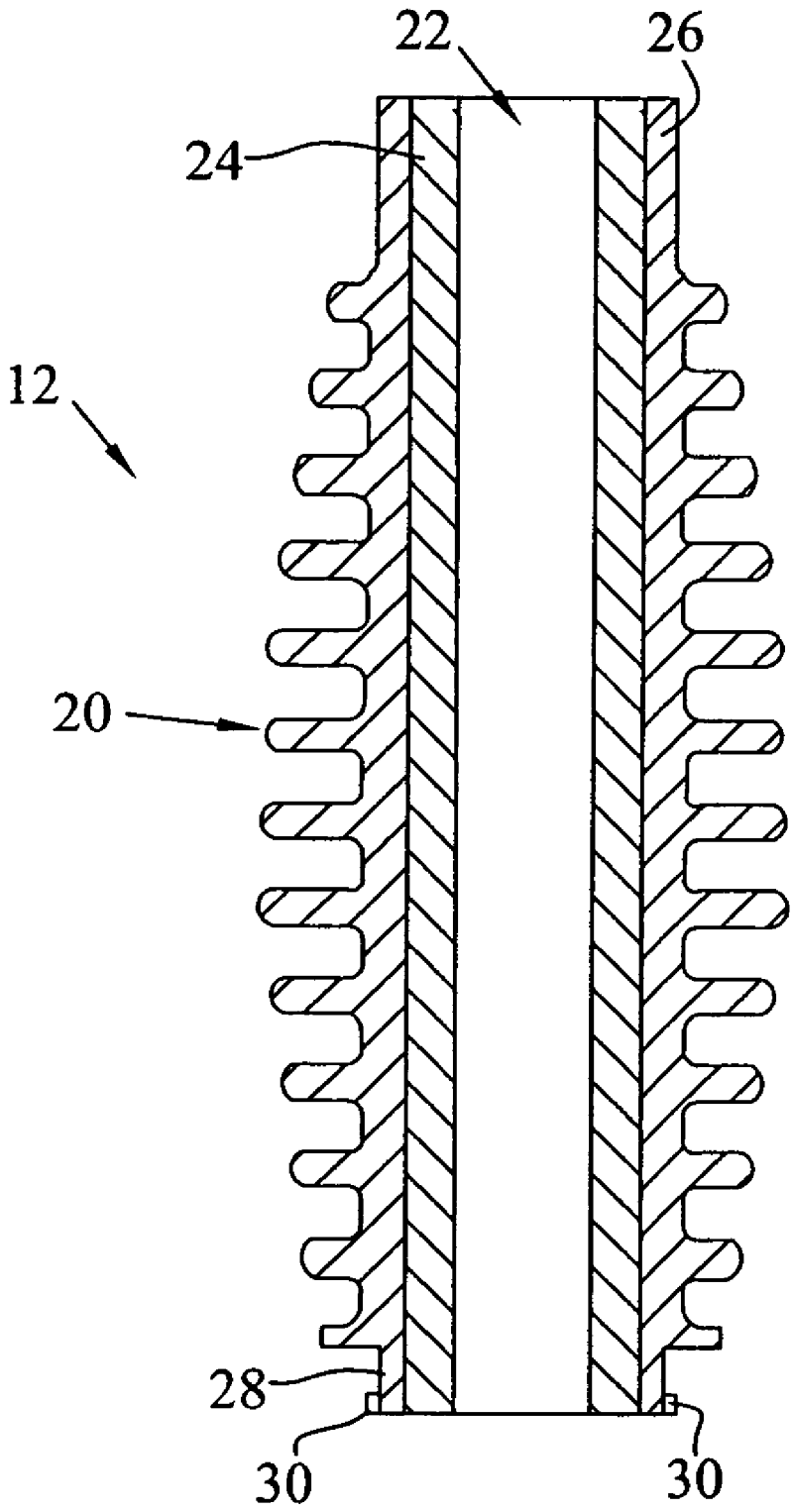
FIG. 2 is a section view of an embodiment of a housing utilized in the diversion device of the present invention.

FIG. 2 shows a section view of housing 12. Housing 12 includes a handle portion 20 having a central bore 22 extending the length of handle portion 20. In the embodiment depicted, handle portion 20 is configured to provide a comfortable grip to a user. Handle portion 20 may be manufactured from any durable material, such as metal or plastic.

Housing 12 further includes a sleeve 24 sized and configured to be retained within bore 22 intermediate a first end 26 and a second end 28 of handle portion 20. In the present embodiment, sleeve 24 is manufactured of metal. It should be noted, however, that in alternative embodiments, sleeve 24 may be manufactured of a plastic material.

Referring still to FIG. 2, it can be seen that handle portion 20 includes a plurality of protrusions, depicted as bayonet style tabs, generally indicated by numeral 30. In the present embodiment, protrusions 30 are integrally formed in second end 28.

Figure 3:
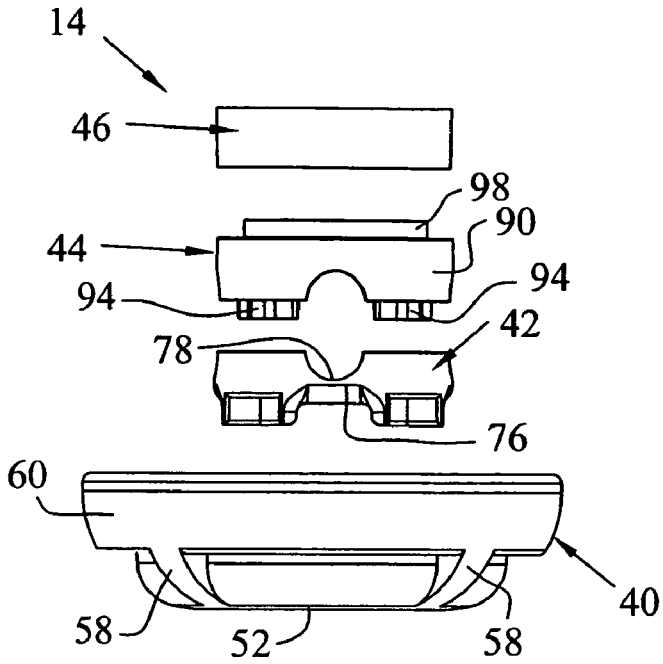
FIG. 3 is an exploded side view of the dispersal mechanism utilized in an embodiment of the present device.

FIG. 3 shows an exploded side view of dispersal mechanism 14. In the present embodiment, dispersal mechanism 14 includes deflector cup 40, lower nozzle housing 42, upper nozzle housing 44 and nozzle interference 46.

Figure 4:
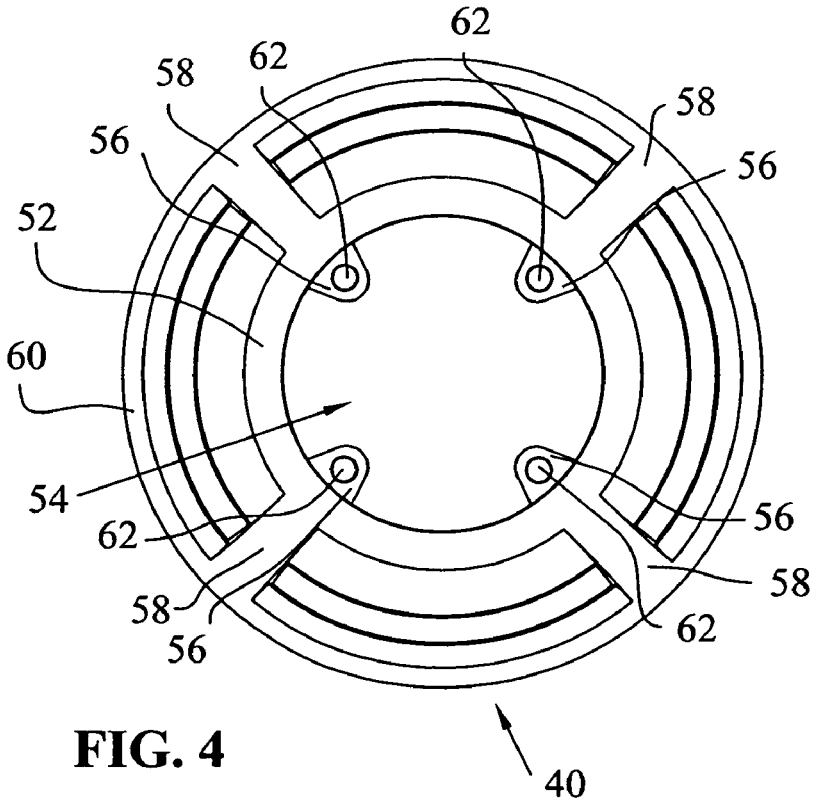
FIG. 4 depicts a bottom view of a deflector cup utilized in the dispersal mechanism shown in FIG. 3.

With reference now to FIGS. 3 and 4, deflector cup 40 includes a base 52, defined by a plastic ring in the embodiment depicted. Base 52 includes a central aperture 54. Deflector cup 40 further includes a plurality of bosses 56, a plurality of arms 58 and baffle ring 60. Each of the bosses 58 includes an aperture 62. In the present embodiment, bosses 56 extend into the aperture 54 from base 52, and bosses 56 reside in the same plane as aperture 54.

FIGS. 3 and 4, depict arms 58 extending upwards from base 52. In the embodiment depicted, arms 58 extend away from protrusions present within base 52 located opposite bosses 56.

In the embodiment depicted, baffle ring 60 connects the top portions of arms 58 together. Baffle ring 60 is oriented perpendicular to base 52. Dispersal mechanism 14 may be manufactured from any durable material such as plastic.

Figure 5A:
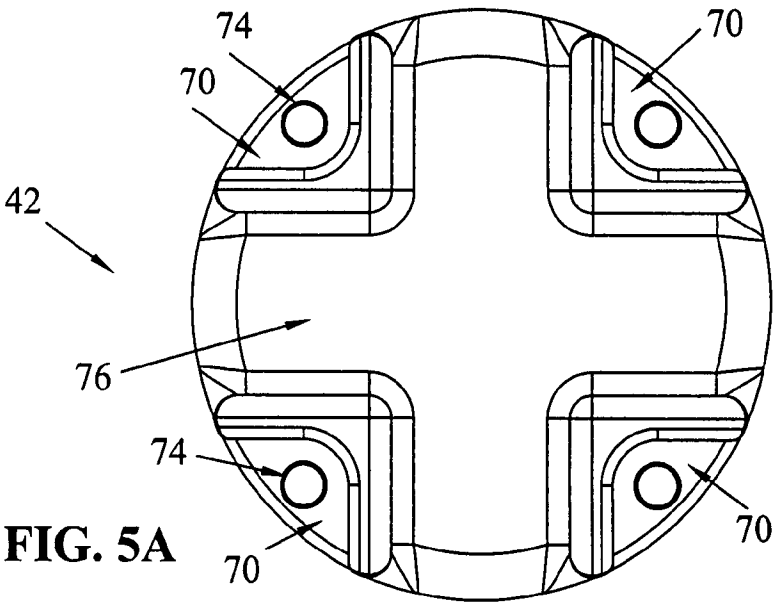
FIGS. 5A and 5B depict a bottom view and a top view of a lower housing utilized in the dispersal mechanism shown in FIG. 3.
Figure 5B:
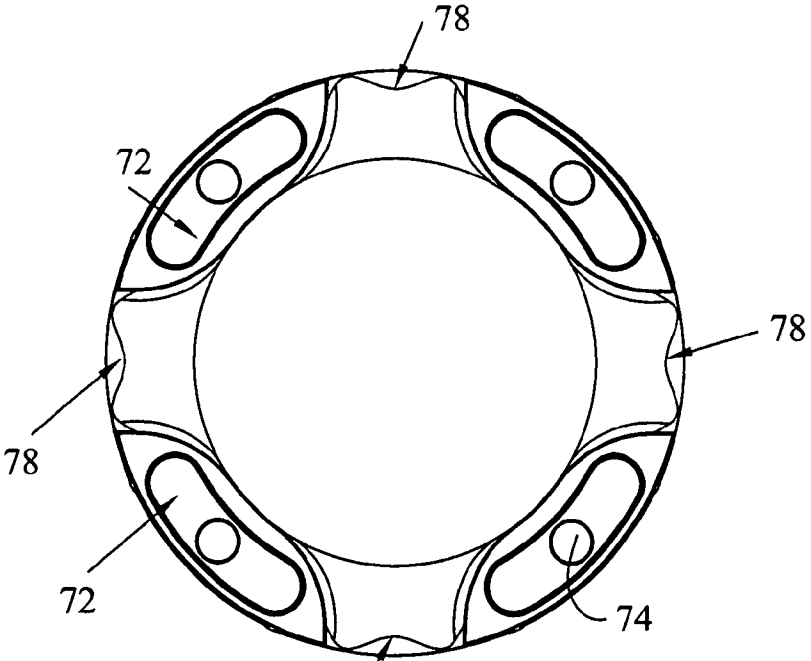

Referring now to FIGS. 3, 5*a* and 5*b*, lower housing 42 is shown. In the present embodiment, lower housing 42 may be manufactured of plastic and includes a plurality of boss receiving cavities 70 disposed in the lower surface thereof. In the present embodiment, boss receiving cavities 70 are sized and configured to receive bosses 56 of deflector cup 40.

The upper surface of lower housing 42 includes a plurality of mounting cavities 72 located opposite boss receiving cavities 70. Each mounting cavity 72 includes an aperture 74 extending through the entirety of lower housing 42. Mounting cavities 72 are arranged to ensure apertures 74 extend through the center of both the mounting cavities 72 and boss receiving cavities 70.

Referring still to FIGS. 3, 5*a* and 5*b*, lower housing 42 further includes a base portion 76 formed in the lower surface thereof. Base portion 76 comprises an "X"-shape centered in the lower surface of housing 42.

In FIGS. 3 and 5*b*, numeral 78 generally indicates a plurality of channels disposed within the top surface of lower housing 42. Channels 78 are located opposite base portion 76 and have a semi-circular cross sectional shape.

Figure 6:
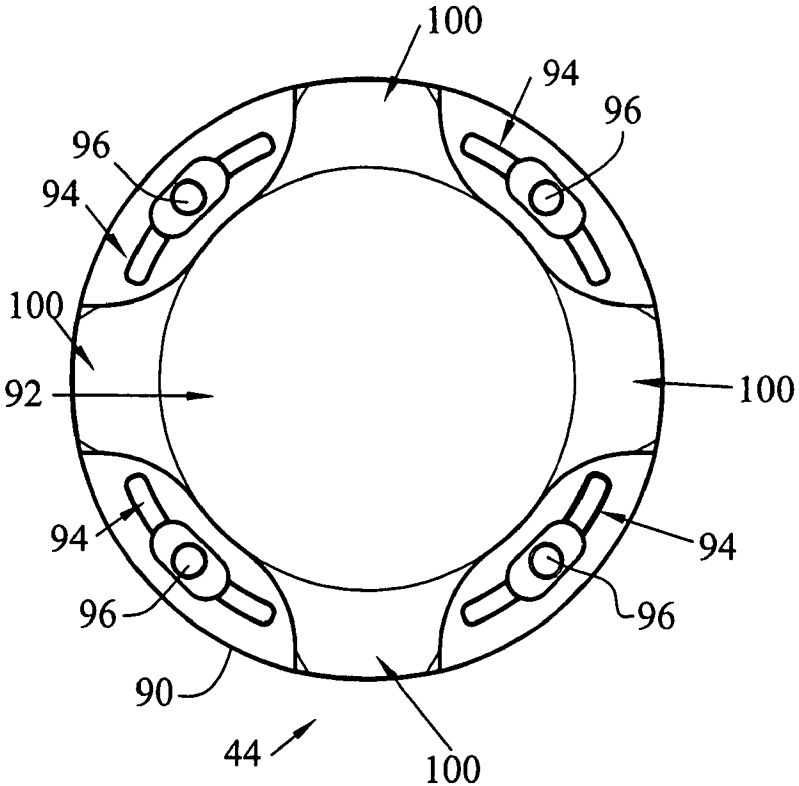
FIG. 6 depicts a bottom view of the upper nozzle housing utilized in the dispersal mechanism shown in FIG. 3.

FIGS. 3 and 6 depict upper nozzle housing 44. In the present embodiment, upper nozzle housing 44 is manufactured from plastic or a similar type of durable material. Upper nozzle housing 44 comprises an outer ring 90 including a central aperture 92 and a plurality of mounting protrusions 94 extending downward from ring 90. Mounting protrusions 94 are sized and configured to be received within mounting cavities 72 of lower housing 42. Mounting protrusions 94 include an aperture 96 positioned at a location to align with aperture 74 of lower nozzle housing 42 when protrusions 96 are inserted into cavities 72.

Referring still to FIG. 3, the upper surface of upper nozzle housing 44 includes an alignment ring 98 extending upward from the upper surface of ring 90. In the embodiment depicted, alignment ring 98 is integral to ring 90.

Referring again to FIGS. 3 and 6, upper nozzle housing 44 further includes a plurality of channels 100 positioned within the lower surface thereof. Channels 100 have a semi-circular cross section sized and configured to mate with channels 78 of the lower nozzle housing 42.

Figure 7:
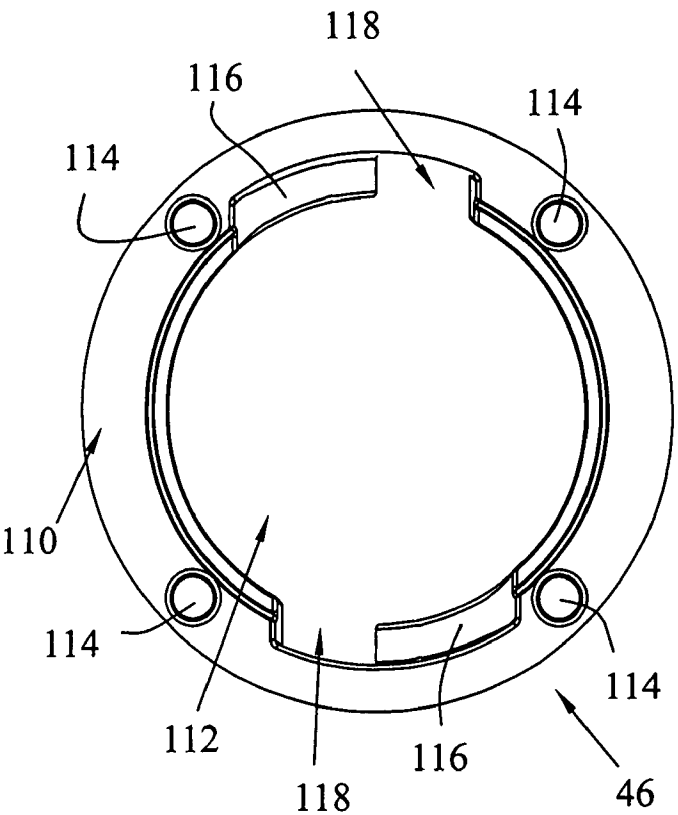
FIG. 7 depicts a bottom view of a nozzle end interface utilized in the dispersal mechanism shown in FIG. 3.

FIGS. 3 and 7 depict nozzle interface 46 comprising body 110 manufactured of metal. Body 110 has a ring shape with aperture 112 disposed in the center. In the present embodiment, body 110 includes aperture 112, a plurality of apertures 114, ramp portions 116 and slot 118. Apertures 114 are disposed throughout body 110 at locations mirroring the positions of apertures 96 in upper nozzle housing 44.

Ramp portions 116 are formed along the inner edge of body 110 on opposite sides of the center of body 110. In the present embodiment, ramp portions 116 are positioned at an angle with respect to the remainder of body 110.

Referring still to FIG. 7, slots 118 are positioned adjacent ramp portions 116. Slots 118 are sized and configured to receive protrusions 30 of housing 12.

Figure 8:
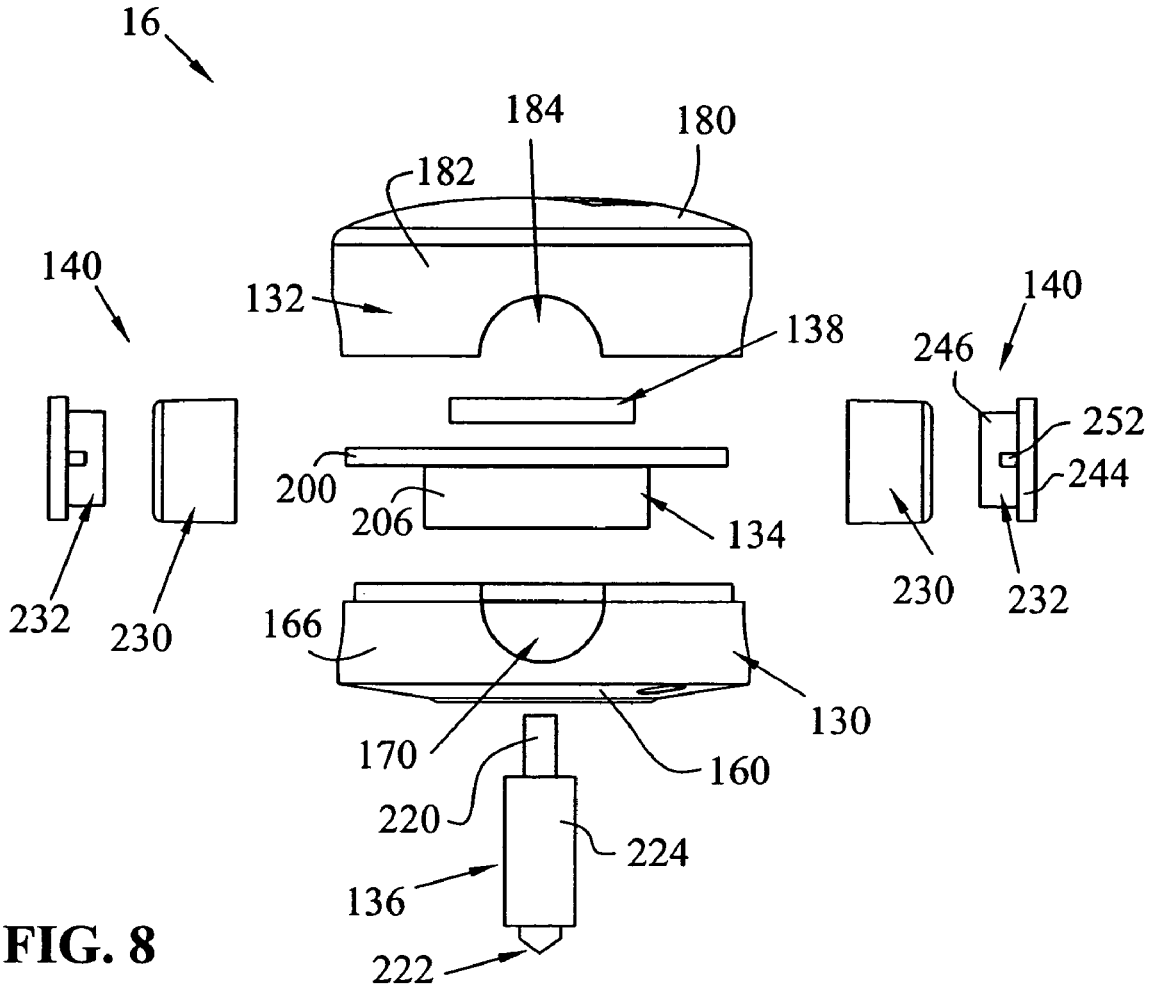
FIG. 8 depicts an exploded side view of the firing mechanism utilized in an embodiment of the present device.

FIG. 8 depicts an exploded view of firing mechanism 16. In the embodiment depicted, firing mechanism 16 includes lower timing housing 130, upper timing housing 132, internal timing housing 134, actuator 136, printed circuit board 138 and a plurality of whistles 140.

Figure 9:
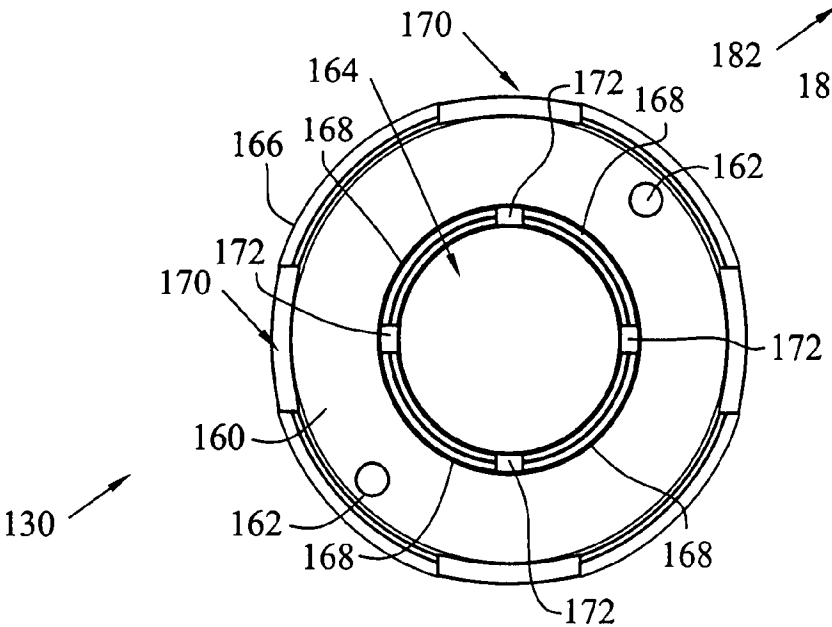
FIG. 9 depicts a top view of the lower timer housing utilized in the firing mechanism shown in FIG. 8.

FIGS. 8 and 9 depict lower timer housing 130. Lower timer housing 130 includes base 160 including a plurality of mounting apertures 162 and a central aperture 164. The apertures 162, 164 extend through base 160. In the present embodiment, central aperture 164 is positioned in the center of base 160 with mounting apertures 162 located on opposite sides of central aperture 164.

Lower timer housing 130 further includes an outer wall 166 and an inner wall 168 both extending upwards from base 160. In the present embodiment, the walls 166, 168 are integral to base 160. Outer wall 166 includes a substantially planar upper surface and a plurality of channels 170. In the present embodiment, channels 170 have a semi-circular cross sectional shape.

Similarly, inner wall 168 includes a stepped upper surface and a plurality of slots 172. In the present embodiment, slots 172 are positioned proximate channels 170 of outer wall 166. The step formed in the upper surface of inner wall 168 positions the two planar flat surfaces of the wall 168 at different heights.

Figure 10:
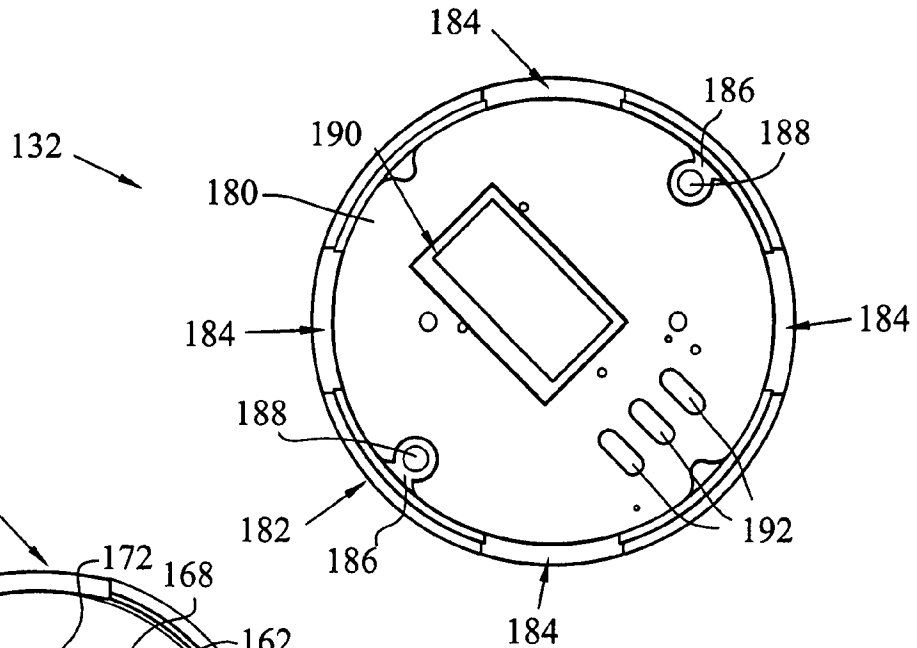
FIG. 10 depicts a bottom view of the upper timer housing utilized in the firing mechanism shown in FIG. 8.

FIGS. 8 and 10 depict upper timer housing 132. Upper timer housing 132 comprises base portion 180 and wall 182. Wall 182 extends downward from base portion 180 and is integral thereto. In the present embodiment, base portion 180 and wall 182 are both manufactured from plastic. Wall 182 includes a plurality of channels 184 disposed throughout. In the embodiment depicted, channels 184 have a semi-circular cross section and are sized and configured to mate with channels 170 of lower timer housing 130.

As seen in FIGS. 8 and 10, upper timer housing 132 further includes a pair of mounting bosses 186 extending away from base portion 180 and located proximate wall 182. Each mounting boss 186 includes a mounting aperture 188. In the present embodiment, mounting aperture 188 are arranged to mirror the positions of apertures 162 of base 160 in lower timer housing 130.

Referring still to FIGS. 8 and 10, in the present embodiment, base portion 180 includes a rectangular opening 190 and a plurality of oval openings 192. Rectangular opening 190 is of sufficient size to receive an LCD screen (not shown). Similarly, oval openings 192 are sized to receive a switching unit (not shown).

Figure 11:
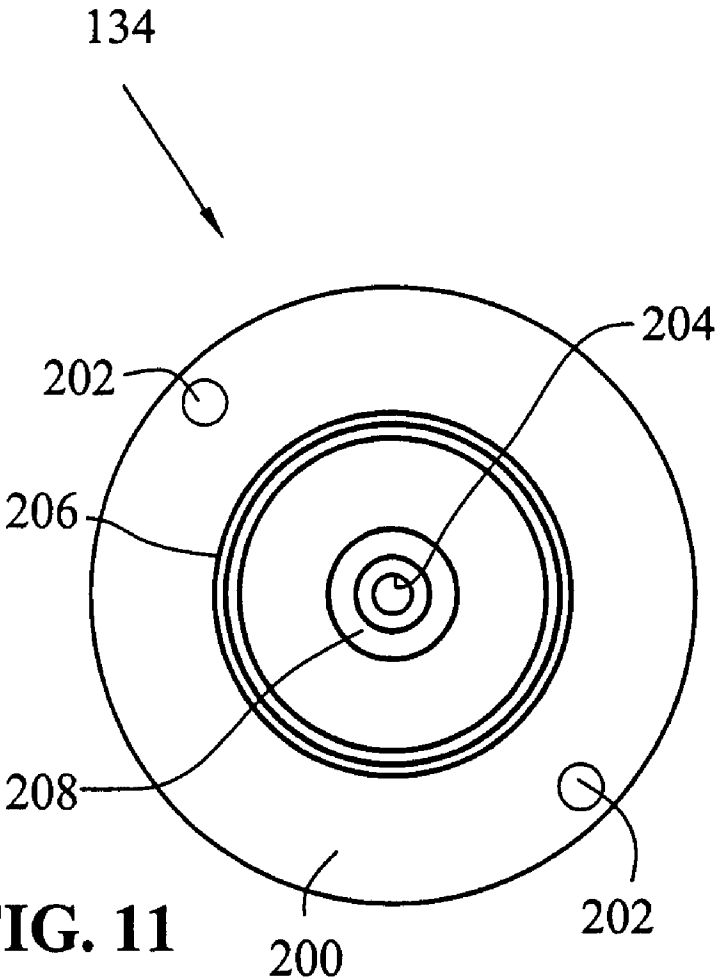
FIG. 11 depicts a bottom view of the internal timer housing utilized in the firing mechanism shown in FIG. 8.

FIGS. 8 and 11 depict internal timer housing 134. In the present embodiment, internal timer housing 134 includes a plate 200 with a substantially planar upper surface. Plate 200 includes a pair of mounting apertures 202 and a central aperture 204. Mounting apertures 202 are located within plate 200 in positions mirroring the position of apertures 188 in upper timer housing 132. Conversely, central aperture 204 extends through the center of plate 200.

In the embodiment depicted, interlocking walls 206 encompass central aperture 204. The interlocking walls 206 are positioned intermediate the mounting apertures 202 and central aperture 204. The lower surface of interlocking walls 206 includes two planar surfaces positioned in different planes.

Referring still to FIGS. 8 and 11, central walls 208 also encompass central aperture 204. In the present embodiment, central walls 208 are positioned intermediate central aperture 204 and the interlocking walls 206. Both sets of walls 206, 208 are integrally formed in plate 200.

Figure 12:
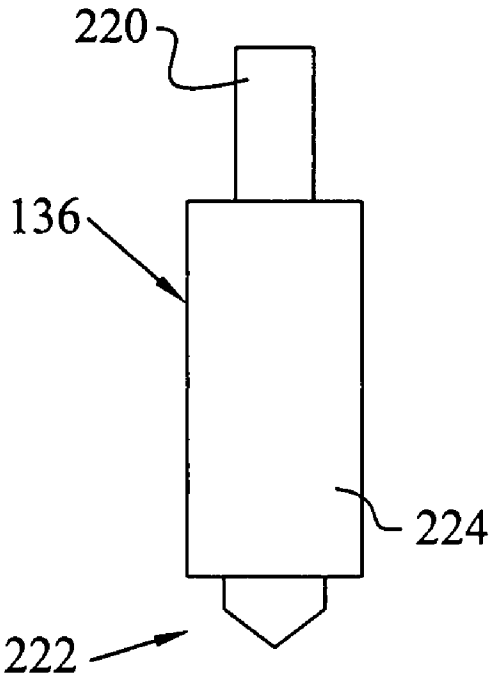
FIG. 12 depicts a side view of an actuator utilized in the firing mechanism shown in FIG. 8.

FIGS. 8 and 12 depict a side view of actuator 136. Actuator 136 includes fixed end 220 and moveable end 222. Actuator 136 further includes body 224 disposed intermediate the ends 220, 222. Actuator 136 may be any device commonly known, such as a solenoid, allowing for the linear movement of moveable end 222 with respect to fixed end 220. In the present embodiment, moveable end 222 includes a sharp tip configured to puncture an object upon activation of actuator 136. In addition, in this embodiment moveable end 222 travels away from fixed end 220.

Referring again to FIG. 8, whistle 140 is depicted. Whistle 140 includes outer whistle housing 230 and inner whistle housing 232. In the embodiment depicted, both housings 230, 232 are manufactured of plastic.

Figure 13:
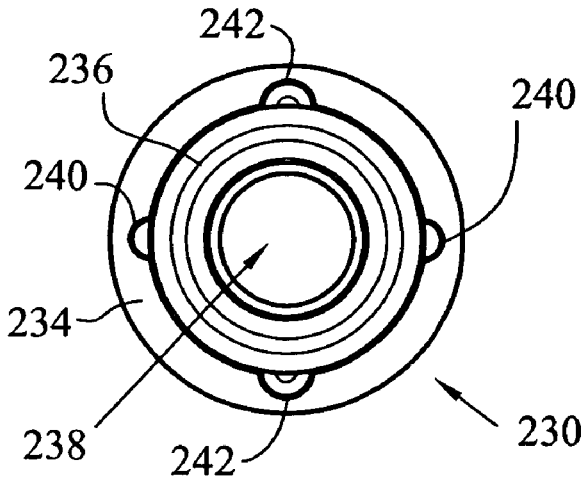
FIG. 13 depicts a front view of the outer whistle housing of the whistle depicted in FIG. 8.

FIGS. 8 and 13 depict outer whistle housing 230. Outer whistle housing 230 includes outer wall 234 and front portion 236. In the present embodiment, outer wall 234 has a cylindrical shape and extends away from the back face of front portion 236 proximate the side edges thereof. Front portion 236 comprises a substantially flat plate and includes a central aperture 238 centered on the longitudinal axis of outer wall 234.

Referring still to FIGS. 8 and 13, outer wall 234 includes two pairs of channels 240, 242 formed in the inner surface thereof. Locking channels 240 are positioned on opposing edges of the inner surface and are arranged at an angle of 180° with respect to the circular cross section of the outer wall 234. Similarly, exit channels 242 are also formed in the inner surface of outer wall 234 and disposed at angle of 180°. Exit channels 242, however, are offset 90° from locking channels 240.

Figure 14A:
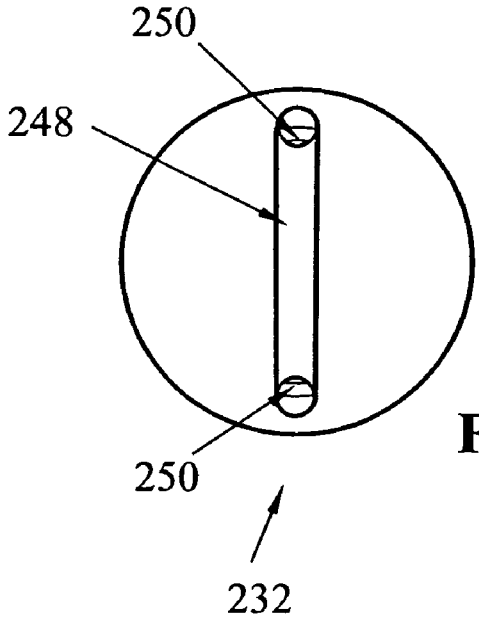
FIGS. 14A and 14B depict back and front views, respectively, of the inner whistle housing of the whistle depicted in FIG. 8.
Figure 14B:
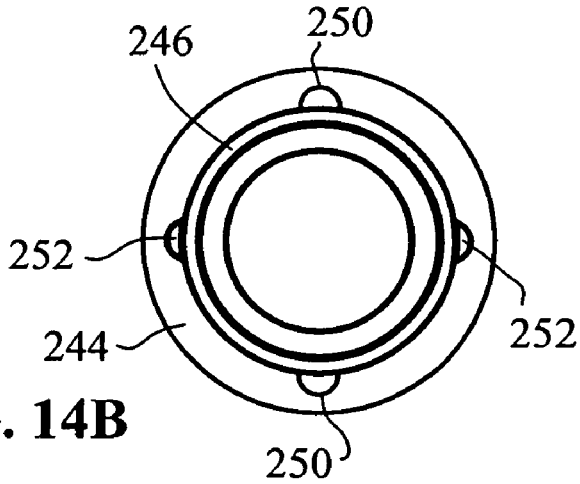

FIGS. 8, 14*a* and 14*b* depict inner whistle housing 232. Inner whistle housing 232 includes base 244 and cylinder portion 246 integrally manufactured from plastic. Base 244 comprises a substantially flat component including slot 248 formed in the rear surface opposite cylinder portion 246. In the present embodiment, slot 248 includes two apertures 250 extending through base 244. Apertures 250 are positioned proximate the ends of slot 248.

Referring still to FIGS. 8, 14*a* and 14*b*, inner whistle housing 232 includes a pair of protrusions 252 attached to the outer surface of cylinder portion 246. Protrusions 252 are sized and configured to be received within locking channels 240. Accordingly, in the present embodiment, the pair of protrusions 252 are offset 180° from each other. Moreover, the protrusions 252 are also offset 90° from apertures 250.

The assembly of whistle 140 is accomplished by inserting inner whistle housing 232 into outer whistle housing 230. When inserting inner whistle housing 232, protrusions 252 travel down locking channels 240 which results in apertures 250 of inner whistle housing 232 being aligned with exit channels 242. This alignment allows flow of a fluid from the rear of whistle 140 to the front of whistle 140 via channels 242. Accordingly, inducing a high pressure gaseous fluid on slot 248 causes the fluid to pass through apertures 250, travel down exit channels 242, and exit the opposite side of whistle 140. Travel of a gaseous fluid in this manner creates a whistling sound.

Moreover, in some embodiments of whistle 140, a reed 254 (see FIG. 1) may be added to the inner cavity of whistle 140 in order to magnify the volume of the sound produced. In an embodiment of the invention, reed 254 comprises an aluminum disk (or a plurality thereof, if desired) vibrating as the whistle 140 is pressurized in order to create a whistling sound.

Now that the major parts of the device have been described in detail, the assembly of the device 10 will be described. Note that the following description is for illustrative purposes only and, as will be apparent to one possessing ordinary skill in the art, the order of assembly may be altered.

Referring first to FIGS. 1 and 3-7, the assembly of dispersal mechanism 14 will first be described. Lower housing 42 is placed into deflector cup 40 so that mounting bosses 56 are positioned within boss receiving cavities 70. Lower housing 42 is sized and configured to allow lower housing 42 to be received by aperture 54 of deflector cup 40. When lower housing 42 is correctly positioned, apertures 62 of bosses 56 align with mounting apertures 74 of the boss receiving cavities 70.

With lower nozzle housing 42 properly positioned within deflector cup 40, upper nozzle housing 44 is added to this sub-assembly. To accomplish this, mounting protrusions 94 are inserted into the mounting cavities 72 of lower housing 42. When upper nozzle housing 44 is properly positioned, apertures 56, 74, 96 should all be in alignment. Moreover, channels 78 of lower housing 42 should be aligned with channels 100 of upper housing 44.

Next, nozzle interface 46 is added to the assembly. Nozzle interface 46 is placed upon the upper surface of upper nozzle housing 44 with alignment ring 98 extending upwards through aperture 112. Nozzle interface 46 is rotated in order to align apertures 114 of nozzle interface 46 with apertures 56, 74, 96.

A piezoelectric device 290 (see FIG. 1) is attached to the base 76 of lower housing 42. In the present embodiment, piezoelectric device 290 is configured to create a spark when contacted by a moving component, as will be described later. Piezoelectric device 290 may be of any type known in the art.

Fasteners (not shown) retain the dispersal mechanism 14 in this assembled configuration. Specifically, fasteners are inserted into apertures 56, 74, 96 and 114 in a manner to retain the mechanism 14.

Referring now to FIGS. 1 and 2, housing 12 is next assembled. To accomplish this, sleeve 24 is inserted into bore 22. Sleeve 24 may be retained via a press fit or in any other known manner.

After sleeve 24 is inserted into bore 22, housing 12 is affixed to dispersal mechanism 14. To accomplish this, protrusions 30 are inserted into slots 118 of nozzle interface 46. Housing 12 is then rotated so that protrusions 30 travel along ramp guides 116 thereby pulling housing 12 toward dispersal mechanism 14 and retaining housing 12 thereto in a known manner.

Once housing 12 has been attached to dispersal mechanism 14, a fine metal powder 270, for example aluminum particles with high reactivity in air and good combustion efficiency without being pyrophoric, is added to the interior portion of sleeve 24. A foil seal (not shown) is utilized to retain the powder 270 within sleeve 24. In the present embodiment, foil seal has sufficient strength to ensure powder 270 does not prematurely exit sleeve 24. However, foil seal does break when sufficient force is applied in order to allow powder 270 to exit sleeve 24. In the present embodiment, powder 270 constitutes a third of the volume of sleeve 24.

Following the addition of the metallic powder 270 to sleeve 24, piston 272 is inserted into sleeve 24. In the present embodiment, piston 272 is sized to form a seal with sleeve 24 that is substantially air tight. However, piston 272 must also be sized with respect to sleeve 24 to allow piston 272 to freely traverse the sleeve 24. Piston 272 may be manufactured of either metal or a durable plastic material.

Once piston 272 has been added to sleeve 26, a cartridge 280 is inserted into sleeve 26. Cartridge 280 may be of any known type. Cartridge 280 includes a cavity 282 defined by a thicker portion 286, a thinner portion 284, and an intermediate wall 288. Thinner portion 284 should be of sufficient thickness to ensure the pressurized inert gas does not rupture cartridge 280. However, thinner portion 284 must also be thin enough to be pierced in order to allow the pressurized inert gas to escape, when desired. In the present embodiment, the inert gas is carbon dioxide.

Now that housing 12 and dispersal mechanism 14 have been assembled, the assembly of the firing mechanism 16 will be described. Referring now to FIGS. 1 and 8-14*b*, fixed end 220 of actuator 136 is inserted into central aperture 204 of timer housing 134. When properly inserted, central walls 208 ensure proper location of actuator 136 with respect to internal timer housing 134.

Printed circuit board 138 is connected to actuator 136 in a known manner allowing printed circuit board 138 to activate actuator 136. In the embodiment depicted, printed circuit board 138 rests upon plate 200.

Whistles 140 are added to channels 170 of lower timer housing 130. In the present embodiment, whistles 140 are retained within the lower timer housing 130 via a frictional interference. In some embodiments of the invention, whistle 140 includes a lip (not shown) capable of interfering with lower timer housing 130 and upper timer housing 132, in order to ensure whistles 140 can not be expelled from the device 10.

The combination of internal timer housing 134, actuator 136 and printed circuit board 138 is now placed onto lower timer housing 130. Actuator 136 extends through aperture 164 of lower timer housing 130. When properly aligned, inner wall 168 and interlocking walls 206 interlock in the manner depicted in FIG. 1.

Referring again to FIGS. 1 and 8-14*b*, upper timer housing 132 is added to the sub-assembly including lower timer housing 130, internal timer housing 134, actuator 136, printed circuit board 138 and whistles 140. Specifically, upper timer housing 132 is placed upon lower timer housing 130. In the embodiment depicted, channels 184 align with channels 170. This alignment locates whistles 140 within channels 184. The switches (not shown) and LCD (not shown) within the upper timer housing 132 are electrically connected to the printed circuit board 138 via any known manner, thereby allowing the switches to input data into the printed circuit board 138 and the printed circuit board 138 to communicate electronically with the LCD.

Fasteners (not shown) extend through mounting apertures 162, 188, 202 of lower timer housing 130, upper timer housing 132 and internal timer housing 134, respectively. The fasteners retain the firing mechanism 16 in the assembled configuration thereby allowing firing mechanism 16 to be added to the sub-assembly comprising housing 12 and dispersal mechanism 14. In the present embodiment, housing 12 is inserted into aperture 164 of lower timer housing 130 and retained therein by way of a snap-fit engagement.

Figure 15:
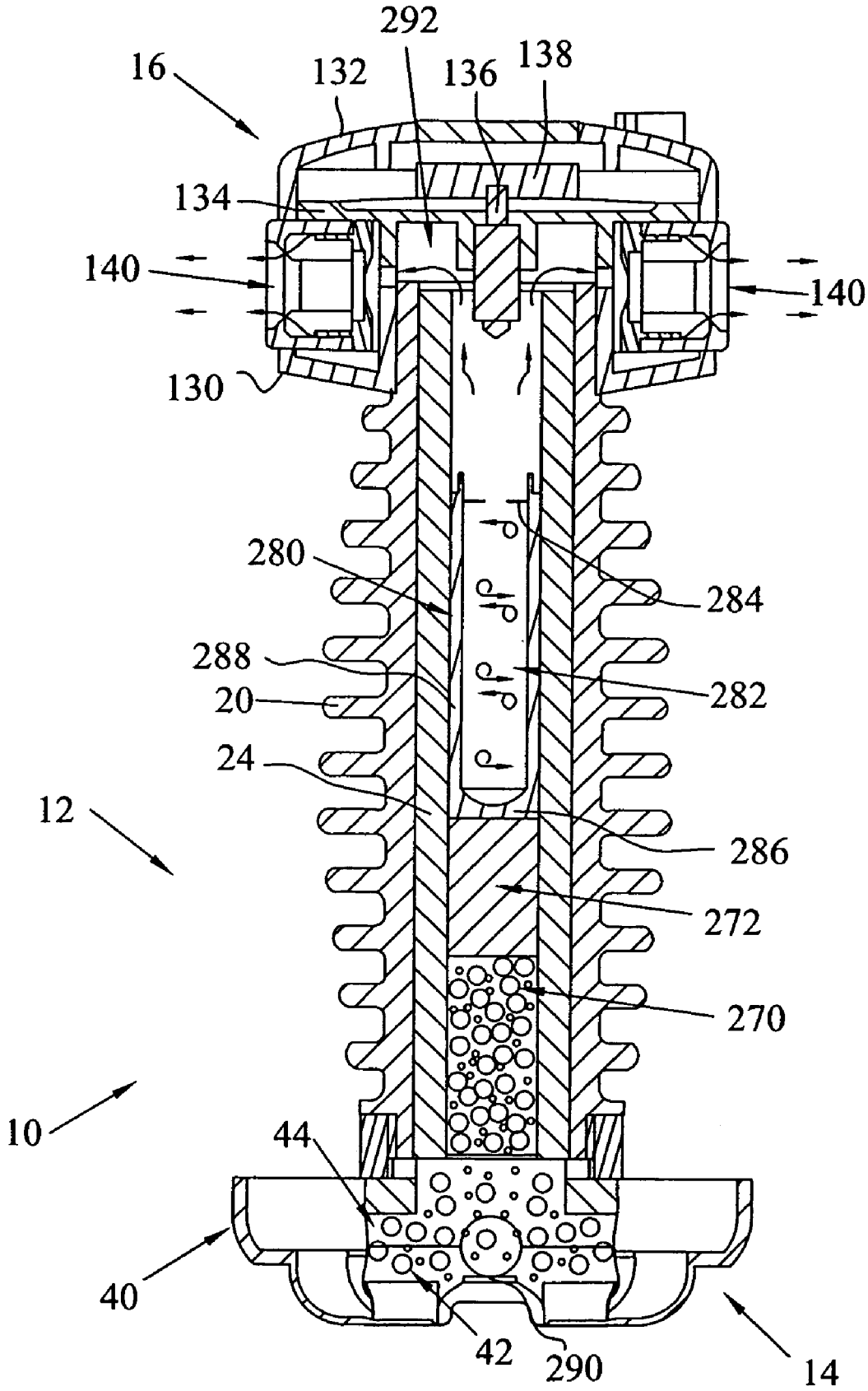
FIGS. 15 and 16 illustrate the configuration of device 10 during various times of operation.
Figure 16:
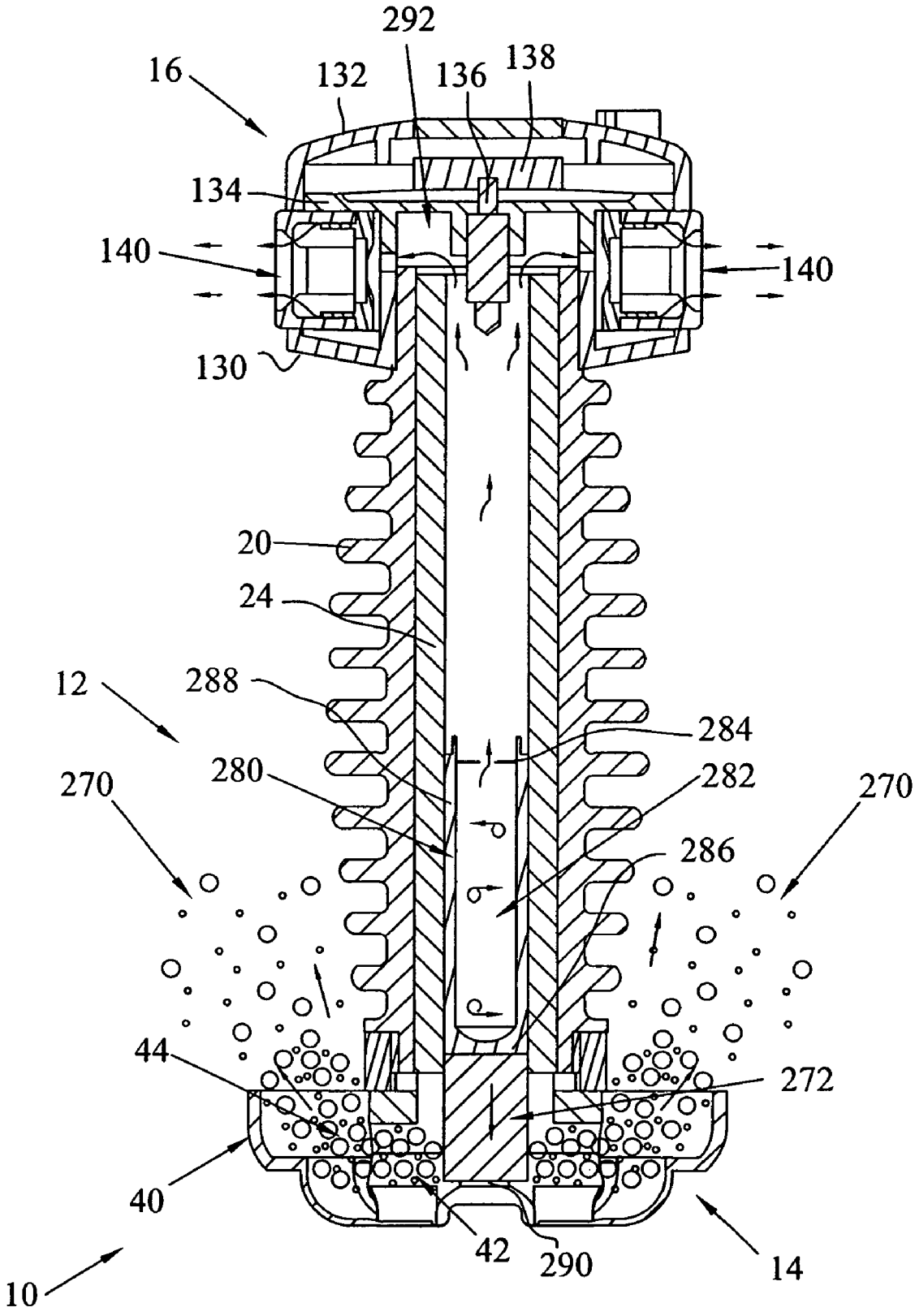

Now that the assembly of device 10 has been described in detail, the function of device 10 will now be described. Referring to FIGS. 1, 15 and 16, a user inputs a firing time via the switches. The LCD displays the firing time as the user depresses the switches. As explained above, printed circuit board 138 controls the interaction between the switches and the LCD. Once the user sets the desired delay, the operator starts the countdown and throws the device. The printed circuit board 138 counts down, displaying the countdown on the LCD while doing so, until the countdown reaches 0. Once the countdown expires, the printed circuit board 138 sends a signal to actuator 136, thereby causing actuator 136 to fire.

The activation of actuator 136 by printed circuit board 138 results in moveable end 222 extending into cartridge 280 and puncturing the thinner portion 284 thereof. After the wall has been pierced, the pressurized inert gas escapes through the hole therein.

Referring now to FIG. 15, as the inert gas escapes through the newly made hole in cartridge 280, cartridge 280 begins to traverse sleeve 24 traveling toward dispersal mechanism 14. As cartridge 280 traverses sleeve 24, cartridge 280 drives piston 272, which in turn forces powder 270 to break the foil seal (not shown). Once the foil seal ruptures, powder 270 travels downward through apertures 92, 112 of upper housing 44 and nozzle interface 46, respectively. Once powder 270 contacts base portion 76 of lower housing 42, powder 270 exits dispersal mechanism 14 through the nozzles defined by channels 78, 100.

Upon exiting the nozzles, the powder 270 contacts the baffle ring 60 of deflector cup 40. Baffle ring 60 is sized and configured to prevent powder 270 from being dispersed in a horizontal plane and ensures powder 270 is directed upward and around device 10.

Once all of the powder 270 has been forced from sleeve 24 by piston 272, as shown in FIG. 16, piston 272 contacts piezoelectric device 290. Piezoelectric device 290 is configured to create a charge when piston 272 contacts the piezoelectric device 290. The charge created by the piezoelectric device 290 results in a spark capable of igniting the entire cloud of powder 270 encompassing the device 10. The powder 270 burns quickly, however, resulting in a non-injurious, disorientating flash.

At the same time that powder 270 is being forced out of sleeve 24, the inert gas continues escaping from the cartridge 280. The forced out inert gas travels upwards through sleeve 24 and into firing mechanism 16 filling chamber 292 defined by inner wall 168 of lower timer housing 130 and interlocking walls 206 of internal timer housing 134.

As the chamber 292 pressurizes with the inert gas, the inert gas exists the cavity 282 via slots 172 in inner wall 168. The pressurized inert gas contacts slots 248 in whistles 140. The slots 248 direct the gas into apertures 250. The gas then travels down exit channels 242. Once the gas clears the exit channels 242, the gas interacts with reed 254 preferably causing a disorientating sound in at least the decidable range of 90-180 dBs.

In this manner, the device 10 can disorientate a person by causing a loud sound via whistles 140, while also creating a disorientating flash of powder 270. It should be noted that since no part of the device 10, except powder 270, cartridge 280 and piezoelectric component 290, is permanently destroyed during use, the device 10 may be disassembled, filled with fresh power 270, a fresh cartridge 280 and a new piezoelectric component 290 and reused. Moreover, printed circuit board 138 may also be configured to count the number of times the device 10 has fired, so that when the device 10 has fired a preset number of times, printed circuit board 138 will no longer activate actuator 136.

It should also be noted that in embodiments of the device 10, a mechanism for blocking some of the slots 172 of lower timer housing 130 in order to prevent the flow of the inert gas into a portion of whistles 140. This blockage, in turn, reduces the volume of the sound produced by the device. Accordingly, a user, via this mechanism, may alter the volume output when desired, such as for training purposes.

FIGS. 17-38 depict an alternative embodiment of a diversionary device of the present invention. In order to simplify the description of this alternative embodiment of the invention, components identical to those utilized in the previous embodiment are generally indicated by the same reference numerals whereas new components present within this alternative embodiment are given new reference numerals. For the sake of brevity, common components between the two embodiments will not be described with respect to this alternative embodiment.

Figure 17:
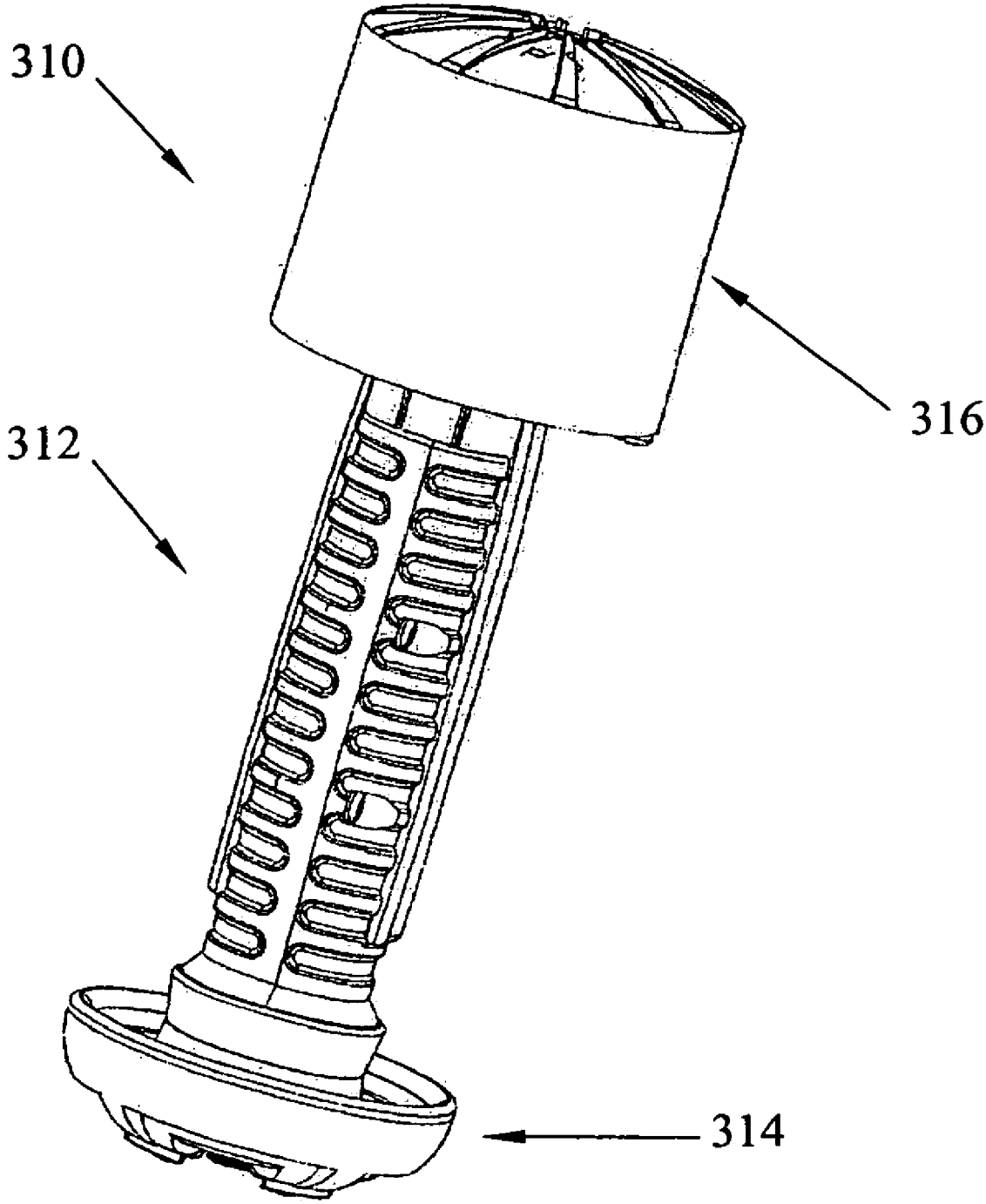
FIG. 17 depicts a perspective view of an alternative embodiment of a diversionary device of the present invention.

With reference first to FIG. 17, numeral 310 generally indicates an alternative device for creating a diversion. Device 310 includes housing 312, dispersal mechanism 314 and firing mechanism 316.

Figure 18:
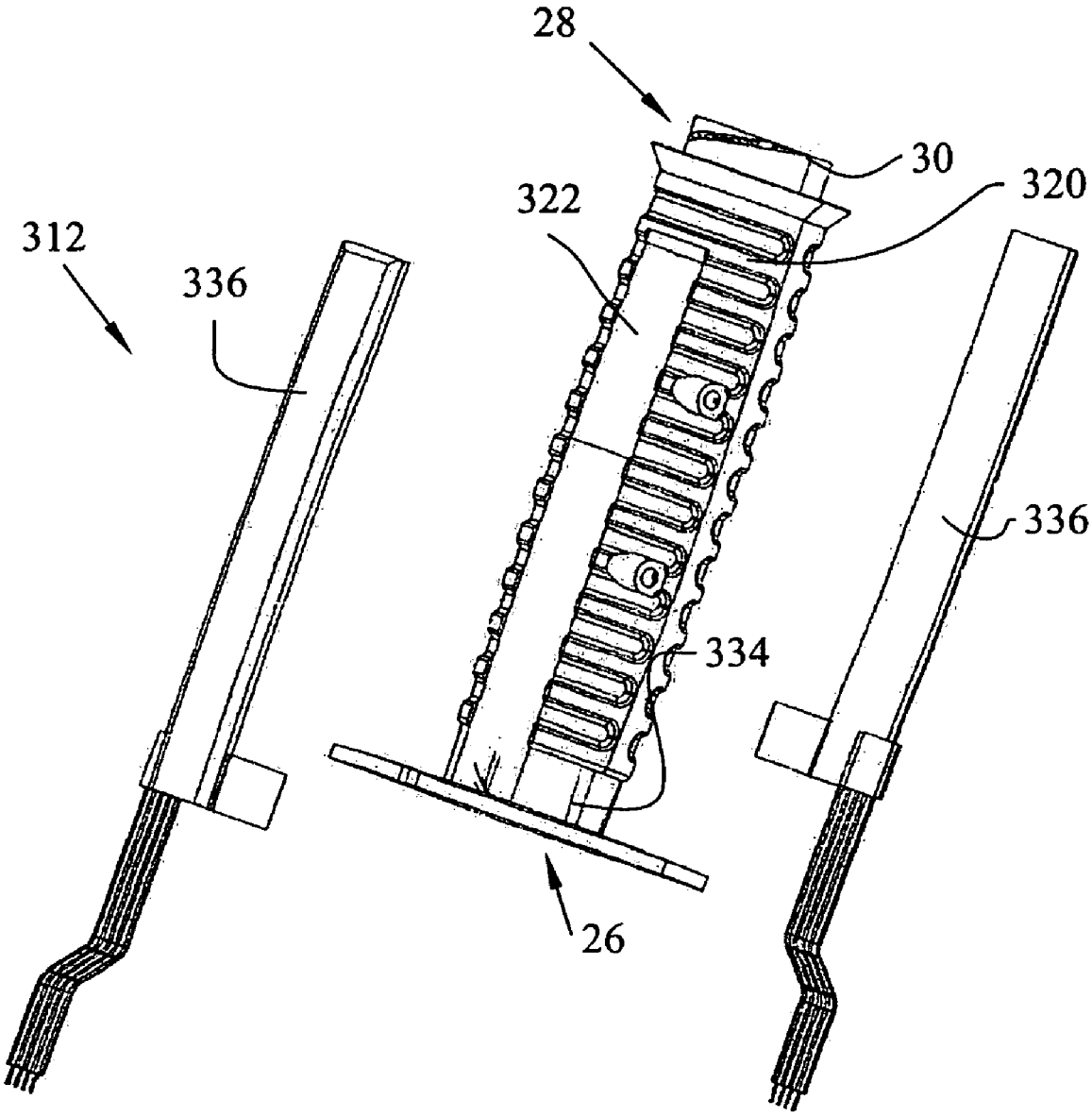
FIG. 18 depicts an exploded perspective view of a housing utilized in the embodiment of the invention depicted in FIG. 17.
Figure 19:
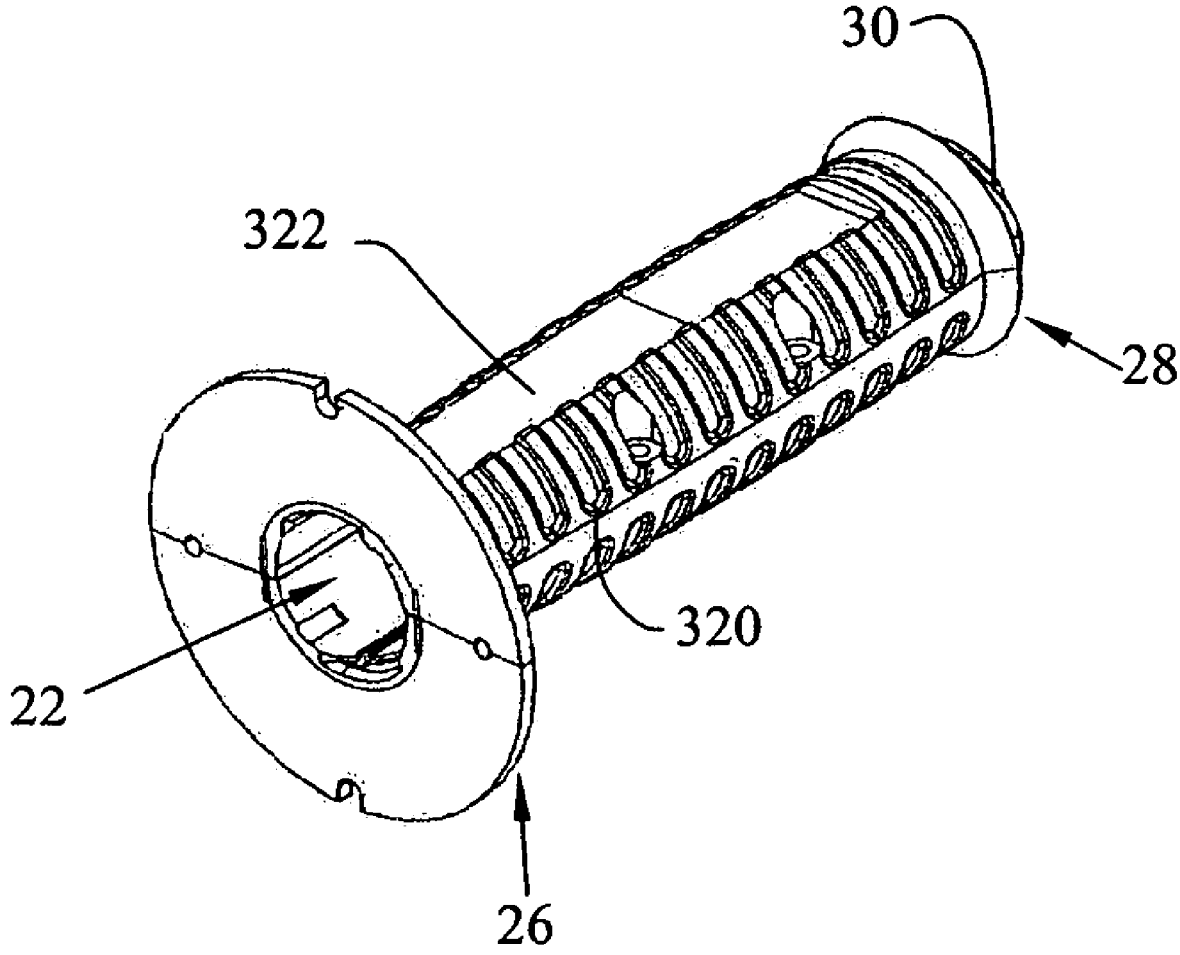
FIG. 19 depicts a perspective view of a handle portion of the housing depicted in FIG. 18.

FIG. 18 depicts housing 312. Housing 312 includes handle portion 320. As shown in FIG. 19, handle portion 320 includes a central bore 22 extending along the interior length thereof. As shown in FIGS. 18 and 19, handle portion 320 further includes a pair of slots 322 located in the outer surface thereof on opposite sides of bore 22. Slots 322 extend substantially the entire length of handle portion 320. Handle portion 320 further includes a recess 334 formed radially therein at first end 26. In addition, at second end 28 handle portion 320 further includes a pair of protrusions 30.

Housing 312 further includes a pair of membrane switches each generally indicated by numeral 336. Membrane switches 336 may be any known type in the art. In the present embodiment, each membrane switch resides in one of slots 332 and partially within recess 334.

Figure 20:
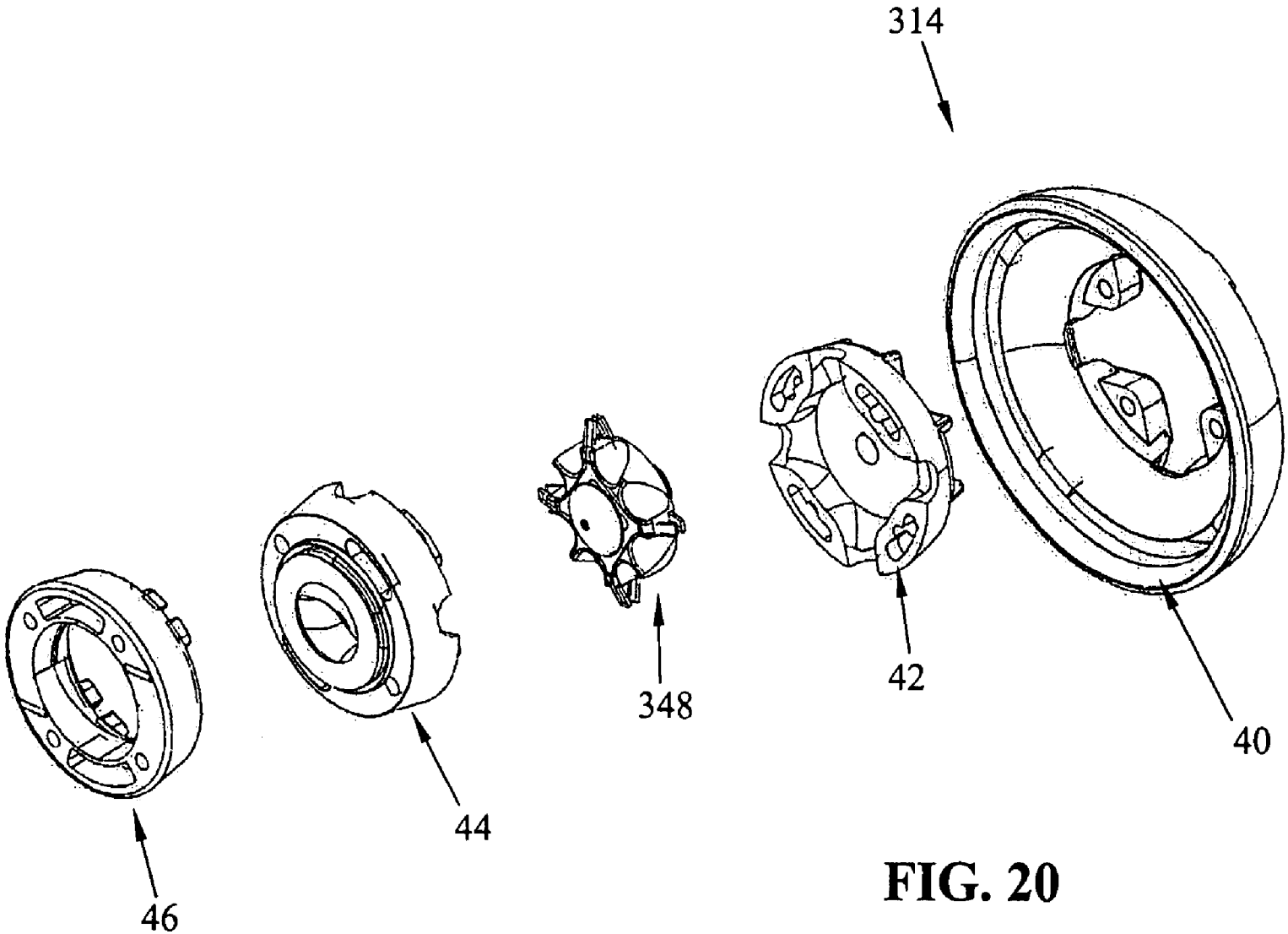
FIG. 20 depicts an exploded perspective view of a dispersal mechanism utilized in the embodiment of the invention depicted in FIG. 17.

FIG. 20 depicts an exploded perspective view of dispersal mechanism 314. Dispersal mechanism 314 includes deflector cup 40, lower nozzle housing 42, upper nozzle housing 44, nozzle interface 46 and igniter assembly 348.

Figure 21:
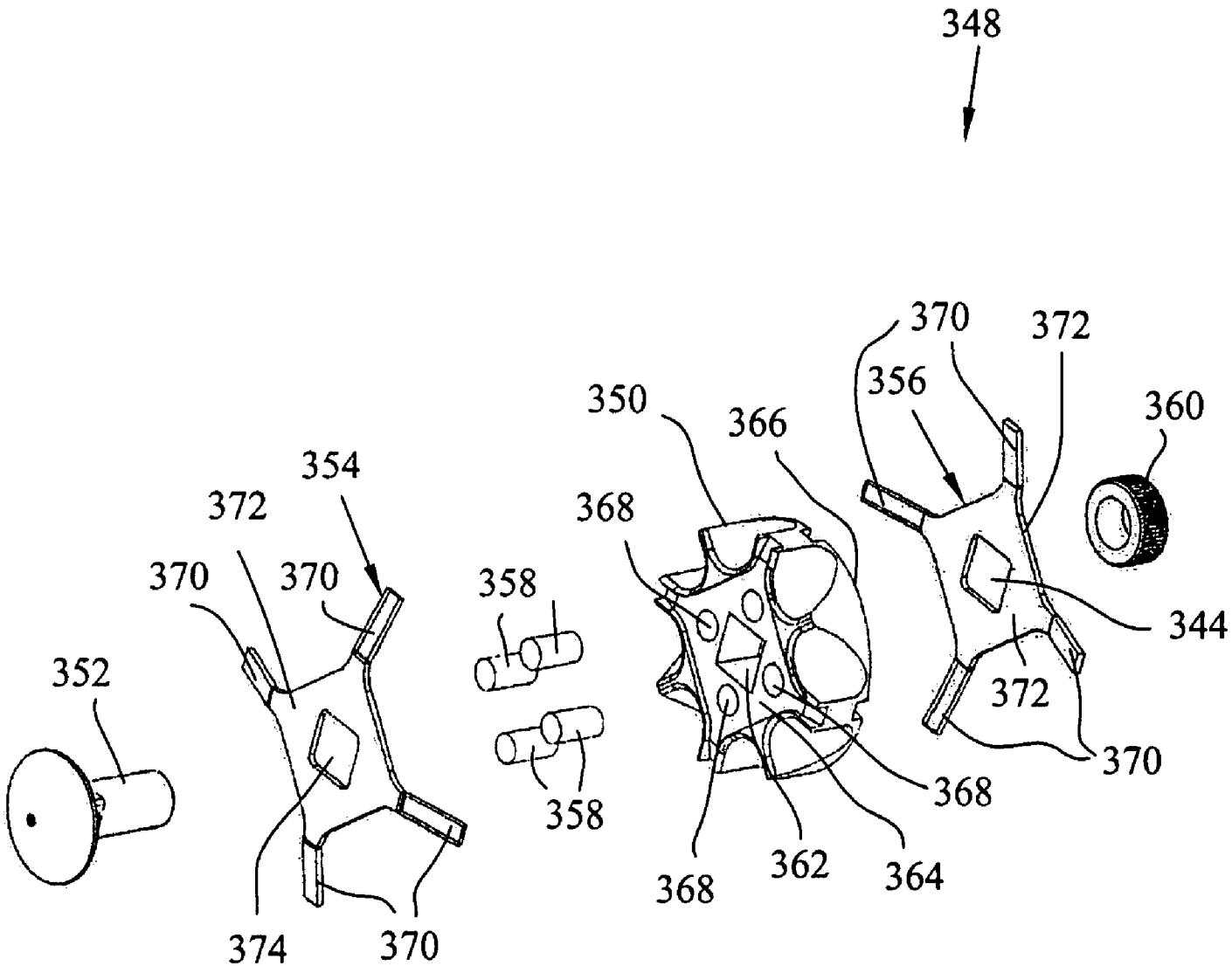
FIG. 21 depicts an exploded perspective view of an igniter assembly of the dispersal mechanism depicted in FIG. 20.

FIG. 21 depicts an exploded perspective view of igniter assembly 348. Igniter assembly 348 includes dielectric igniter 350, carriage bolt 352, a first igniter conductor 354, a second igniter conductor 356, a plurality of piezo igniters each generally indicated by numeral 358, and a nut 360.

Dielectric igniter 350 may be manufactured from any material known in the art. In the present embodiment, dielectric igniter 350 includes a central bore 362 extending from upper surface 364 to lower surface 366. Central bore 362 is located approximately in the center of surfaces 364, 366. Dielectric igniter 350 further includes a plurality of outer bores 368 substantially surrounding central bore 362. The outer bores 368 also extend from upper surface 364 to lower surface 366. In addition, the outer bores 368 have a shape complementary to the piezo igniters 358.

Referring still to FIG. 21, upper surface 364 of dielectric igniter 350 includes a recess complementary to the shape of the first igniter conductor 354. Similarly, lower surface 366 of dielectric igniter 350 also includes a recess complementary to second igniter conductor 356. In the present embodiment, first igniter conductor 354 and second igniter conductor 356 both have identical shapes and are comprised of any conductive material. Each igniter conductor 354, 356 includes four arms indicated by numeral 370 all extending outward from a main body 372. In the embodiment depicted, main body 372 is substantially planar with arms 370 extending outward at a slight angle. In the present embodiment the angle is identical for each of the arms 370 so that the tips thereof are all located in a single plane. Body 372 includes an aperture 374.

Referring still to FIG. 21, the present embodiment of igniter assembly 348 may be assembled by inserting piezo igniters 358 into the outer bores 368 of the dielectric igniter 350. Piezo igniters 358 may be of any type known in the art capable of creating an electric charge when compressed. First igniter conductor 354 is then inserted to the recess of upper surface 364. Similarly, second igniter conductor 356 is inserted into the recess of lower surface 366. The igniter conductors 354, 356 are situated such that the tips of the arms 370 are separated by a smaller distance than the distance separating bodies 372. Once the igniter conductors 354, 356 have been arranged into proper position, carriage bolt 352 is inserted into central bore 362 of dielectric igniter 350 through aperture 374 of igniter conductor 354. Bolt 352 also extends outward from aperture 374 of second igniter conductor 356.

Figure 22:
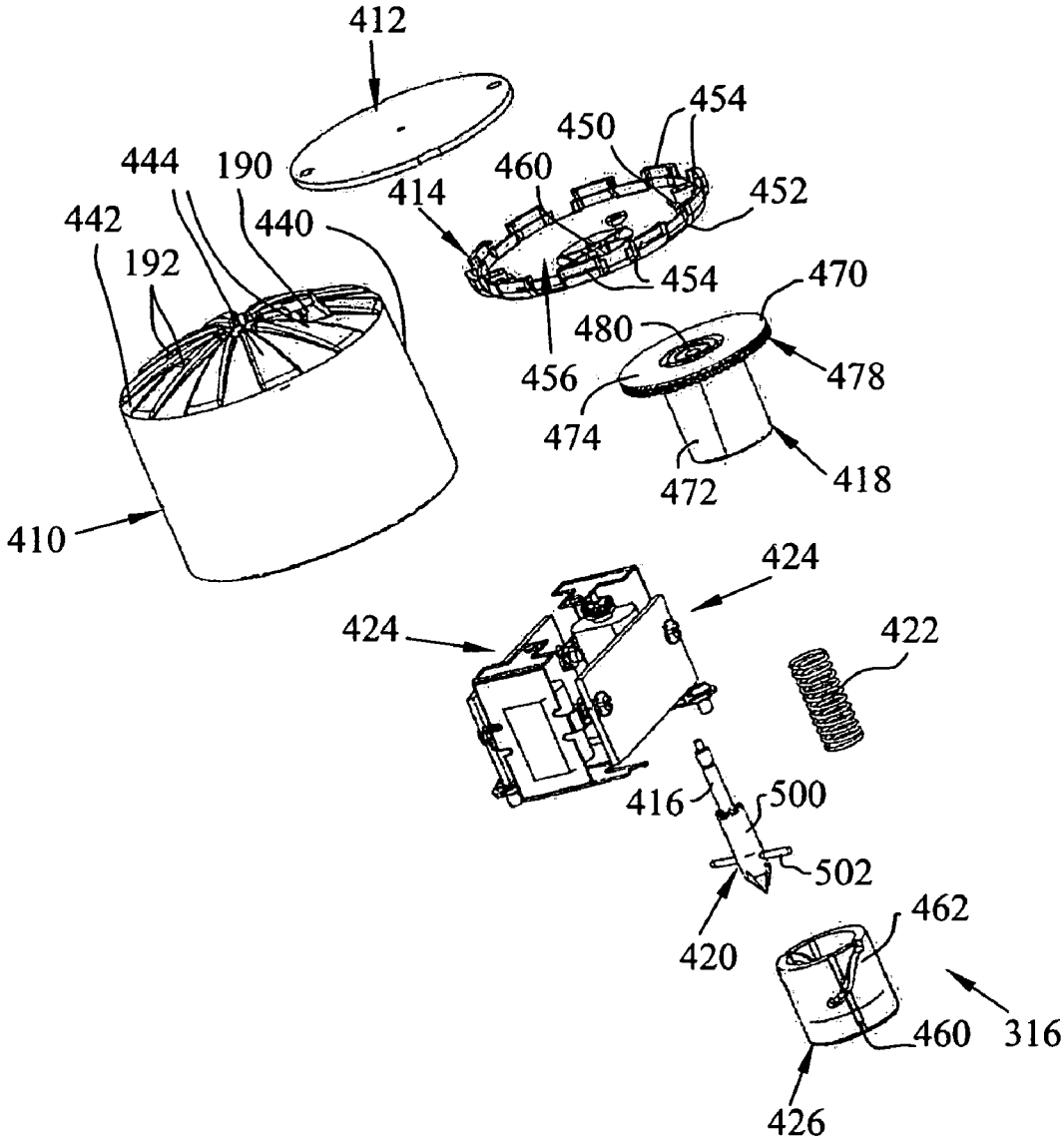
FIG. 22 depicts an exploded perspective view of a firing mechanism utilized in the embodiment of the invention depicted in FIG. 17.

FIG. 22 depicts an exploded perspective view of firing mechanism 316. In the embodiment depicted, firing mechanism 316 includes timer housing 410, controller PCB 412, deflector 414, shaft 416, impeller 418, firing pin 420, spring 422, a pair of motor assemblies each indicated by numeral 424 and cylindrical cam 426. In the present embodiment, timer housing 410 comprises a single piece and may be manufactured from plastic or similar material. As shown in FIG. 22, timer housing 410 includes cylindrical wall 440 and an upper surface 442. Upper surface 442 includes a plurality of stiffening ribs 444 for increasing the resiliency thereof. Upper surface 442 further includes LCD opening 190 and a plurality of switch openings 192.

Referring still to FIG. 22, controller PCB 412 comprises any type of PCB known in the art that allows for logical control of electric circuits. In the present embodiment, controller PCB 412 substantially has a disc shape.

Deflector 414 may be manufactured of any substantially rigid material such as plastic. Deflector 414 includes an upper surface 450 and a lower surface 452. Upper surface 450 includes a plurality of vertically extending guides 454 defining a PCB receiving area 456. As shown in FIG. 22, upper surface 450 further includes an aperture 460 extending through the center of the upper and lower surfaces 450, 452.

Shaft 416 may be manufactured from any material with high strength and corrosion resistance such as stainless steel for example. The outer diameter of shaft 416 should be sized to allow shaft 416 to extend through aperture 460 of deflector 414. Furthermore, the outer surface of shaft 416 should be substantially smooth.

Figure 23:
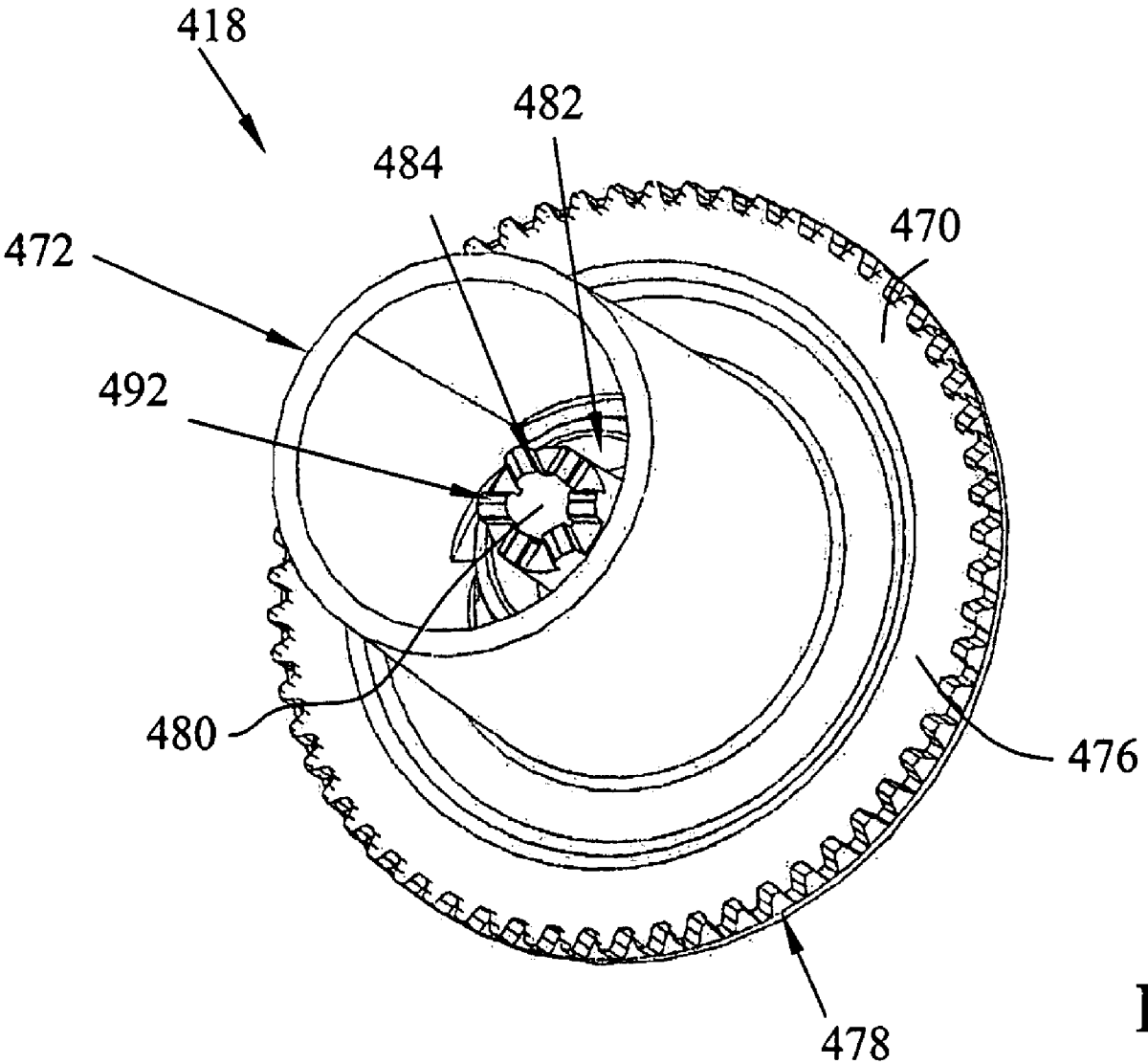
FIG. 23 depicts an impellor utilized by the firing mechanism depicted in FIG. 22.
Figure 24:
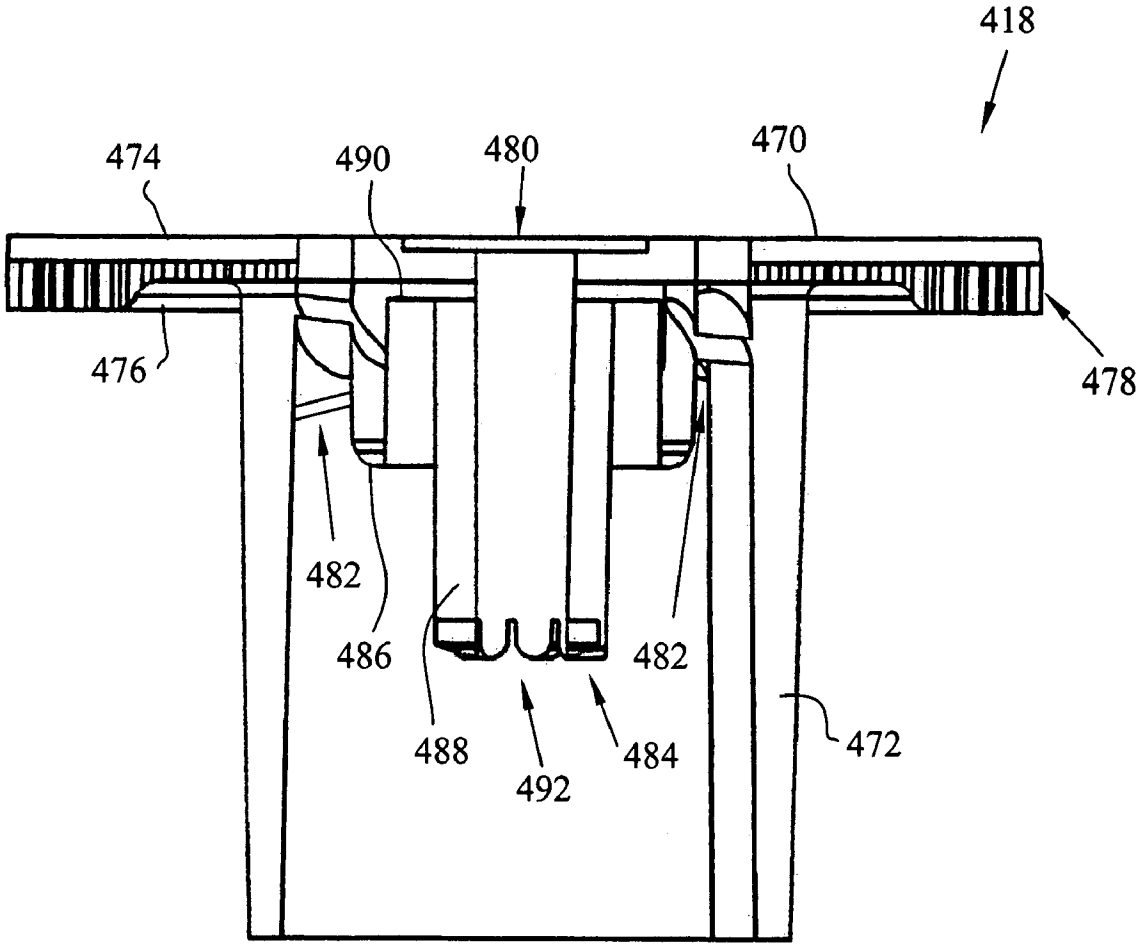
FIG. 24 depicts a section view of the impellor depicted in FIG. 23.

Referring now to FIGS. 22, 23 and 24, impeller 418 may be manufactured from any resilient material such as an injection molded plastic. In the present embodiment, impeller 418 includes a head 470 and a body 472. The majority of head 470 is substantially disc shaped with body 472 forming a cylinder extending downward therefrom. Head 470 includes an upper surface 474 and a lower surface 476. Lower surface 476 includes a plurality of gear teeth 478 extending along the outer edge thereof. Impeller 418 further includes an aperture 480 extending through the longitudinal center thereof from upper surface 474 of the head 470 through the cylindrical portion of body 472. Head portion 470 further includes a plurality of vanes 482 surrounding the aperture 480. The vanes 482 are configured to create rotation of impeller 418 when a gas or other fluid passes through the vanes 482 from lower surface 476 to the upper surface 474. In the present embodiment, the vanes 482 are located inward of the connection between head portion 470 and body 472.

As shown in FIG. 24, impeller 418 further includes an arrangement 484 extending downward from lower surface 476. Arrangement 484 is located inward of vanes 482 and surrounds aperture 480. Arrangement 484 includes an outer wall 486 encircling aperture 480 and located adjacent to vanes 482. Outer wall 486 generally defines a cylinder extending downward from lower surface 476. Arrangement 484 further includes an inner cylinder 488 located adjacent aperture 480. The portion of arrangement 484 located intermediate outer wall 486 and inner cylinder 488 defines land 490. In the present embodiment, inner cylinder 488 includes a plurality of splines 492 formed in the lower surface thereof.

Figure 25:
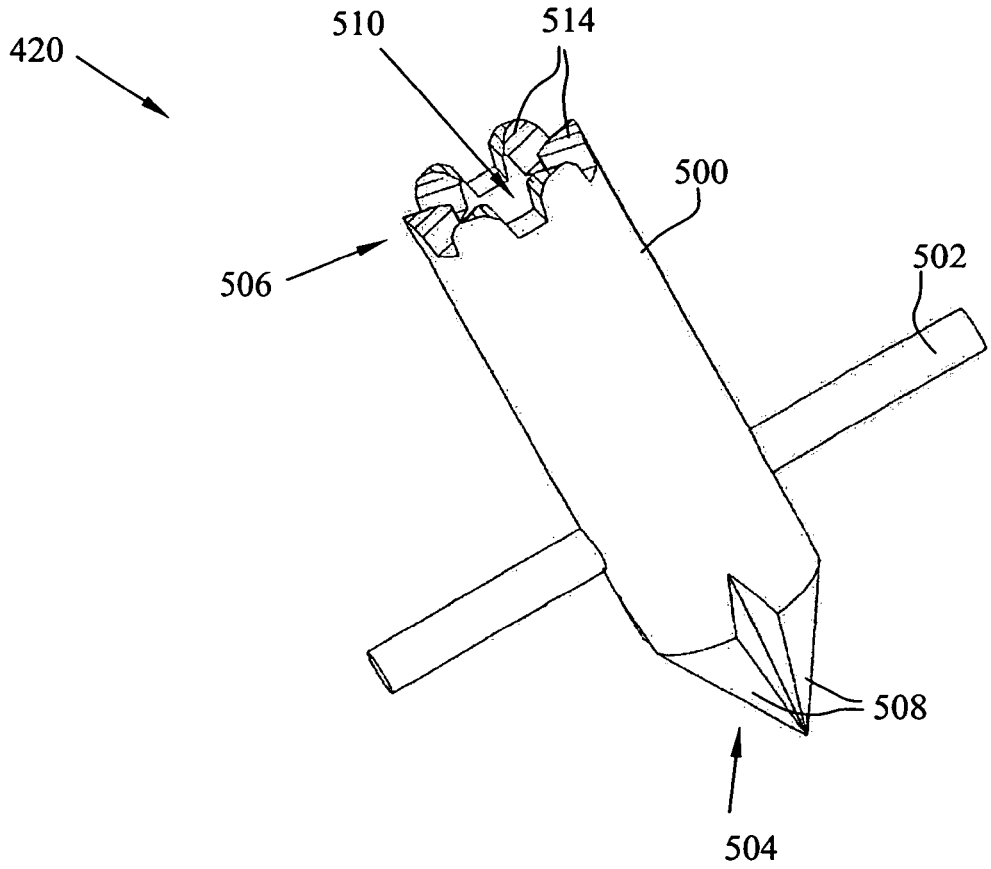
FIG. 25 depicts a firing pin utilized by the firing mechanism depicted in FIG. 22.

Referring now to FIGS. 22 and 25, firing pin 420 includes a main body 500 and a dowel 502. Firing pin 420 may be manufactured from any tough, strong material such as stainless steel. Main body 500 has a substantially cylindrical shape with a smooth outer surface and includes a first end 504 and a second end 506. Main body 500 further includes a transverse channel (not shown) through which dowel pin 502 extends. In the present embodiment, first end 504 includes a plurality of flutes 508 which come to a sharp point. Second end 506 includes an aperture 510 forming a channel extending from second end 506 toward first end 504. The channel is sized to receive shaft 416 and allow firing pin 420 to rotate about shaft 416 without binding. In the present embodiment, second end 506 further includes a plurality of splines 514. Splines 514 are configured to mate with splines 492 of impeller 418.

As shown in FIG. 22, firing mechanism 316 further includes a spring 422 manufactured from any known spring material. Spring 422 is sized to receive firing pin 420 within the coils. Specifically, the interior diameter of spring 422 is large enough to receive main body 500 but is small enough such that dowel 502 will not pass perpendicularly therethrough. In addition, spring 422 should be sized such that the upper surface thereof will fit within the land area 490 of impeller 418.

Figure 26:
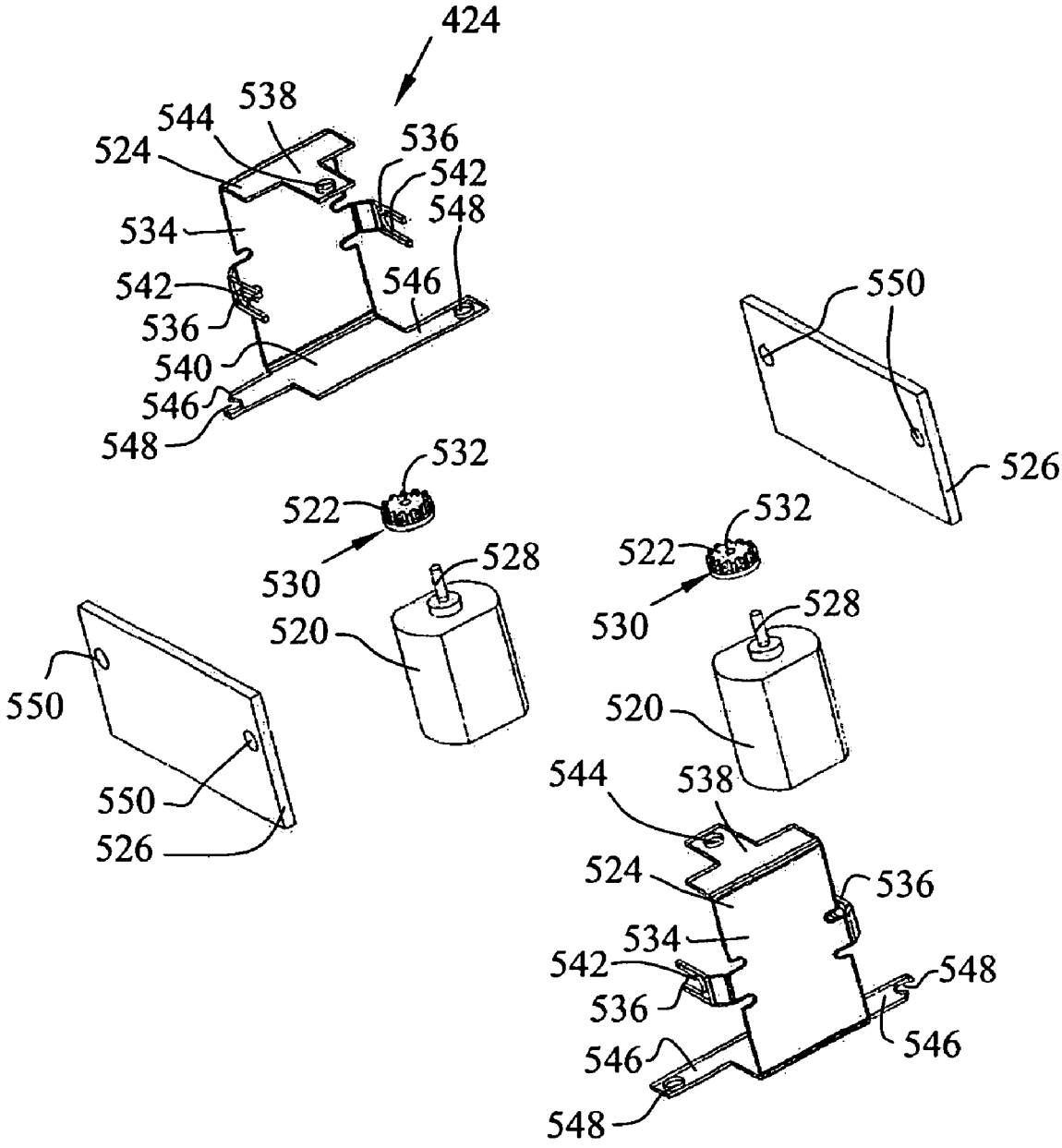
FIG. 26 depicts an exploded perspective view of a pair of motor assemblies utilized by the firing mechanism depicted in FIG. 22.

Referring now to FIGS. 22 and 26, firing mechanism 316 includes a pair of motor assemblies 424 each comprising a motor 520, a gear 522, a motor bracket 524 and a PCB 526. Motors 520 may be of any known type. For example, in the present embodiment, motors 520 run from direct current and include a motor shaft 528 extending vertically along the longitudinal axis of the motor.

Gears 522 may be manufactured from any strong material and in the present embodiment are substantially disc shaped. Gears 522 include a plurality of teeth 530 located around the circumference thereof. In the present embodiment, teeth 530 are configured to have a shape complimentary to that of the teeth 478 in the impeller 418. Gears 522 further include an aperture 532 extending substantially through the center thereof.

Each motor bracket 524 may be manufactured from stainless steel or similar material. In the present embodiment, motor brackets 524 include a back 534, a pair of arms each indicated by numeral 536, a top 538 and a bottom 540. In the present embodiment, back 534 is substantially planar and rectangular shaped. Arms 536 extend forward from back 534 and each arm 536 includes a slot 542 formed in the forward edge thereof. Top 538 is located along the upper edge of back 534 and extends forward in the same direction as arms 536. Top 538 includes an aperture 544 extending therethrough. Bottom 540 extends forward from the edge of back 534 located opposite top 538. Bottom 540 includes a pair of feet 546 extending outward therefrom. Each of the feet 546 includes an aperture 548 extending therethrough.

PCBs 526 may be manufactured in accordance with any PCB known in the art. Each PCB 526 includes a pair of apertures generally indicated by numeral 550.

Now that the components of the motor assembly 424 have been generally described, the steps of assembling a motor assembly 424 will now be set forth. It should be noted that these steps may be altered as desired by one generally skilled in the art and are set forth herein merely as an example of an assembly procedure. First, each motor 520 is connected to motor bracket 524. Specifically, motor bracket 524 is configured such that motors 520 may be connected to the motor brackets 524 in any known manner. It should be noted that the motor brackets 524 are sized such that motors 520 fit in the area defined by the back 534, arms 536, top 538 and bottom 540 of the motor brackets 524. When properly located in bracket 524, motor shaft 528 extends through aperture 544.

Next, one of each of the gears 522 is connected to motor 520 by inserting motor shaft 528 into aperture 532 of gear 522.

Once the motors 520 have been joined to the motor brackets 524 and gears 522 have been attached, the PCBs 526 are then affixed to the motor brackets 524. Specifically, fasteners (not shown) are inserted into the apertures 550 of each PCB 526. The fasteners (not shown) extend through the apertures 550 into slots 542 of the arms 536. It should be noted that in the present embodiment, each PCB 526 is connected to each of the motor brackets 524. Once the PCBs 526 have been connected to the motor brackets 524, the motors 520 are then electrically connected to the PCBs 526 allowing the PCBs 526 to control the rotation of the motors 520.

Figure 27:
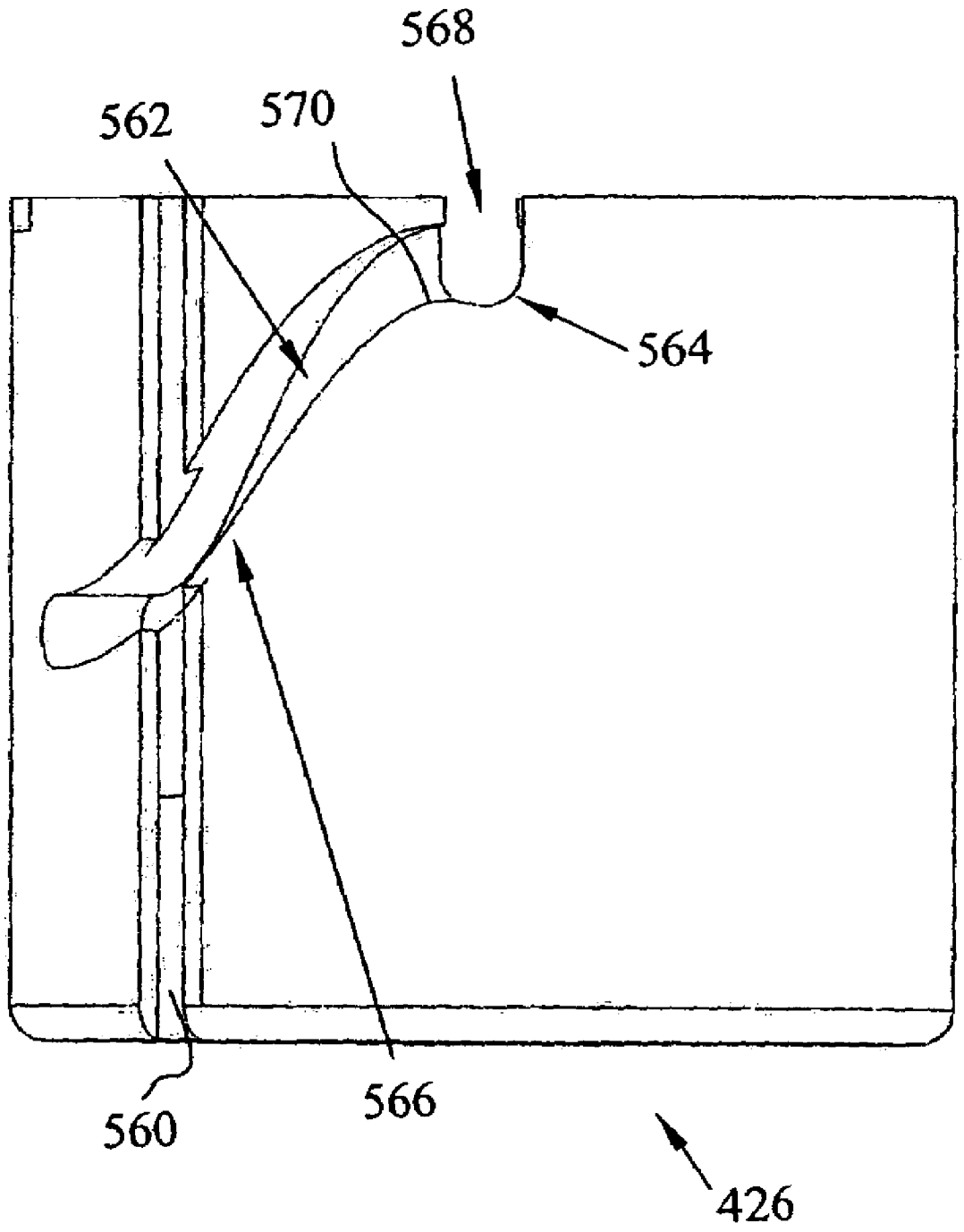
FIG. 27 depicts a side view of a cylindrical cam utilized by the firing mechanism depicted in FIG. 22.

Referring now to FIGS. 22 and 27, cylindrical cam 426 has a substantially cylindrical shape and may be manufactured from any strong material. Cylindrical cam 426 is hollow with the inner surface being substantially smooth. The outer surface of cylindrical cam 426 is also substantially smooth and includes a pair of slots 560 extending parallel to the longitudinal axis thereof. The slots 560 are located on opposite sides of the cam 426 and extend through the corresponding cylindrical wall. Cylindrical cam 426 further includes a pair of traces 562. Each trace 562 is formed on the outer surface of the cylindrical cam 426 and includes a first portion 564 and a second portion 566. First portion 564 includes an opening 568 in the upper surface of cylindrical cam 426. In addition, first portion 564 further includes a stop 570, comprising a raised portion of the bottom surface of the trace 562. Conversely, second portion 566 is substantially smooth with no stops and does not open in the bottom surface or the top surface of the cam 426. In the present embodiment, each of the traces 562 is sized to receive dowel 502 of firing pin 420.

Now that the major components of the present embodiment have been described, assembly of the diversionary device will be described in detail. It should be noted that this description is being given for exemplary purposes only and, as will be apparent to one of ordinary skill in the art, the order of the assembly may be altered as desired in accordance with the present invention.

Figure 28:
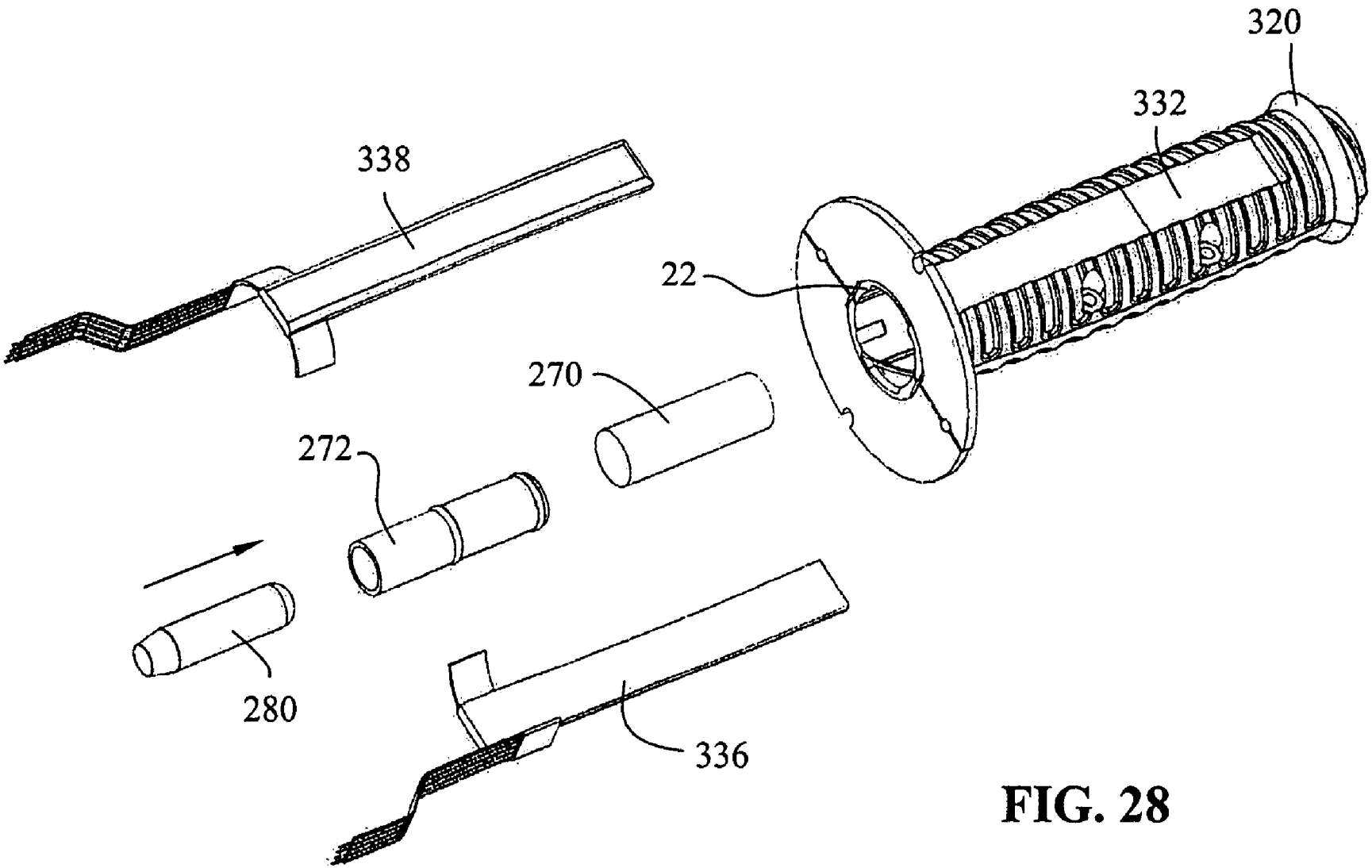
FIGS. 28 through 32 illustrate an example of the steps undertaken in assembling the embodiment of the invention depicted in FIG. 17.

The first step of the assembly of the present embodiment of the diversionary device 310 and requires that the housing 312 be assembled in substantially the same manner as described above with respect to the previous embodiment. Specifically with reference to FIG. 28, the bore 22 of housing 312 is packed with aluminum powder 270, piston 272, cartridge 280, as shown in FIG. 28. In the present embodiment, the membrane switches 336 and 338 must also be attached to the handle portion 320 in their respective slots 332 and recesses 334 by a known manner. At this time the switches 336, 338 are not connected electrically to any component.

Following the assembly of the handle, the dispersal mechanism 314 is assembled substantially in the manner as set forth above, as best shown with reference to FIG. 20. In the present embodiment, dispersal mechanism 314 further includes an igniter assembly 348. Igniter assembly 348 is positioned intermediate lower nozzle housing 42 and upper nozzle housing 44. In the present embodiment, igniter assembly 348 is maintained in a fixed position by the extension of carriage bolt 352 through the central bore 362 of dielectric igniter 350. Bolt 352 also extends through a central aperture (not shown) formed in the lower housing 42 and a central aperture (not shown) formed in the base 52 of deflector cup 40. Once carriage bolt 352 has been arranged such that the threaded portion extends outward from the deflector cup 40, nut 360 may then be threaded onto the carriage bolt 352 in order to maintain the igniter assembly 348 in its fixed position. Following the completed assembly of dispersal mechanism 314, the dispersal mechanism 314 may then be attached to housing 312 in a manner set forth above with respect to the previous embodiment of the invention as shown in FIG. 29.

Figure 29:
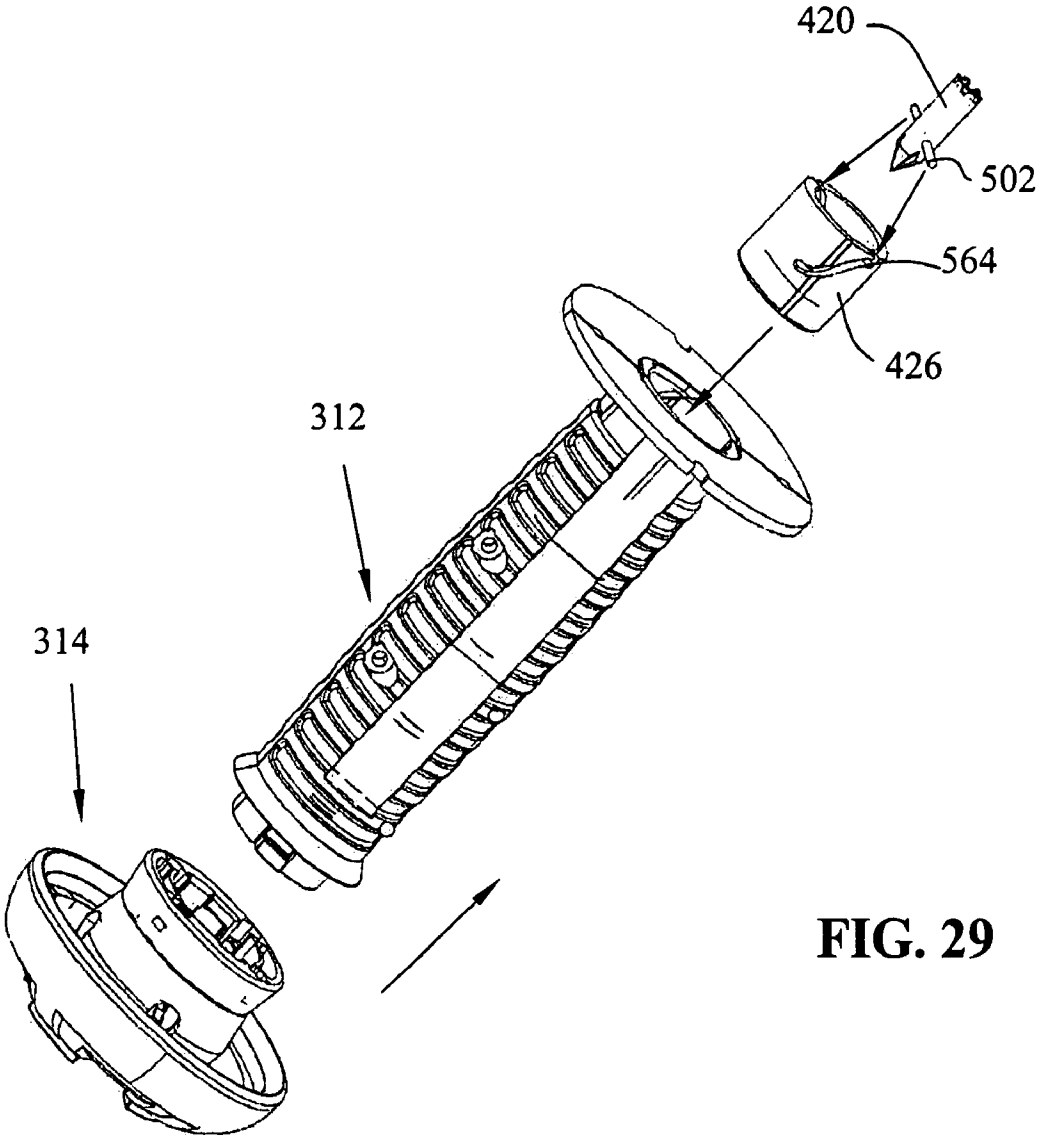

Following the connection of housing 312 to dispersal mechanism 314, the firing mechanism 316 may then be assembled referring still to FIG. 29. In order to accomplish this, cylindrical cam 426 is placed within the bore 22 of housing 312. It should be noted that in the present embodiment, a portion of cylindrical cam 426 will extend above housing 312.

Firing pin 420 is then inserted into cylindrical cam 426. Specifically, firing pin 420 is arranged such that first end 504 is located within the confines of cylindrical cam 426 while second end 506 extends above cylindrical cam 426. Once firing pin 420 has been positioned within cylindrical cam 426, dowels 502 of firing pin 420 rest within the first portion 564 of trace 562.

Figure 30:
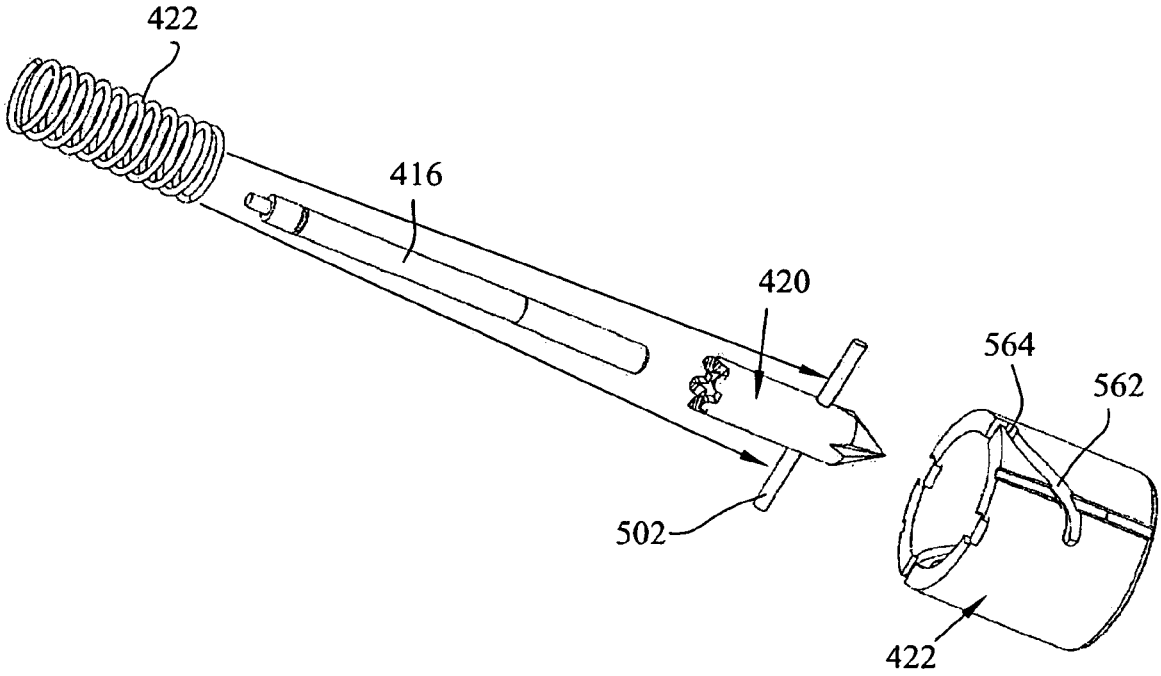

Next, spring 422 is placed upon firing pin 420 such that the main body 500 of firing pin 420 is located in the central portion of spring 422 as shown in FIG. 30. In FIG. 30, housing 312 is not shown in order to clearly depict this portion of the assembly process. It should be noted that spring 422, when positioned properly, rides on dowel 502 of firing pin 420. In an embodiment of the invention, a Teflon™ ring, or similar type component, may be located intermediate spring 422 and dowel 502 of firing pin 420.

Figure 31:
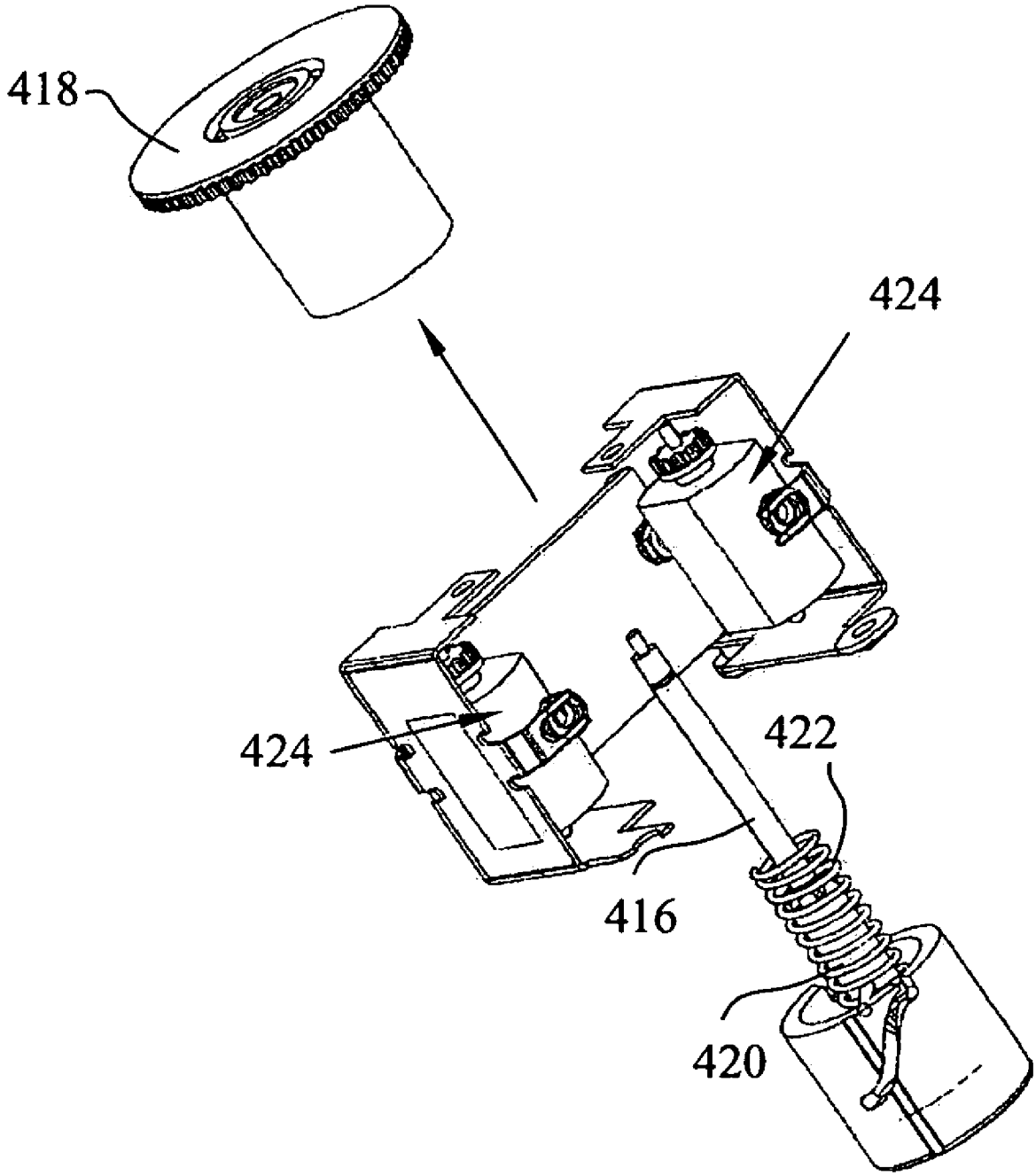

Shaft 416 may then be inserted into impeller 418 such that shaft 416 extends through aperture 480 of impeller 418 as shown in FIG. 31, in which a PCB included in one of the motor assemblies 424 has been omitted. Again, housing 312 has been omitted from view in order to more clearly describe this portion of the assembly process. Shaft 416 may be affixed to impeller 418 in any known fashion allowing impeller 418 to rotate with respect to shaft 416.

Once shaft 416 has been attached to impeller 418, this combination may be placed upon firing pin 420 and spring 422. Specifically, shaft 416 should extend through aperture 510 of the firing pin 420. In addition, spring 422 should contact land 490 of impeller 418. In embodiments of the invention, it is anticipated that a Teflon™ ring or similar type component may be located intermediate land 490 and spring 422. Furthermore, it should also be noted that once impeller 418 has been properly located, splines 492 of impeller 418 should engage splines 514 of firing pin 420.

With reference still to FIG. 31, following the placement of spring 422 onto firing pin 420, the motor assemblies 424 are placed upon and affixed to handle portion 320 by a plurality of fasteners (not shown). In an embodiment of the invention, it is anticipated that fasteners extend upward through a portion of handle portion 320 and into apertures 574 of the motor brackets 524. In this manner, the fasteners would affix the motor assembly 424 to the housing 312. It should be noted that the distance separating the motors 520 and PCBs 526 is sufficient to receive impeller 418. When properly located, gears 522 should engage impeller 418.

Figure 32:
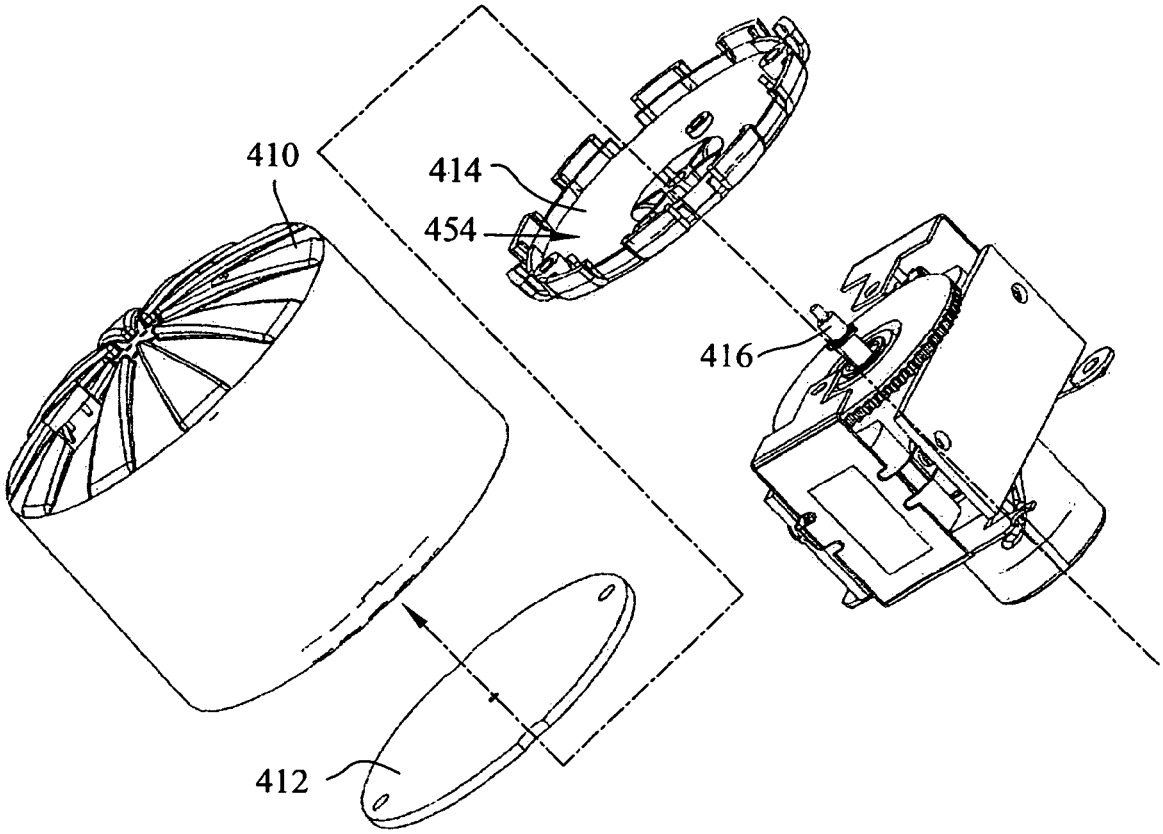

In order to complete the assembly, deflector 414 is placed upon shaft 416 such that shaft 416 extends through aperture 460 of deflector 414 as shown in FIG. 32. Next, controller PCB 412 is positioned within deflector 414 in PCB receiving area 456. Once controller PCB 412 has been positioned within deflector 414, PCB 412 should be electrically connected to the membrane switches 336, 338 and PCBs 526 of the motor assembly 424 in a manner understood by one with ordinary skill in the art. In the present embodiment, it is envisioned that the PCBs 412, 526 will control a countdown timer (not shown) and the motors 520. Once PCB 412 has been positioned within deflector 414, timer housing 410 is affixed to handle portion 320 in any known manner, thereby sealing the firing mechanism 360 and completing the assembly of the device.

Figure 33:
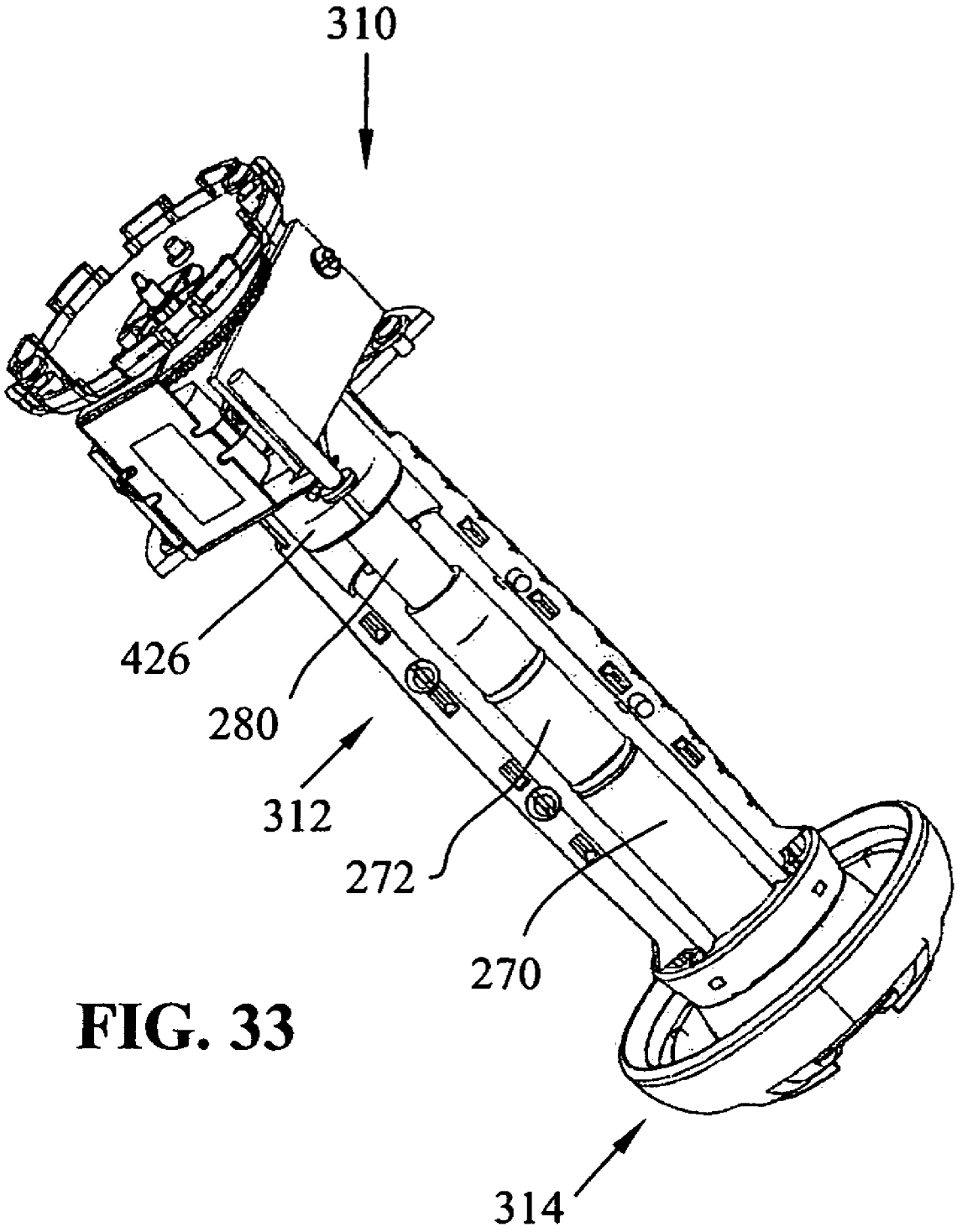
FIGS. 33 through 38 illustrate the configuration of the device depicted in FIG. 17 at various times during operation.
Figure 34:
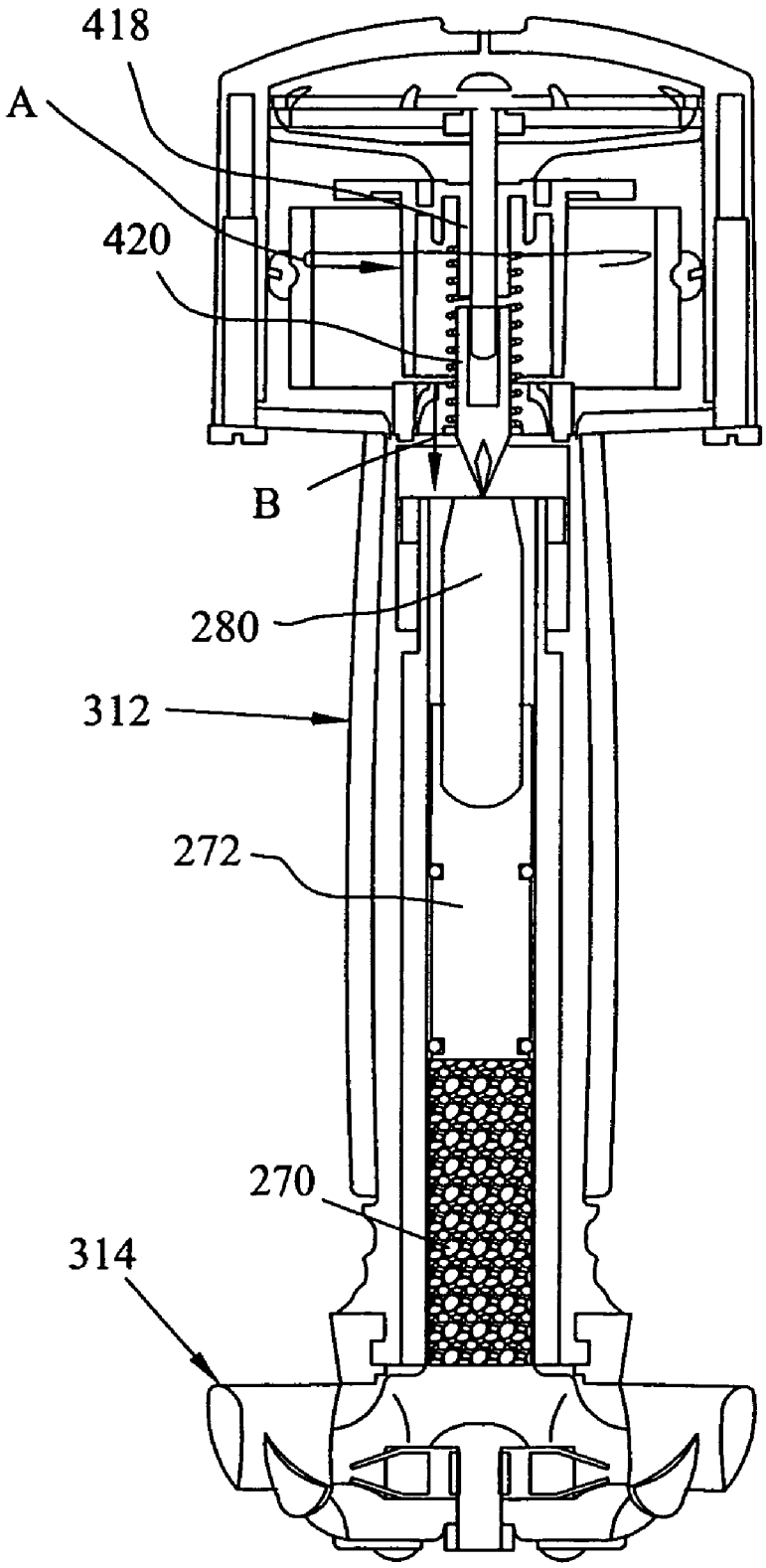

Now that the assembly of device 310 has been described, the function of device 310 will be described below with reference first to FIGS. 17 and 33. In FIG. 33, a portion of the housing 312 and the timer housing 410 have been omitted in order to more clearly show function of the device 310. In the present embodiment, membrane switches 336, 338 control actuation of the device 310. Specifically in this embodiment, membrane switches 338 are used to set the delay between the arming of the device and activation thereof. In embodiments of the invention, this time delay may be displayed in an LCD screen (not shown) positioned within LCD opening 190 of timer housing 410.

Once the desired time has been set using the membrane switches 338, the device may be armed by pressing membrane switches 336. It is anticipated that once an operator arms the device, the operator would throw the device toward the intended target. During this time the counter counts down toward zero. Once the counter reaches zero, the logic in the PCBs 412, 526 activates motors 520 causing rotation of gears 522. The intermeshing of gears 522 and impeller 418 in turn causes rotation of impeller 418 about shaft 416 as indicated by arrow "A" in FIG. 34. Furthermore, the interconnection between impeller 418 and firing pin 420 by way of splines 492 and 514, respectively, causes rotation of firing pin 420. The motors 520 continue to cause rotation of impeller 418 a sufficient distance to ensure that dowel 502 of the firing pin 420 clears the stops 570 located in cylindrical cam 426. Once dowel 502 has cleared the stops 570, spring 422 will press against land 590 of the impeller 418 and force the firing pin 420 downward through the cylindrical cam 426 and toward cartridge 280 as indicated by arrow "B". As firing pin 420 continues down cylindrical cam 426 with dowel 502 traveling along trace 562, the distance separating firing pin 420 and impeller 418 will increase and splines 514 will disengage from splines 492. It should be noted that due to the force caused by spring 422, the firing pin 420 will continue down cylindrical cam 426 regardless of whether impeller 418 continues to rotate.

Figure 35:
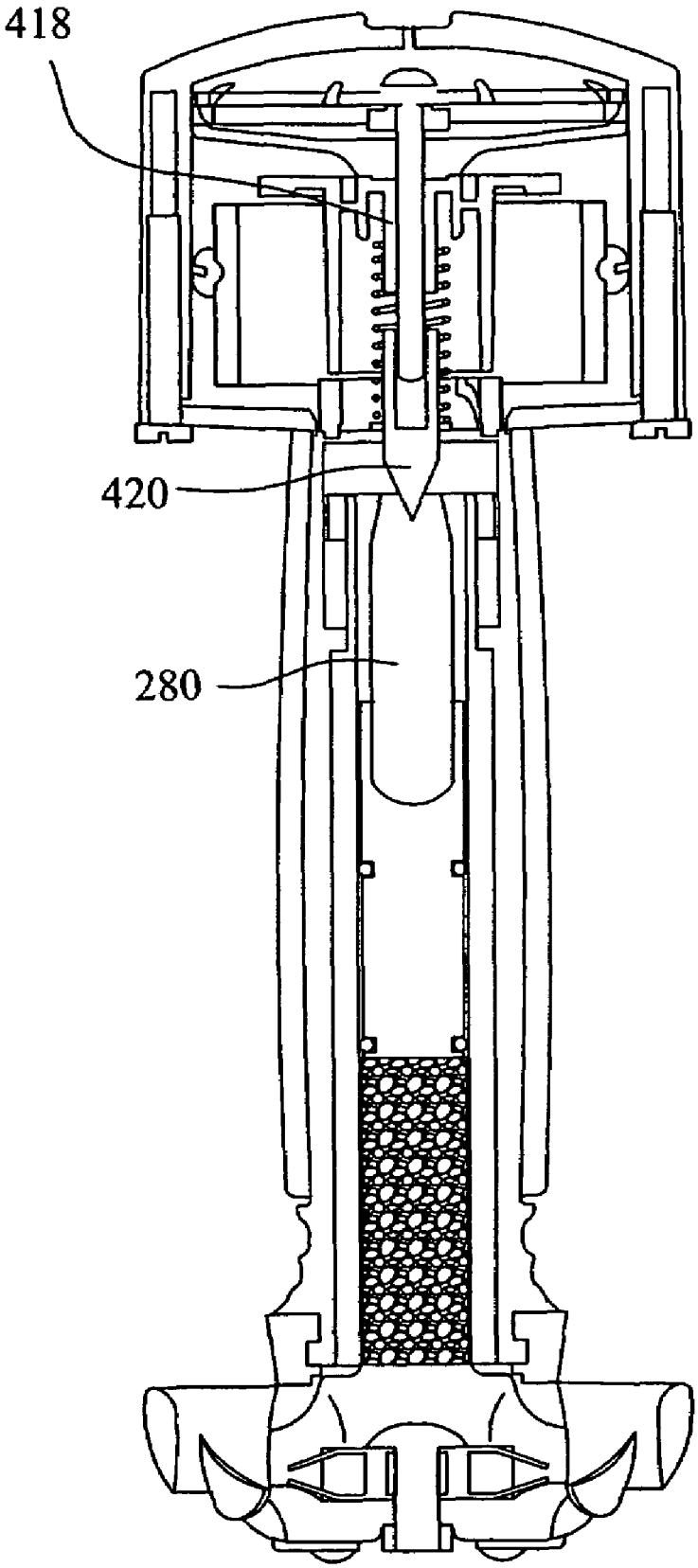
Figure 36:
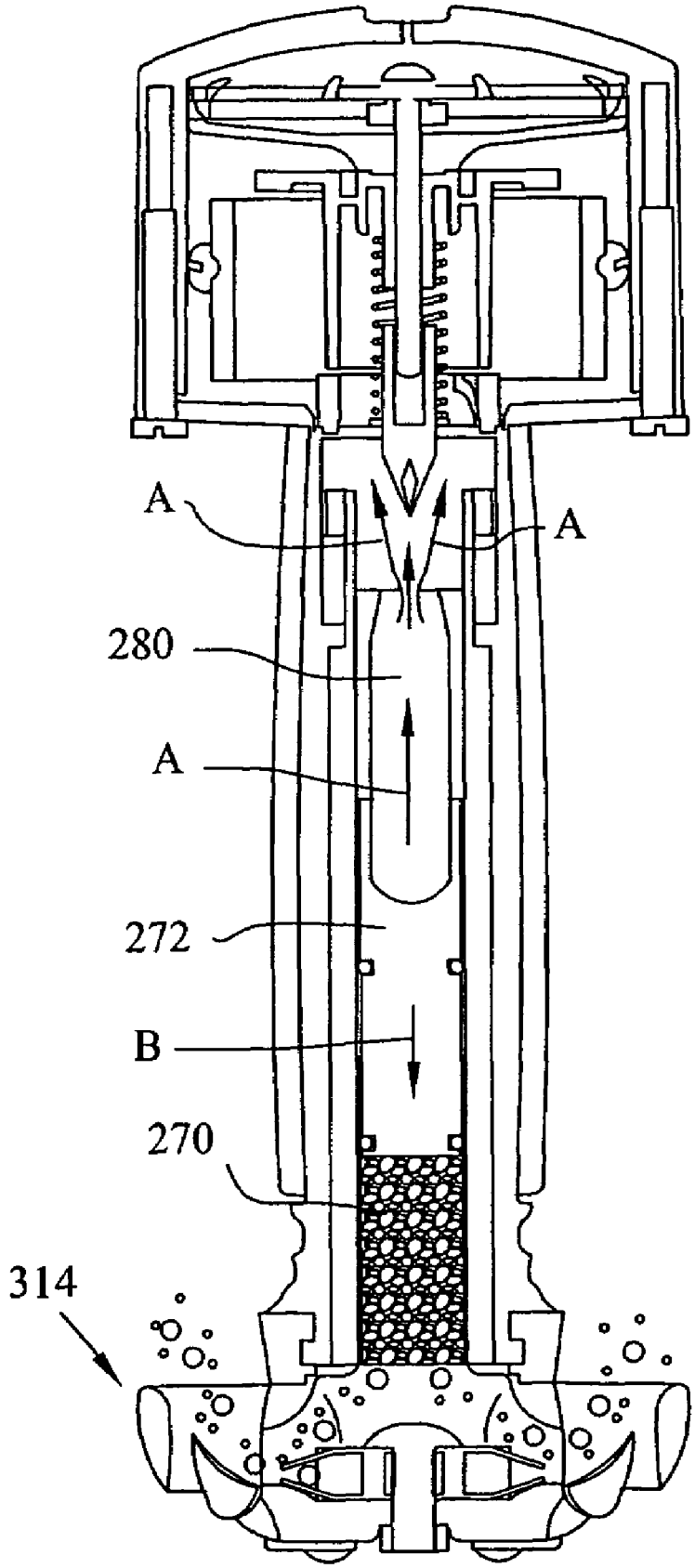

The force placed upon firing pin 420 by spring 422 is sufficient to ensure that flutes 508 of firing pin 520 penetrate cartridge 280 as shown in FIG. 35. The rotation of the firing pin 420 caused by the travel of the dowel 502 in the trace 562 further ensures piercing of the cartridge 280 by the flutes 508. Furthermore, the inclusion of flutes 508 allows pressurized gas to escape the cartridge 280 and travel upwards through the cylindrical cam 426 and into the impeller 418. As shown in FIG. 36, the escaping gas, indicated by arrows "A" will cause the cartridge 280 to move in the direction of powder 270, as indicated by arrow "B". This movement forces the powder 270 out of the dispersal mechanism 314, as depicted.

Figure 37:
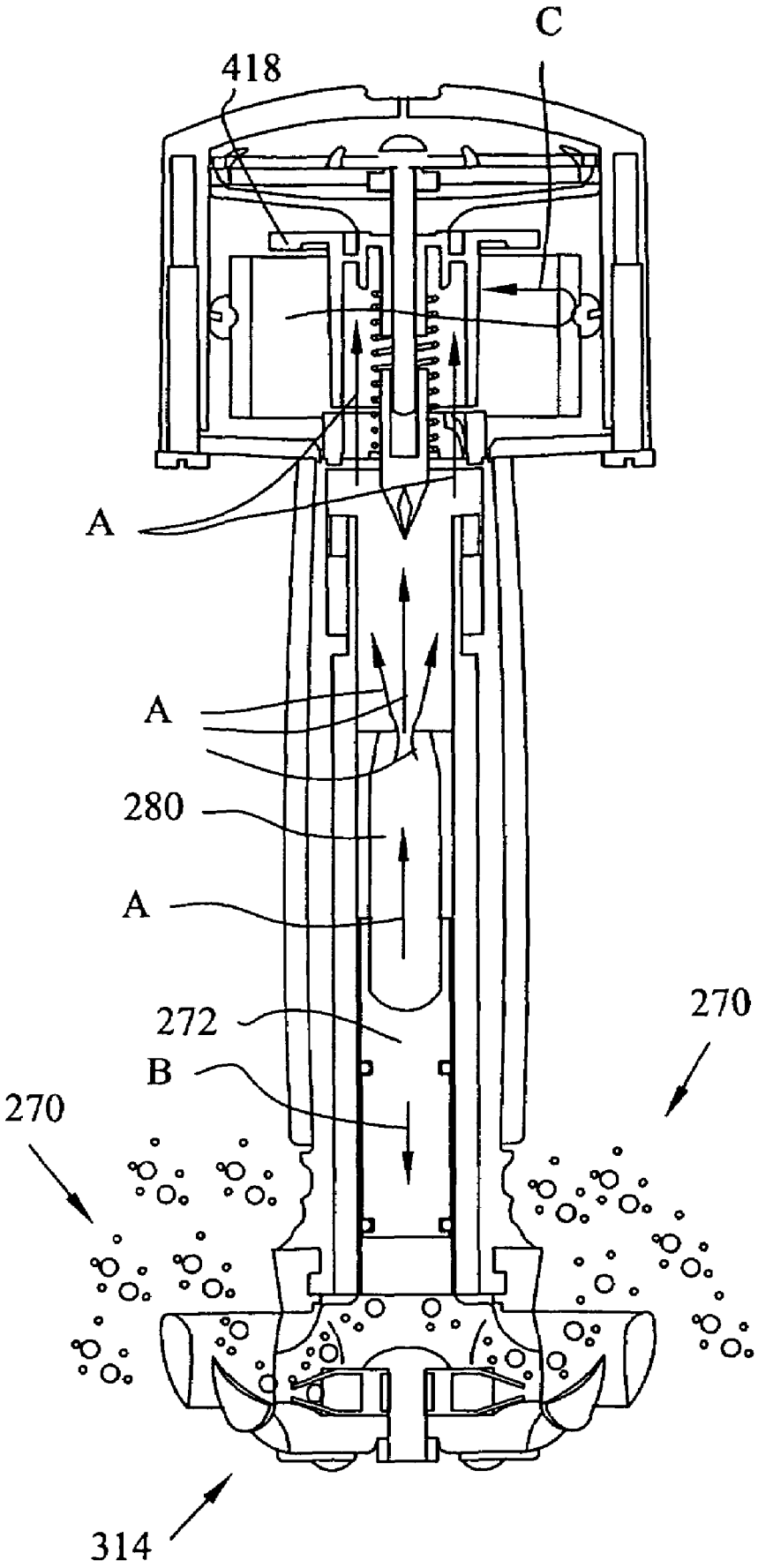

As gas escapes cartridge 280 and travels through impeller 418, gas will come into contact with the vanes 482 of the impeller 418 as shown in FIG. 37. The gas will travel through the vanes 482, thereby causing impeller 418 to rotate in a direction opposite that from which the impeller 418 rotated to actuate the device, as indicated by arrow "C". It should be noted that impeller 418 is free of firing pin 420 at this point, as firing pin 420 has traveled down cylindrical cam 426 and the impeller 418 has remained stationary vertically. The rotation of impeller 418 in the opposite direction causes motors 520 to now function as generators. The electricity generated by the motors 520 may be used for any number of a variety of reasons as desired by those skilled in the art. For example, the current generated by the motors 520 may be applied to a piezo electrical sound component in order to generate a disorientating sound. Additionally, the current generated by the motors 520 as the motors 520 spin in reverse may also be used to charge the PCBs 526 so that upon a subsequent activation of device 310, there will be sufficient power to activate the motors 520. It should also be noted that in embodiments of the invention, timer housing 410 may be modified to include whistles similar to those described above with respect to the previous embodiment.

In the present embodiment, cartridge 280 functions as in previous embodiments. The cartridge 280 continues to drive piston 272 toward dispersal mechanism 314, which in turn forces the powder 270 of the device 310 through dispersal mechanism 314 as indicated by arrow "B" in FIG. 37.

Figure 38:
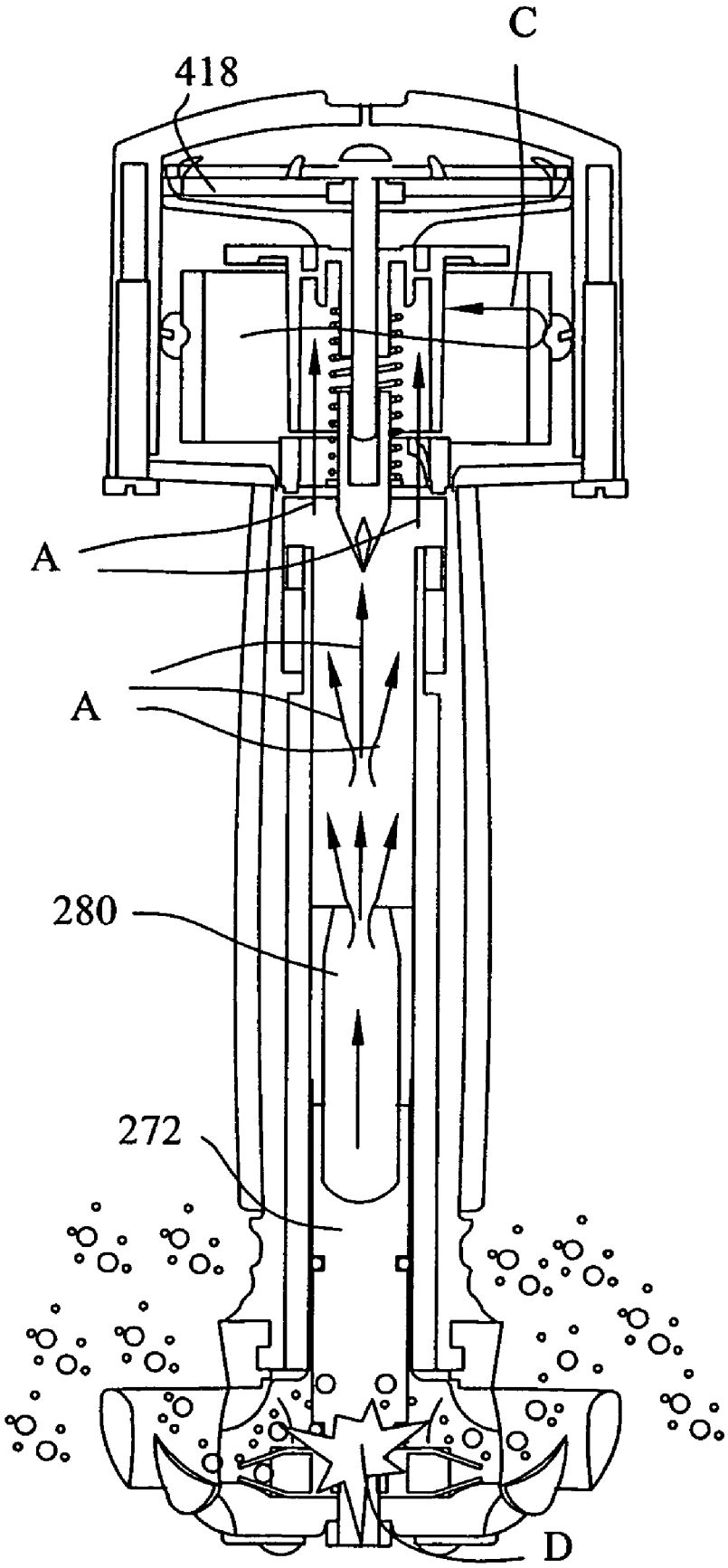

In the present embodiment, at the end of its travel, piston 272 will contact carriage bolt 352 of igniter assembly 348 as shown in FIG. 38. The contact of the piston 272 into the carriage bolt 352 will cause igniter conductor 354 to act upon the piezo igniters 358, causing the piezo igniters 358 to put forth an electric current. In the present embodiment, the current will travel through the igniter conductors 354, 356 and create a spark, indicated by "D", at the tips of the arms 370. This spark D ignites the powder 270 as the powder escapes from the dispersal mechanism 314, thereby causing the powder 270 to flash and disorientate a target.

In order to reset the device 310 for a subsequent use, dispersal mechanism 314 is removed from housing 312 in the manner opposite that described above. This has the effect of allowing sleeve 24 to travel through handle portion 320 away from firing mechanism 316. In the present embodiment, cylindrical cam 426 also travels with sleeve 24. Cylindrical cam 426 is prevented from rotating due to protrusions (not shown) extending into slots 560. It should be noted that dowel 502 of firing pin 420 prevents the firing pin 420 from also traveling with cylindrical cam 426. Specifically, dowel 502 contacts the upper portion of handle portion 320. It should be noted that in embodiments of the invention, handle portion 320 may include lands (not shown) in the bore 22 that will contact dowel 502 and prevent the firing pin 420 from traveling with the cam 426. Therefore, firing pin 420 rotates and dowel 502 in effect travels "upwards" through the traces 562 of the cylindrical cam 426. In the present embodiment, the components are sized such that when cylindrical cam 426 reaches its maximum point of travel, dowel 502 is positioned within first portion 564 of the traces 562.

Bore 22 may once again be reloaded with a fresh cartridge 280 and additional aluminum powder 270. Once bore 22 has been reloaded, the bore is pushed back up towards firing mechanism 316, driving cylindrical cam 426 upwards toward firing mechanism 316 also. It should be noted that due to the presence of the stops 470 acting on dowel 502, firing pin 420 will travel upwards toward the remainder of the firing mechanism 316 without rotating. Upon the full insertion of bore 22 resulting in full travel of cylindrical cam 426, firing pin 420 should again engage impeller 418. Specifically, splines 514 of firing pin 420 should mate with splines 492 of impeller 418. At this point, the dispersal mechanism 314 may again be attached to housing 312 in the manner described previous and the device 310 is ready to be armed and reused.

Figure 39:
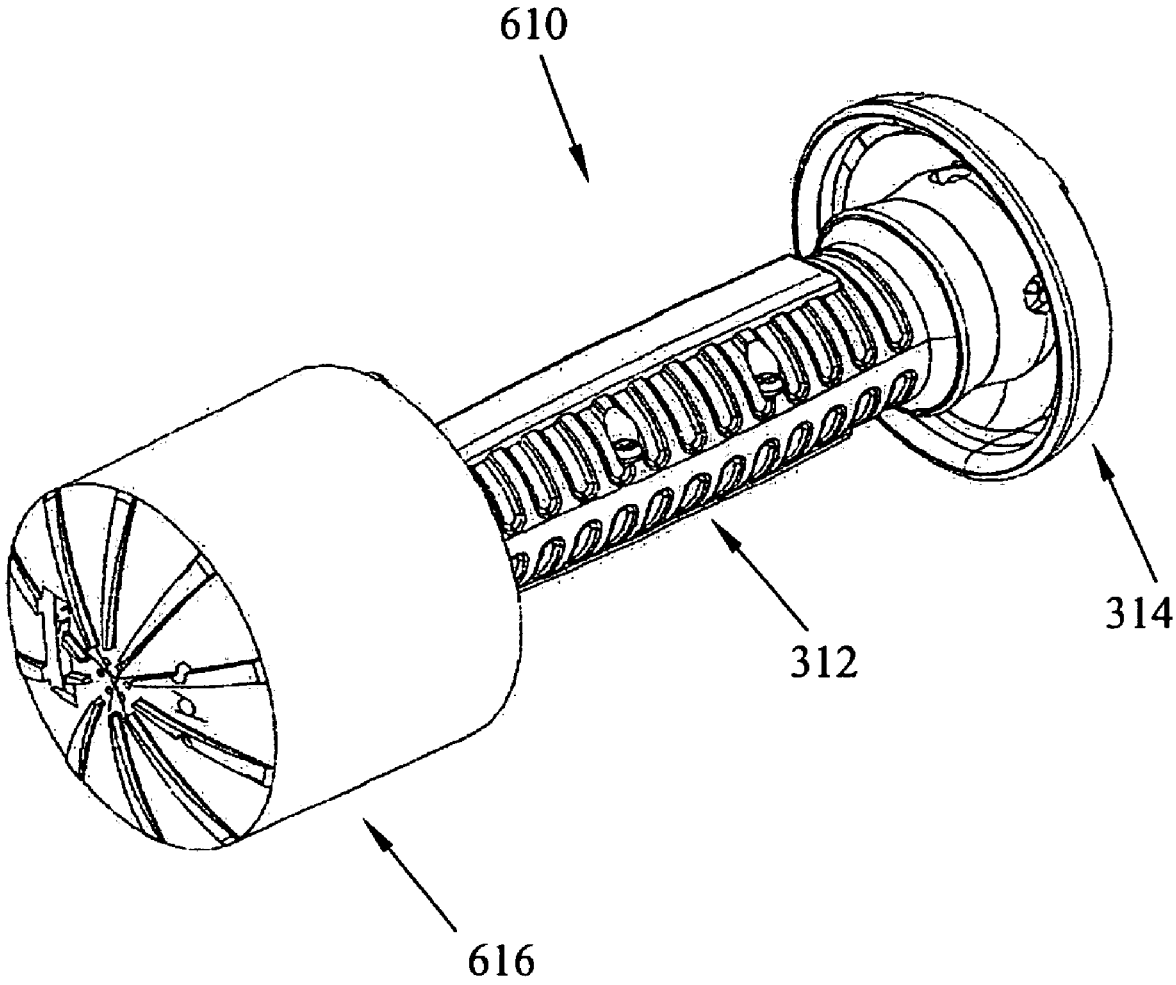
FIG. 39 depicts a perspective view of an alternative embodiment of a diversionary device of the present invention.

With reference now to FIG. 39, an alternative embodiment of the device portraying a diversion is generally indicated by numeral 610 in accordance with previous embodiments. Components previously described will be indicated by the same reference number used earlier. In this embodiment of the invention, new components are generally indicated by a numerical indicator falling in the range between 600 and 700.

Figure 40:
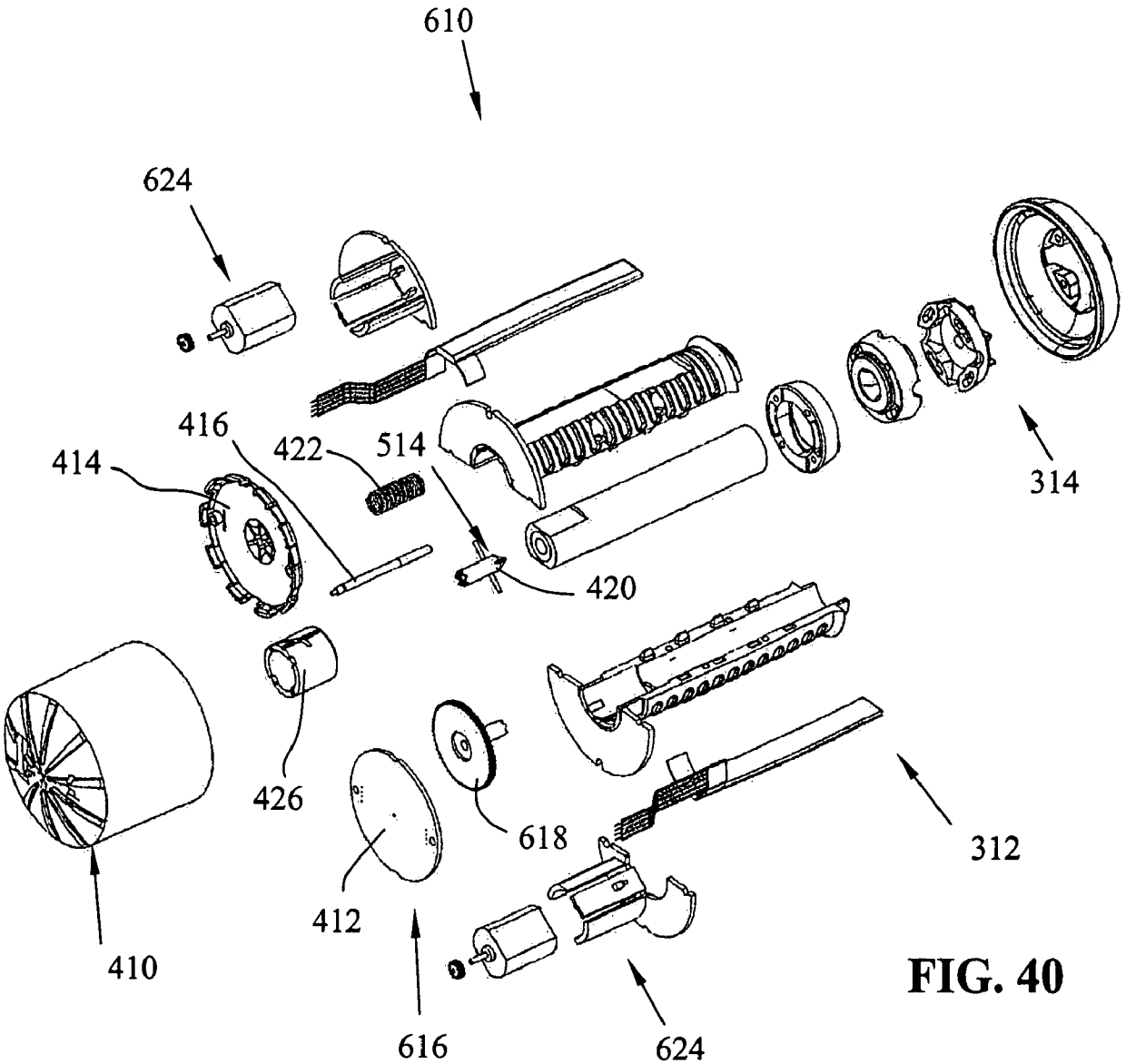
FIG. 40 depicts an exploded perspective view of the alternative embodiment of the device depicted in FIG. 39.

Device 610 includes housing 312, dispersal mechanism 314 and firing mechanism 616. FIG. 40 depicts an exploded perspective view of device 610 including firing mechanism 616. Firing mechanism 616 includes timer housing 410, controller PCB 412, deflector 414, shaft 416, central gear 618, firing pin 420, spring 422, a pair of motor assemblies 624 and cylindrical cam 426.

Figure 41:
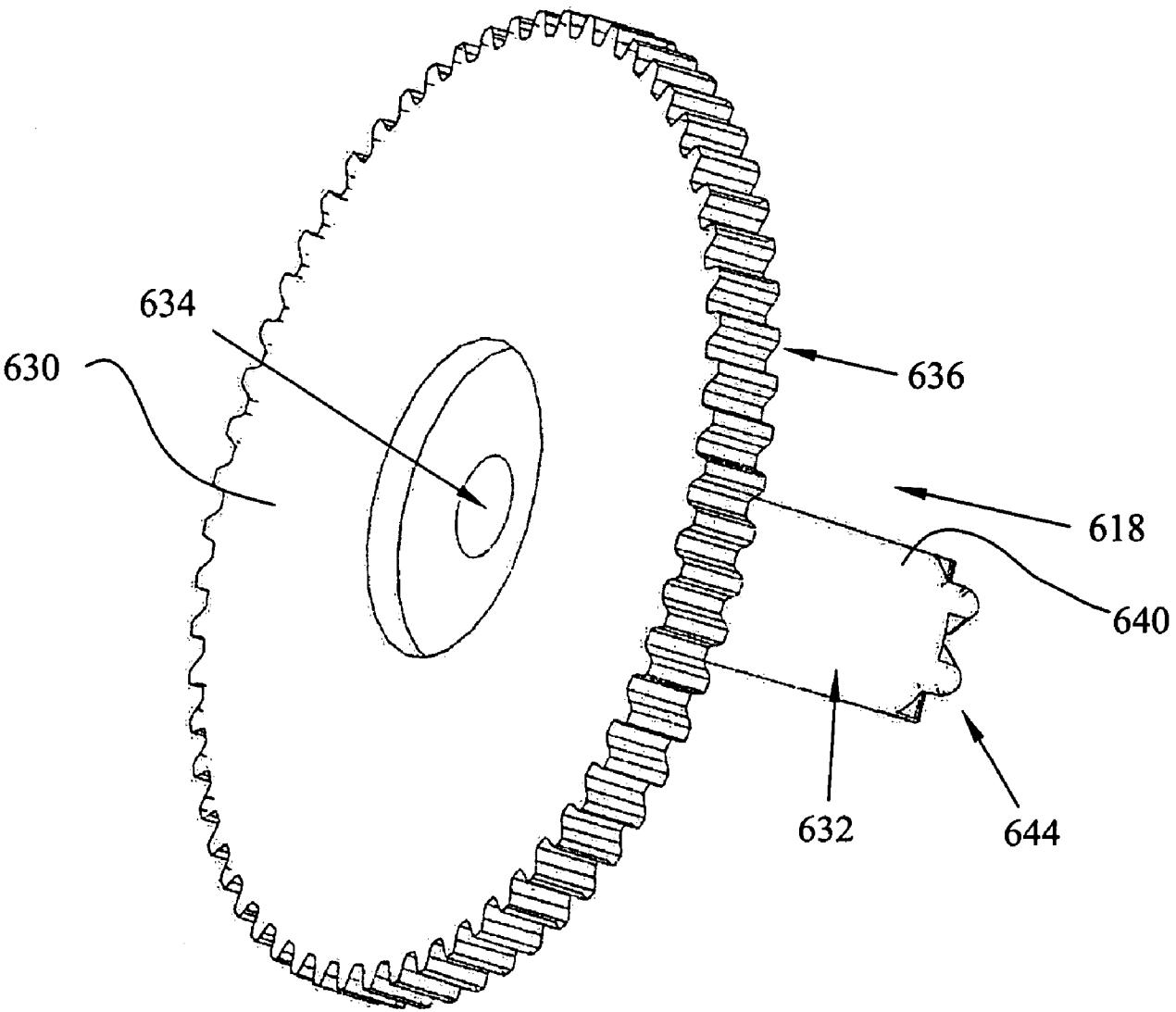
FIG. 41 depicts a perspective view of a central gear utilized in the embodiment of the device depicted in FIG. 40.
Figure 42:
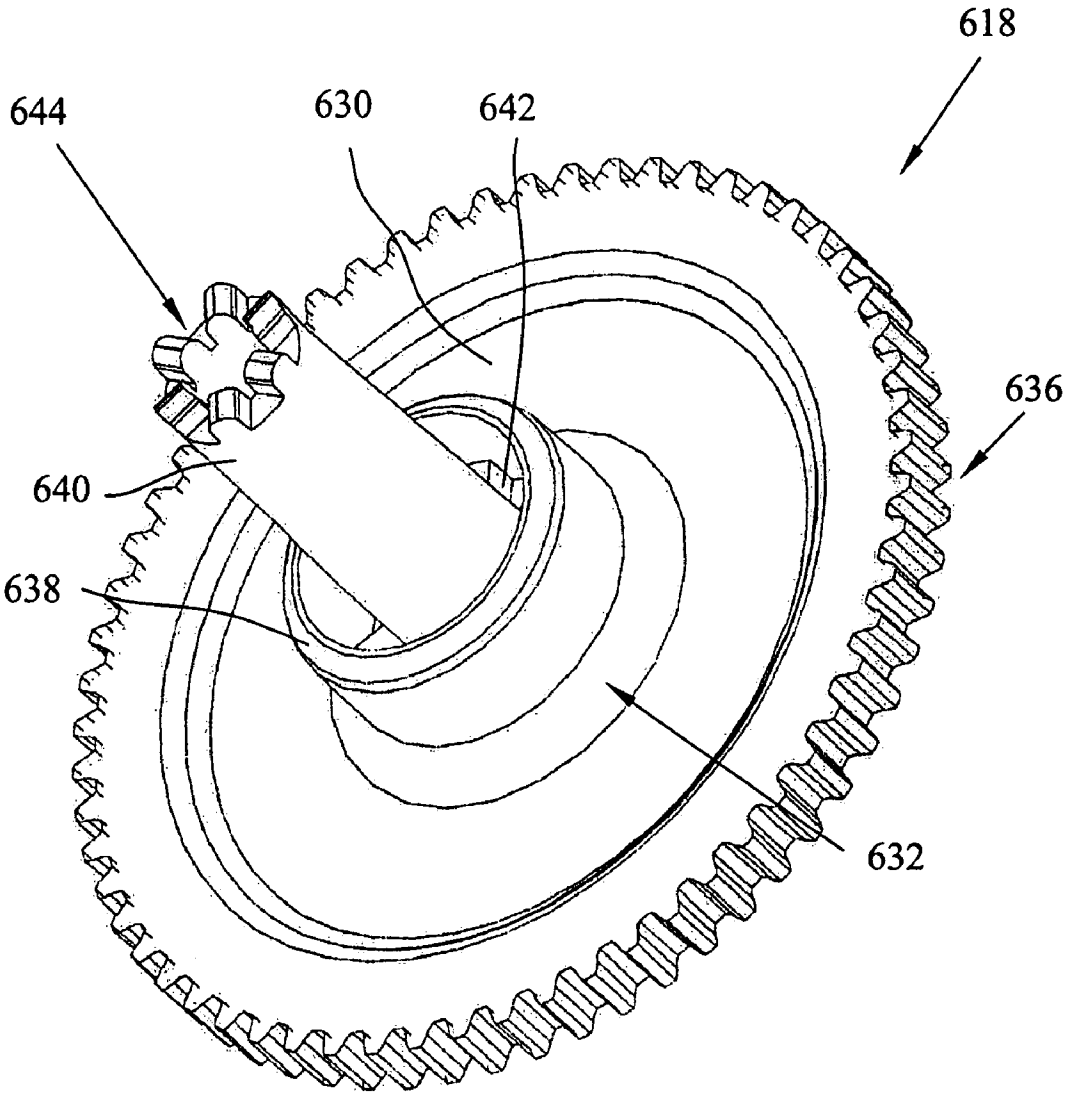
FIG. 42 depicts an underside perspective view of the central gear depicted in FIG. 41.

FIGS. 41 and 42 depict central gear 618. Central gear 618 includes substantially disc shaped top 630 having a planar upper surface and an assembly 632. Top 630 includes an aperture 634 positioned at approximately the center point of top 630. Top 630 further includes a plurality of teeth 636 located along the outer circumference of top 630.

An assembly 632 extends downward from the under side of top 630. Assembly 632 includes wall 638 and cylinder 640. Wall 638 is substantially smooth and, in the present embodiment, is integrally formed within top 630. Cylinder 640 has a substantially hollow interior that aligns with aperture 634 of top 630 and has a smooth outer surface. Cylinder 640 may also be integrally formed with top 630. Furthermore, cylinder 640 extends a greater distance downward from the under side of top 630 than wall 638. The area intermediate wall 638 and cylinder 640 defines land 642. In the present embodiment, cylinder 640 further includes a plurality of splines 644 configured to mate with splines 514 of firing pin 420.

Figure 43:
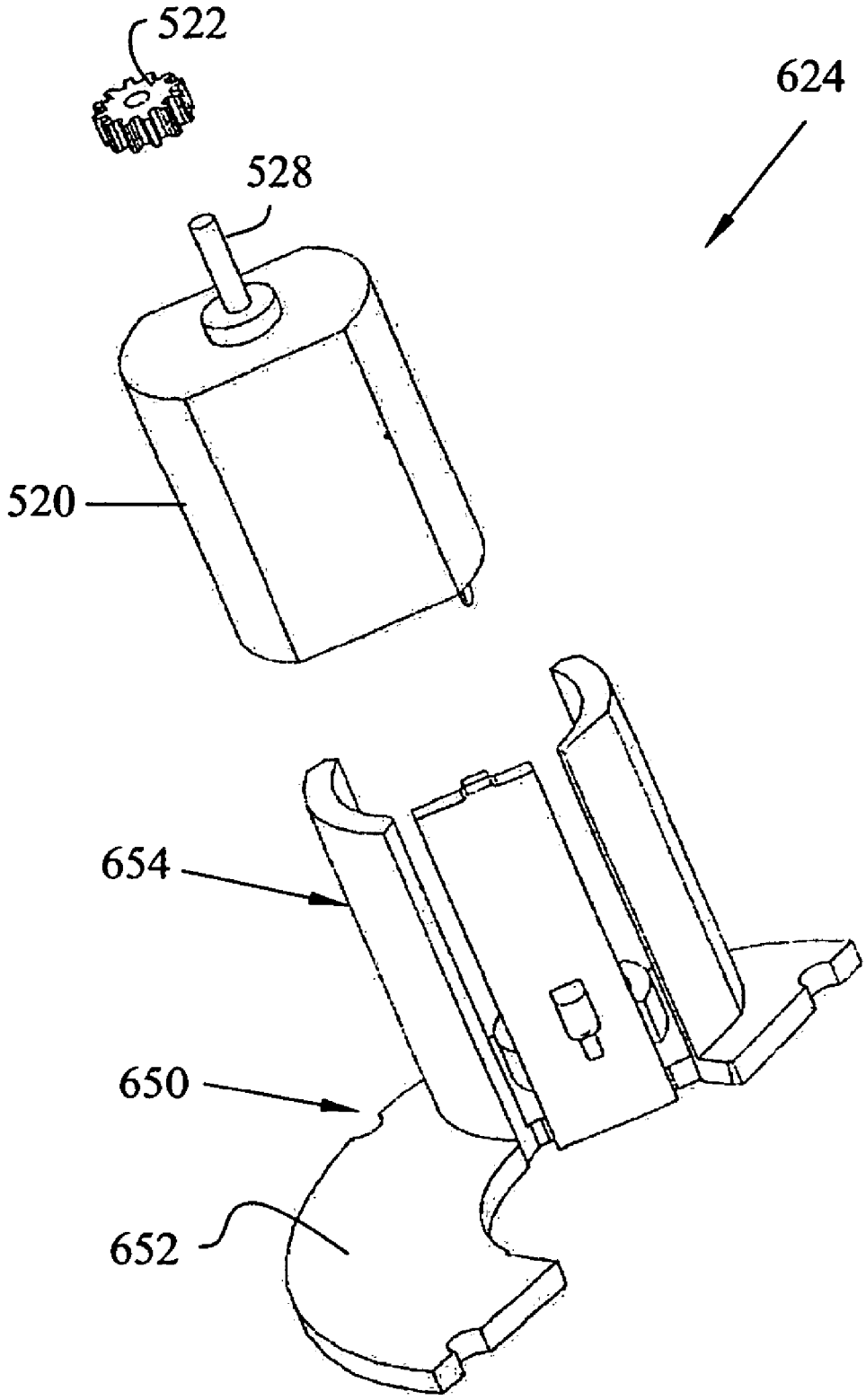
FIG. 43 depicts an exploded perspective view of a motor assembly utilized in the embodiment of the device depicted in FIG. 40.

FIG. 43 depicts an exploded perspective view of a motor assembly 624. In this embodiment, motor assembly 624 includes motor 520, gear 522 and motor bracket 650. Motor 520 and gear 522 are similar to those described in previous embodiments and may be assembled in a similar manner.

Bracket 650 may be manufactured of any sturdy material, such as injection molded plastic. Bracket 650 includes base 652 and receiving arm 654. In the present embodiment, base 652 is planar with a slightly arcuate shape, and receiving area 654 extending upwards from base 652. Receiving area 654 is sized and configured with a shape complementary to that of motor 520.

Motor assembly 624 is assembled by first affixing gear 522 to motor shaft 528 in the manner described with respect to previous embodiments. The motor/gear combination is then subsequently inserted receiving area 654 and affixed to bracket 650 in a known manner.

The assembly of device 610 is substantially similar to that described above with respect to the previous embodiment. In this embodiment, however, the motor assembly 624 may be attached by way of a plurality of fasteners (not shown) which extend upwards through handle portion 320 and into the base 652 of the brackets 650. Furthermore, in assembling this embodiment of device 610, central gear 618 replaces impeller 418.

It should be noted that in this embodiment central gear 618 does not include vanes similar to those present within impeller 418. Therefore, upon releasing the gas from the cartridge 280, central gear 418 does not rotate in reverse, and motors 520 do not act as generators. Thus, in the present embodiment, it is anticipated that batteries may be employed in order to allow for subsequent usage of the device. In embodiments of the invention, it is anticipated that rechargeable batteries may be used. The inventors further envision the inclusion of an access hatch within timer housing 410 allowing for quick replacement of the batteries once the charge has been expelled. In addition, it is anticipated that in this embodiment, piezo electric sound components may also be utilized to create sound upon activation of the device. It is anticipated that in this embodiment, the energy required to activate the piezo electric sound components come from batteries also. Furthermore, it is anticipated that in this embodiment whistles, similar to those utilized in previous embodiments of the invention, may be incorporated into timer housing 410 in order to allow escaping gas to cause a distracting sound.

It should be noted that with the exceptions discussed directly above, the function of device 610 and rearming thereof is substantially similar to that set forth with respect to device 310 discussed in detail above.

Figure 44:
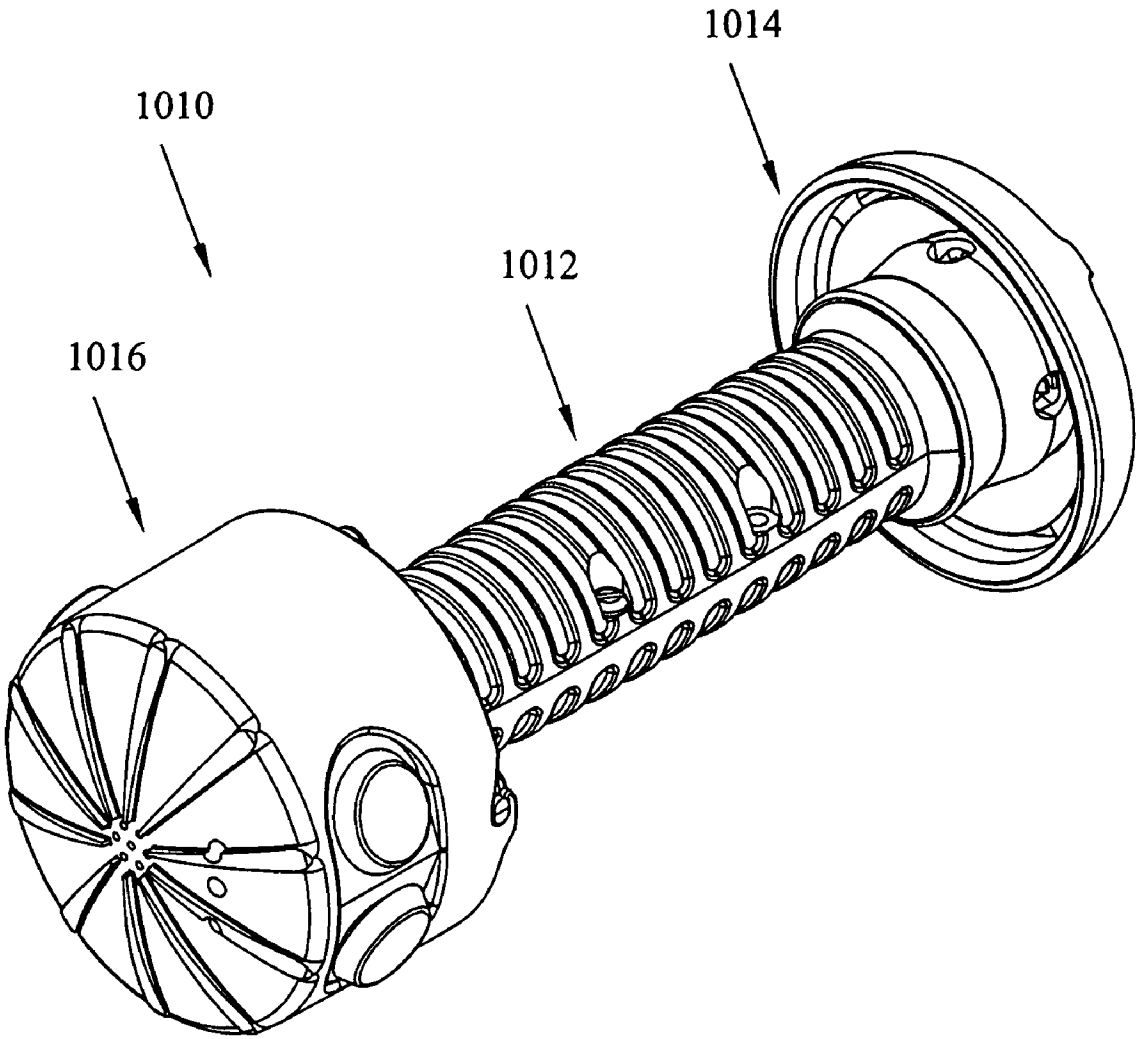
FIG. 44 depicts a perspective view of an alternative embodiment of a diversionary device of the present invention.
Figure 45:
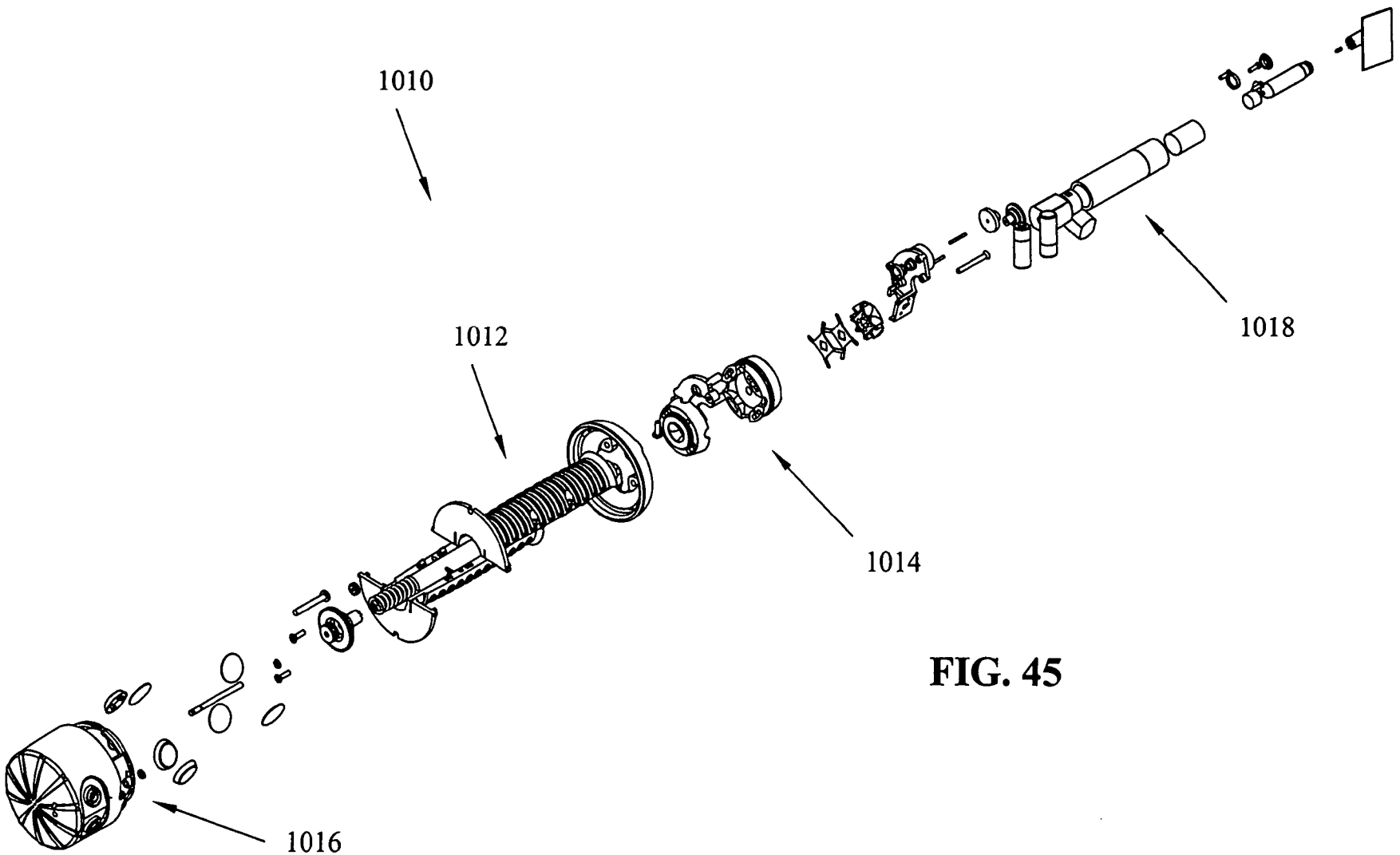
FIG. 45 depicts an exploded perspective view of the alternative embodiment depicted in FIG. 44.

Referring now to FIGS. 44 through 81, an alternative embodiment of the diversionary device will be described. It should be noted that for the sake of brevity, components of this embodiment of the diversionary device common to previous embodiments will not be described and will be indicated with a common reference numeral. Referring now to FIGS. 44 and 45, a diversionary device is generally indicated by numeral 1010. Diversionary device 1010 includes housing 1012, dispersal mechanism 1014, firing mechanism 1016, cartridge assembly 1018.

Figure 47:
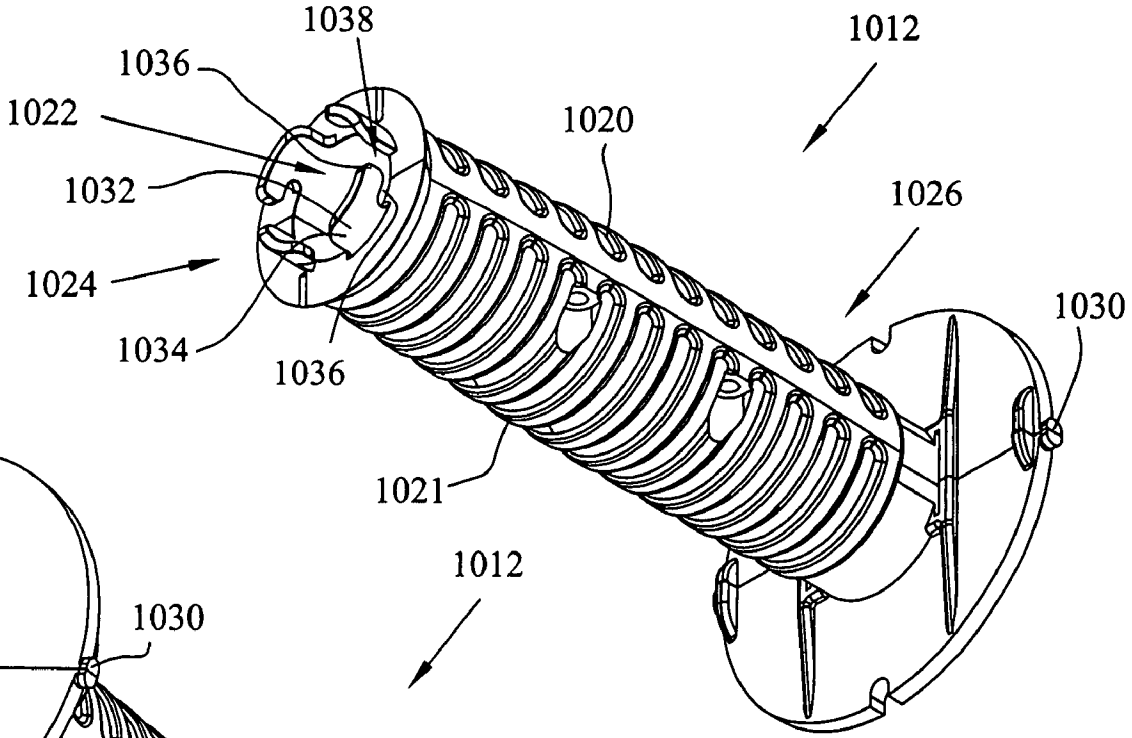
FIG. 47 depicts an underside perspective view of the housing depicted in FIG. 46.
Figure 46:
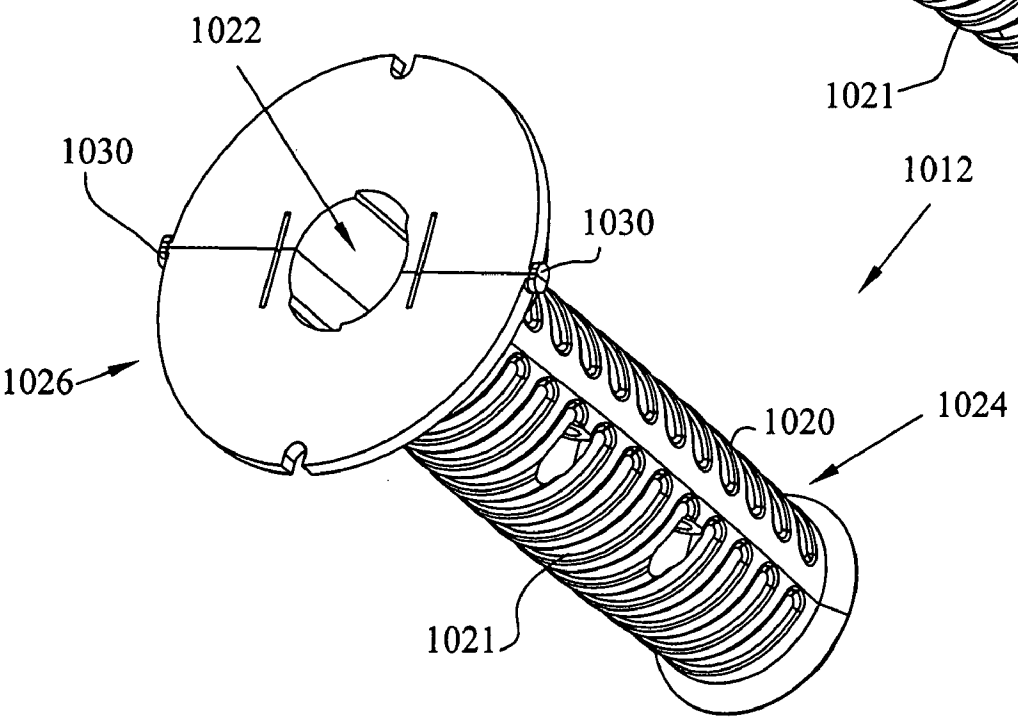
FIG. 46 depicts a perspective view of a housing utilized in the embodiment of the invention depicted in FIG. 44.
Figure 48:
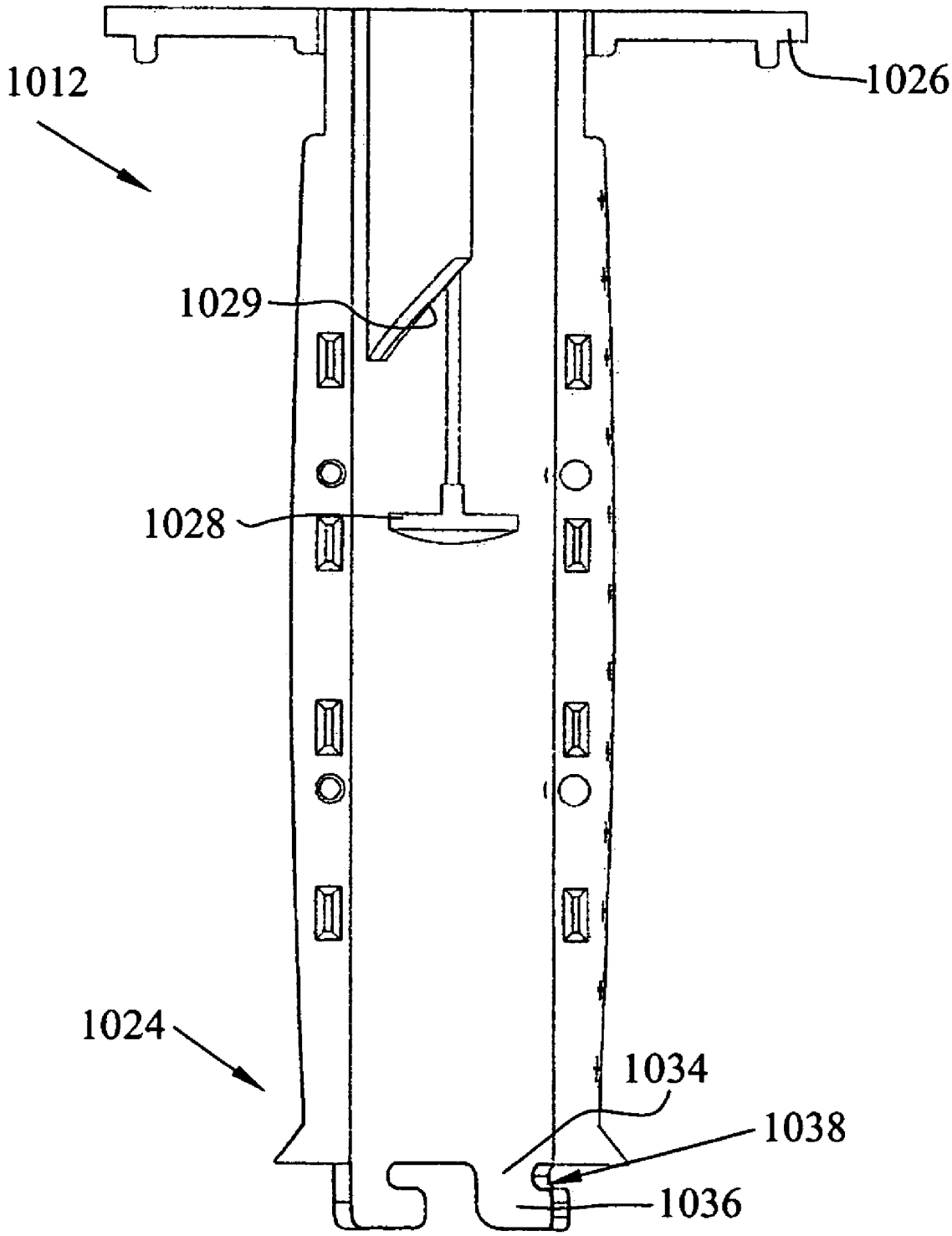
FIG. 48 depicts a section view of the housing depicted in FIG. 47.

FIGS. 46 through 48 depict housing 1012. Housing 1012 includes a first handle portion 1020 and a second handle portion 1021. In the present embodiment of the invention, handle portions 1020, 1021 are configured to provide a comfortable grip to the user and may be manufactured from any durable material such as plastic. Additionally, if desired, handle portions 1020 and 1021 man be manufactured as a single component if desired. In the present embodiment, handle portions 1020, 1021 define a bore generally indicated by numeral 1022. Bore 1022 is substantially smooth with a cylindrical shape and extends from first end 1024 of the handle portions 1020, 1021 to second end 1026 of the handle portions 1021, 1022.

Handle portions 1020, 1021 include lands 1028, protrusions 1030 and affixing members 1032. As shown in the section view depicted in FIG. 48, lands 1028 extend into bore 1022 from the inner surface of the handle portions 1020, 1021. In addition, the handle portions 1020, 1021 further include a ramp 1029.

Referring again to FIGS. 46 and 47, protrusions 1030 extend outward from the second end 1026 of the handle portions 1020, 1021. In this embodiment, the protrusions 1030 are integrally formed in the handle portions 1020, 1021. First handle portion 1020 comprises approximately half of each protrusion 1030, and second handle portion 1021 comprises the remainder of each protrusion 1030. As would be understood by one skilled in the art, one of the protrusions 1030 may be entirely formed in first handle portion 1020, and the second protrusion 1030 may be entirely formed in second handle portion 1021.

As shown in FIG. 47, in the present embodiment of the invention, affixing members 1032 extend downward from the first end 1024 of the first and second handle portions 1020, 1021. Affixing members 1032 include a vertical portion 1034 and a horizontal portion 1036. Vertical portion 1034 extends in a direction parallel to the longitudinal axis of housing 1012, and horizontal portion 1036 extends in a direction perpendicular to the longitudinal axis of housing 1012. In the present embodiment, the configuration of vertical portion 1034 and horizontal portion 1036 forms a slot generally indicated by numeral 1038.

Figure 49:
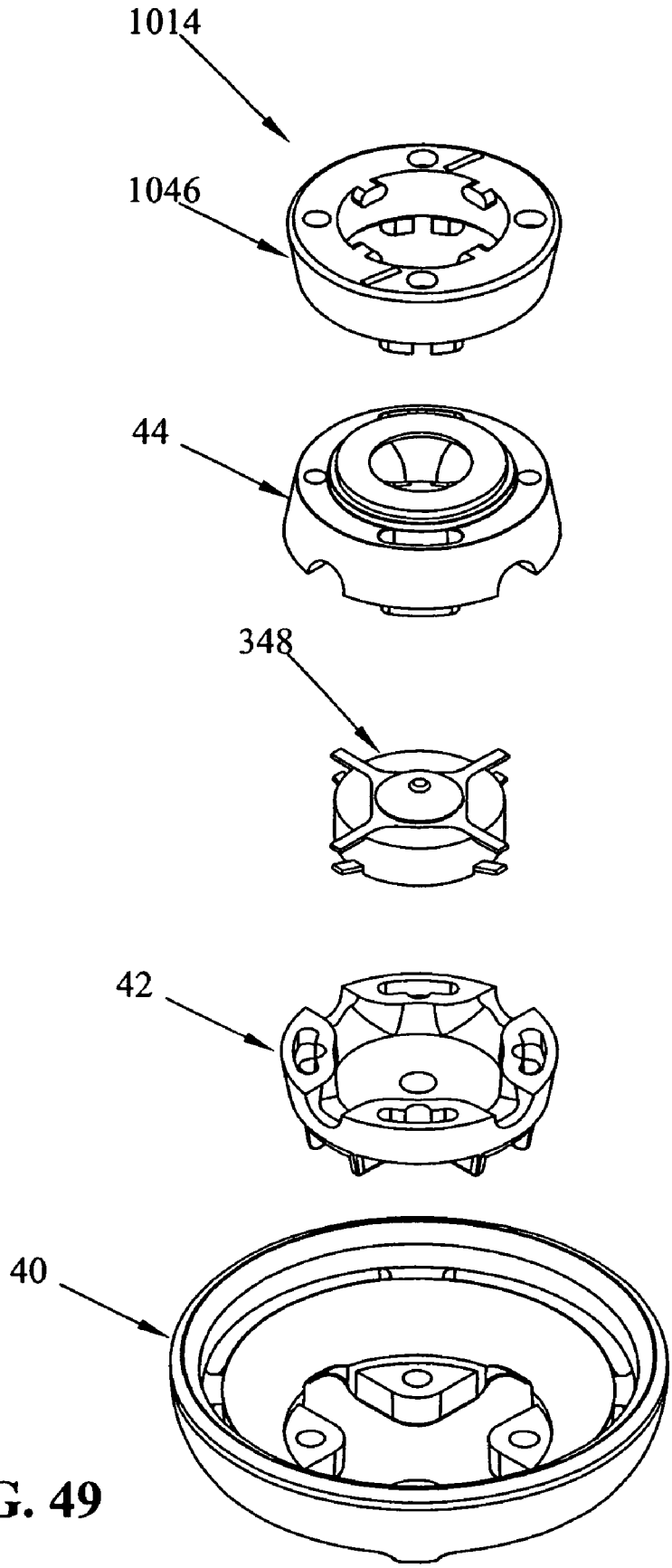
FIG. 49 depicts an exploded perspective view of a dispersal mechanism depicted utilized in the embodiment of the invention depicted in FIG. 44.

FIG. 49 depicts a dispersal mechanism generally indicated by numeral 1014. Dispersal mechanism 1014 includes deflector cup 40, lower nozzle housing 42, upper nozzle housing 44, nozzle interface 1046 and igniter assembly 348. Each of deflector cup 40, lower nozzle housing 42, upper nozzle housing 44 and igniter assembly 348 have been described in previous embodiments and thus, for the sake of brevity, will not be described with respect to this embodiment.

In the present embodiment, nozzle interface 1046 may be manufactured from any sturdy material such as plastic or metal. Nozzle interface 1046 comprises body 1110 and a central aperture 1112 as shown in FIG. 50.

Figure 50:
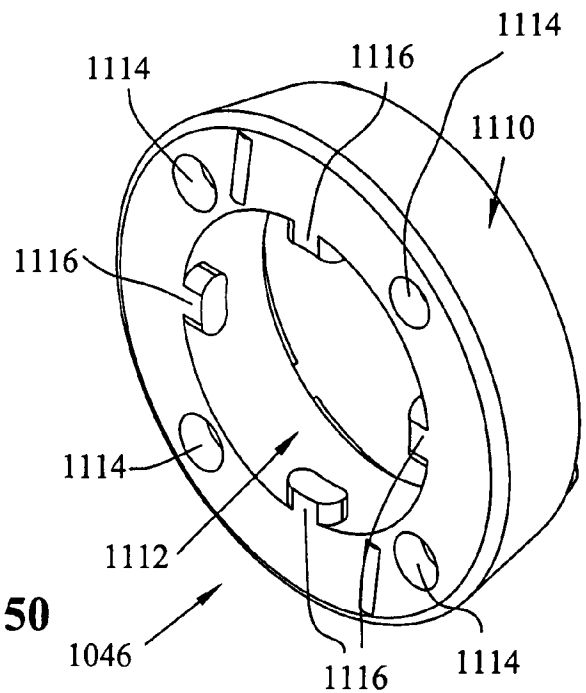
FIG. 50 depicts a nozzle interface utilized in the dispersal mechanism depicted in FIG. 49.

Referring still to FIG. 50, body 1110 has a ring shape and includes a plurality of mounting apertures indicated by numeral 1114. Mounting apertures 1114 encompass central aperture 1112 in the present embodiment. Body 1110 further includes a pair of protrusions 1116 formed in its inner surface. Protrusions 1116 extend into central aperture 1112 from opposite sides. It should be noted that in the present embodiment, protrusions 1116 are sized and configured to be received within slot 1038 of housing 1012.

With reference now to FIGS. 51 through 60, firing mechanism 1016 will now be described. Firing mechanism 1016 comprises timer housing 1210, controller PCB 1212, PCB cover 1214, pivot shaft 1216, central drive gear 1218, firing pin 1220, spring 1222, motor assembly 1224, cylindrical cam 1226, a plurality of piezo buzzers each generally indicated by numeral 1228 and battery pack 1230.

Figure 52:
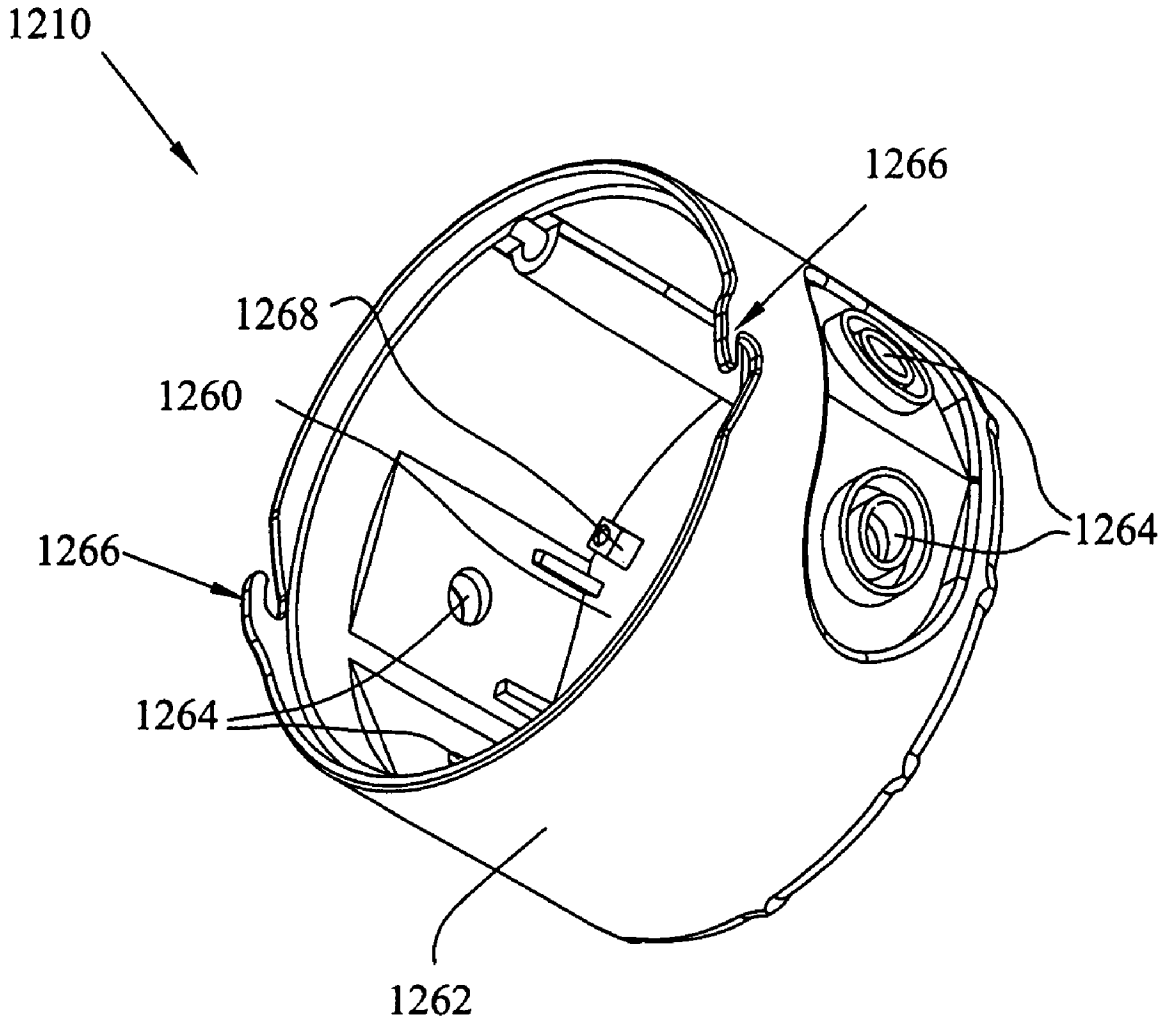
FIG. 52 depicts an underside perspective view of the timer housing utilized in the firing mechanism depicted in FIG. 51.

As shown in FIG. 52, timer housing 1210 comprises top portion 1260 and wall 1262. Timer housing 1210 may be manufactured from any sturdy material such as injection molded plastic. Top portion 1260 may include a plurality of openings (not shown) that receive LCD displays or similar mechanisms as described in previous embodiments.

Wall 1262 is integrally formed with top portion 1260 and extends downward from the edge thereof. Wall 1262 includes a plurality of apertures each generally indicated by numeral 1264 and a plurality of hooks 1266. Hooks 1266 extend downward from the lower edge of wall 1262. In the present embodiment, hooks 1266 are sized and configured to mate with protrusions 1030 of housing 1012.

As shown in FIG. 52, timer housing 1210 further includes a plurality of receiving areas each indicated by numeral 1268. Receiving area 1268 is formed in timer housing 1210 at the mating point between top portion 1260 and wall 1262.

Figure 53:
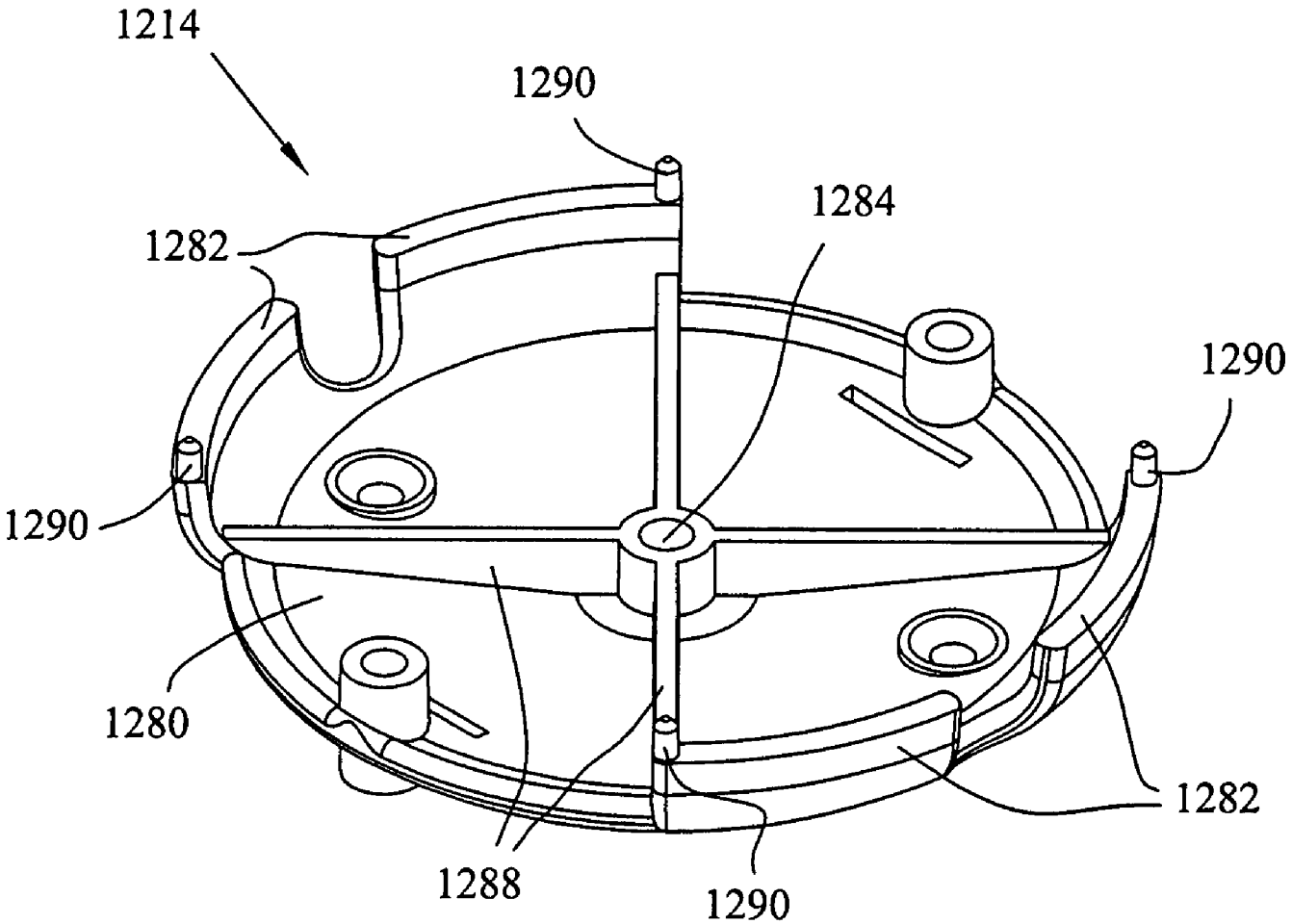
FIG. 53 depicts a perspective view of the PCB cover utilized in the firing mechanism depicted in FIG. 51.

FIG. 53 depicts PCB cover 1214. PCB cover 1214 includes base 1280 and walls 1282 extending upward therefrom. Walls 1282 and base 1280 define a PCB receiving area generally indicated by numeral 1284. In the present embodiment, PCB receiving area 1284 has a shape complementary to that of controller PCB 1212. PCB cover 1214 may be manufactured from any sturdy material such as injection molded plastic. At its center, base 1280 includes an aperture 1286. Base 1280 also includes a plurality of stiffening ribs 1288 integrally formed in the upper surface and radiating outward from aperture 1286 toward walls 1282.

In the present embodiment of PCB cover 1214, walls 1282 include a plurality of pins, each generally indicated by numeral 1290. Pins 1290 are sized and configured to be received by the receiving areas 1268 of timer housing 1210 when PCB cover 1214 is properly orientated within timer housing 1210.

Figures 54, 55:
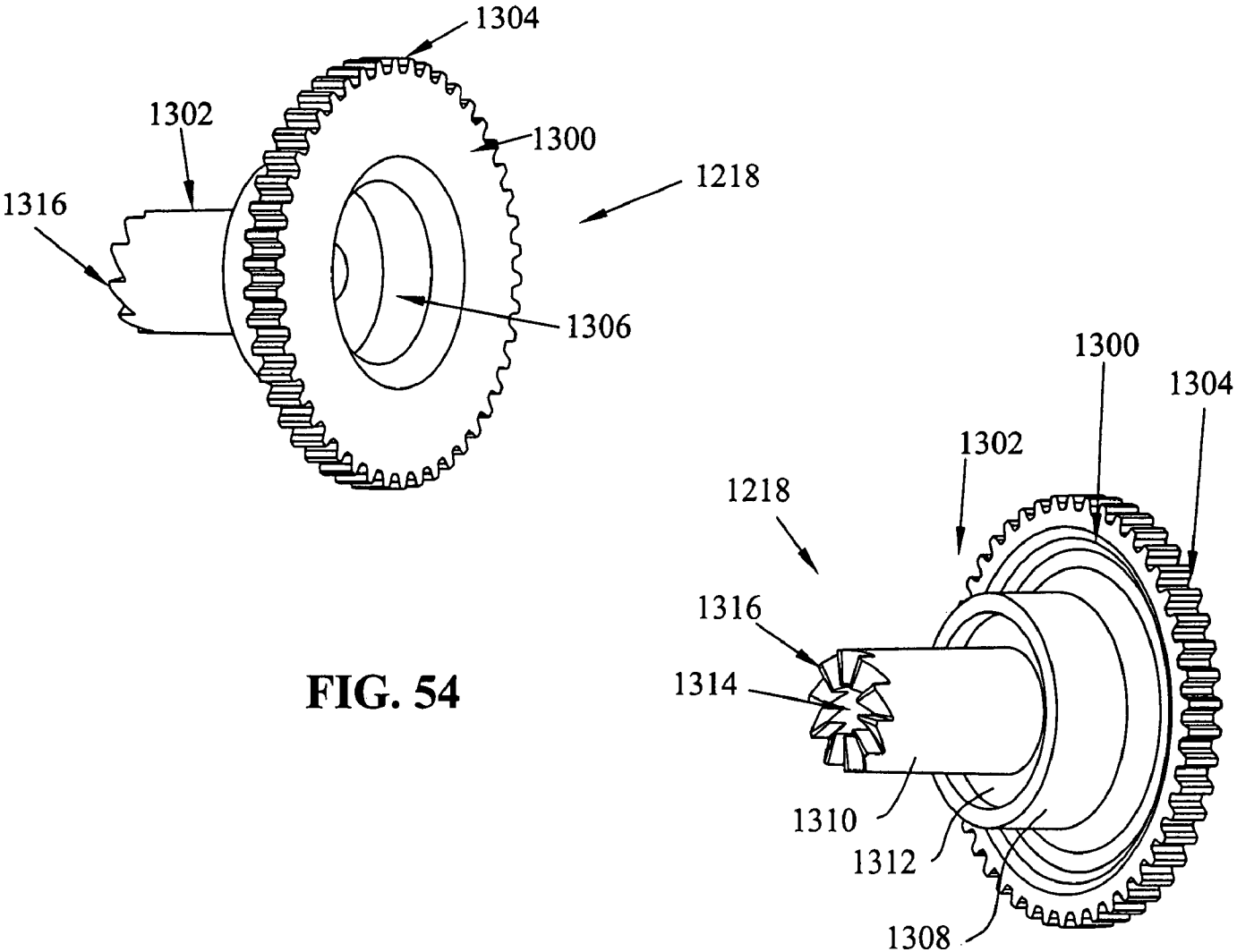
FIG. 54 depicts a perspective view of the central gear utilized in the firing mechanism depicted in FIG. 51.
FIG. 55 depicts an underside perspective view of the central gear utilized in the firing mechanism depicted in FIG. 51.

FIGS. 54 and 55 depict central drive gear 1218. Central drive gear 1218 includes head 1300 and body 1302. In the present embodiment, central drive gear 1218 may be manufactured from any strong material such as a metal or strong plastic. Head 1300 includes a plurality of gear teeth generally indicated by numeral 1304. Gear teeth 1304 are formed in the outer edge of head 1300. Head 1300 further includes a central aperture generally indicated by numeral 1306.

As shown in FIG. 55, body 1302 includes shorter portion 1308 and longer portion 1310. In the present embodiment, shorter portion 1308 has a larger diameter and extends downward from the under surface of head 1300. Longer portion 1310 also extends downward from head 1300 and is encompassed by shorter portion 1308. Body 1302 further includes a land generally indicated by numeral 1312 defined by the area intermediate shorter portion 1308 and longer portion 1310.

In the present embodiment, longer portion 1310 includes bore 1314 centered upon the longitudinal axis of central drive gear 1218. The longer surface of longer portion 1310 also includes a plurality of splines generally indicated by numeral 1316.

Figures 56, 57:
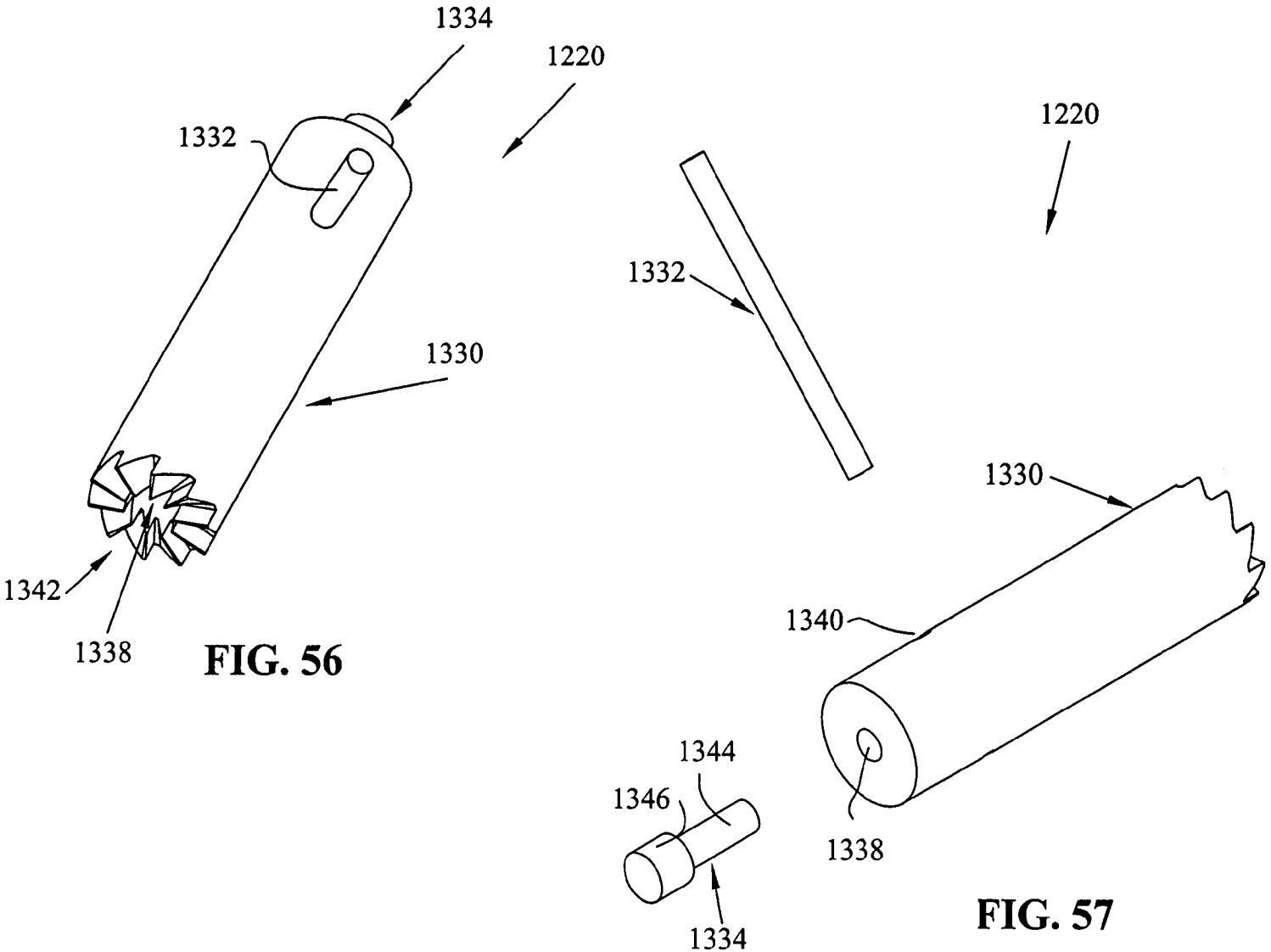
FIG. 56 depicts a perspective view of the firing pin utilized in the firing mechanism depicted in FIG. 51.
FIG. 57 depicts an exploded perspective view of the firing pin utilized in the firing mechanism depicted in FIG. 51.

FIGS. 56 and 57 depict firing pin 1220. Firing pin 1220 includes main body 1330, cross pin 1332 and extension 1334. In the present embodiment, firing pin 1220 is manufactured from a durable material such as stainless steel. Main body 1330 has a substantially cylindrical shape. Main body 1330 includes a longitudinal shaft, generally indicated by numeral 1338, and a cross shaft 1340, which extends perpendicular to longitudinal shaft 1338. Cross shaft 1340 is sized and configured to receive cross pin 1332.

In addition, the upper surface of main body 1330 further includes a plurality of splines 1342. In the present embodiment, splines 1342 are substantially sized and configured to mate with splines 1316 of central drive gear 1218.

As shown in FIG. 57, extension 1334 includes first portion 1344 and second portion 1346. First portion 1344 is sized and configured to be received by the longitudinal shaft 1338 of main body 1330, and second portion 1346 has a diameter larger than longitudinal shaft 1338. Accordingly, extension 1334 may only be inserted into main body 1330 to the point wherein second portion 1346 contacts main body 1313. In the present embodiment, extension 1334 may be retained within main body 1330 by any known mechanism.

Figure 58:
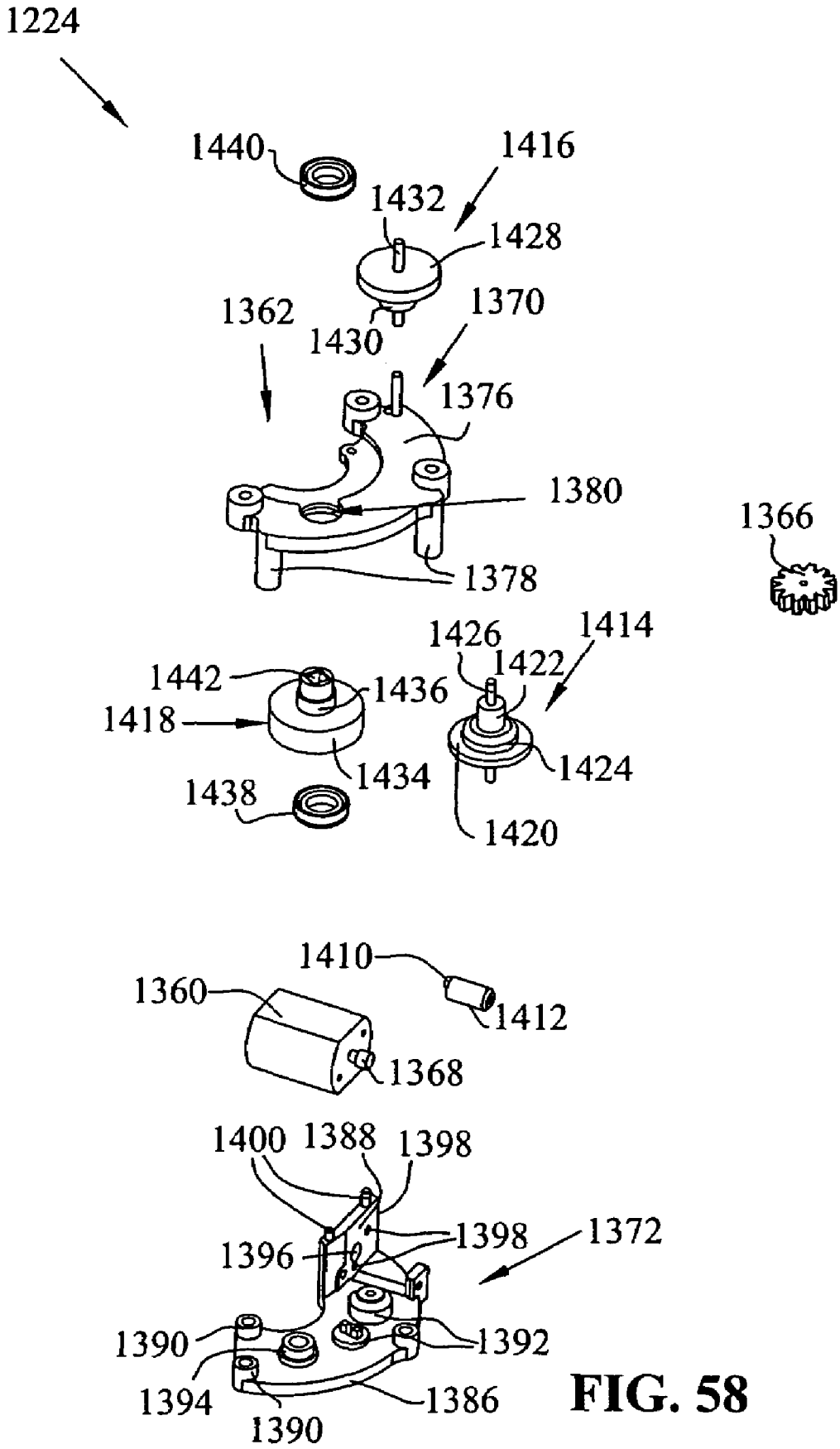
FIG. 58 depicts an exploded perspective view of the motor assembly utilized in the firing mechanism depicted in FIG. 51.
Figure 59:
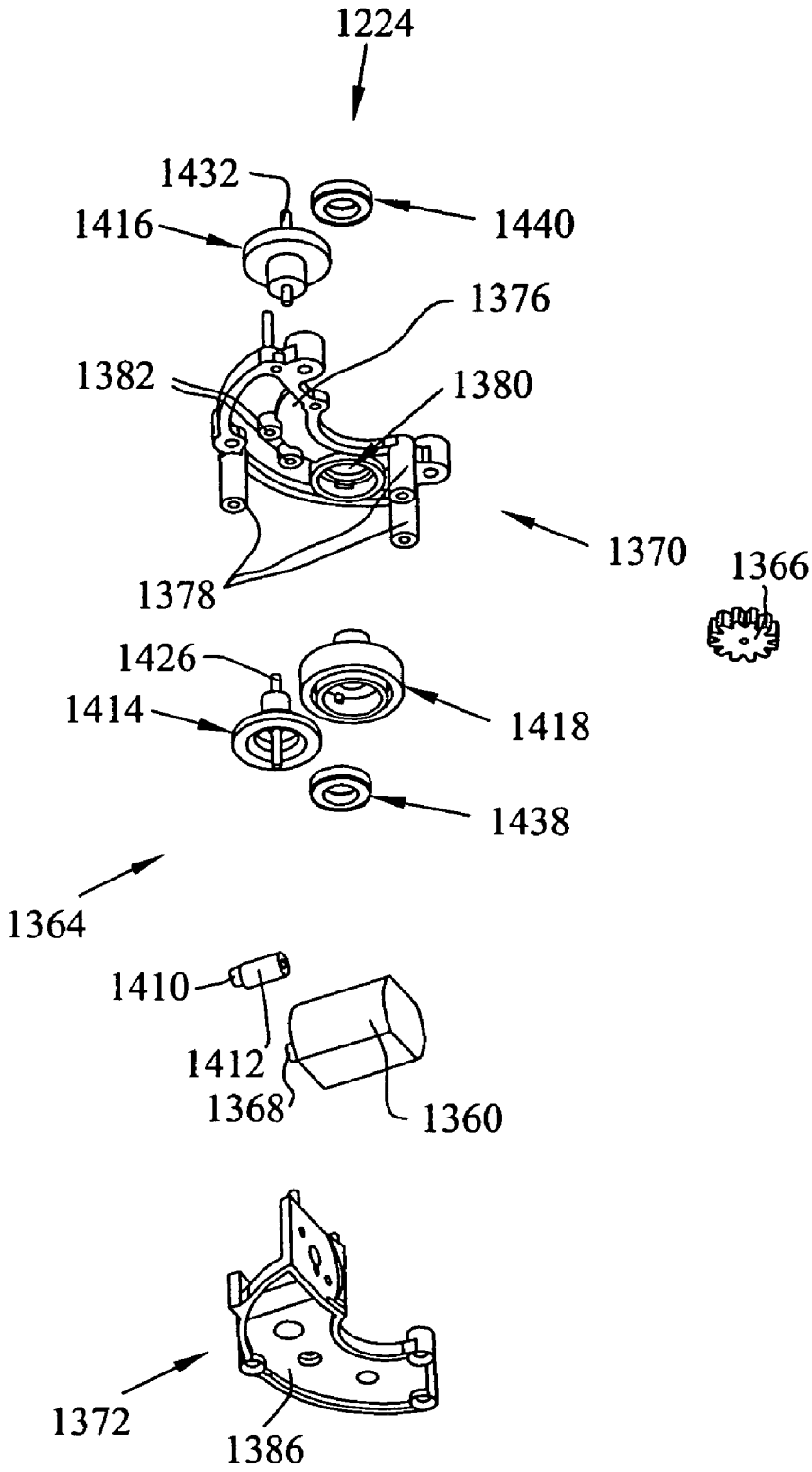
FIG. 59 depicts an underside exploded perspective view of the motor assembly utilized in the firing mechanism depicted in FIG. 51.
Figure 61:
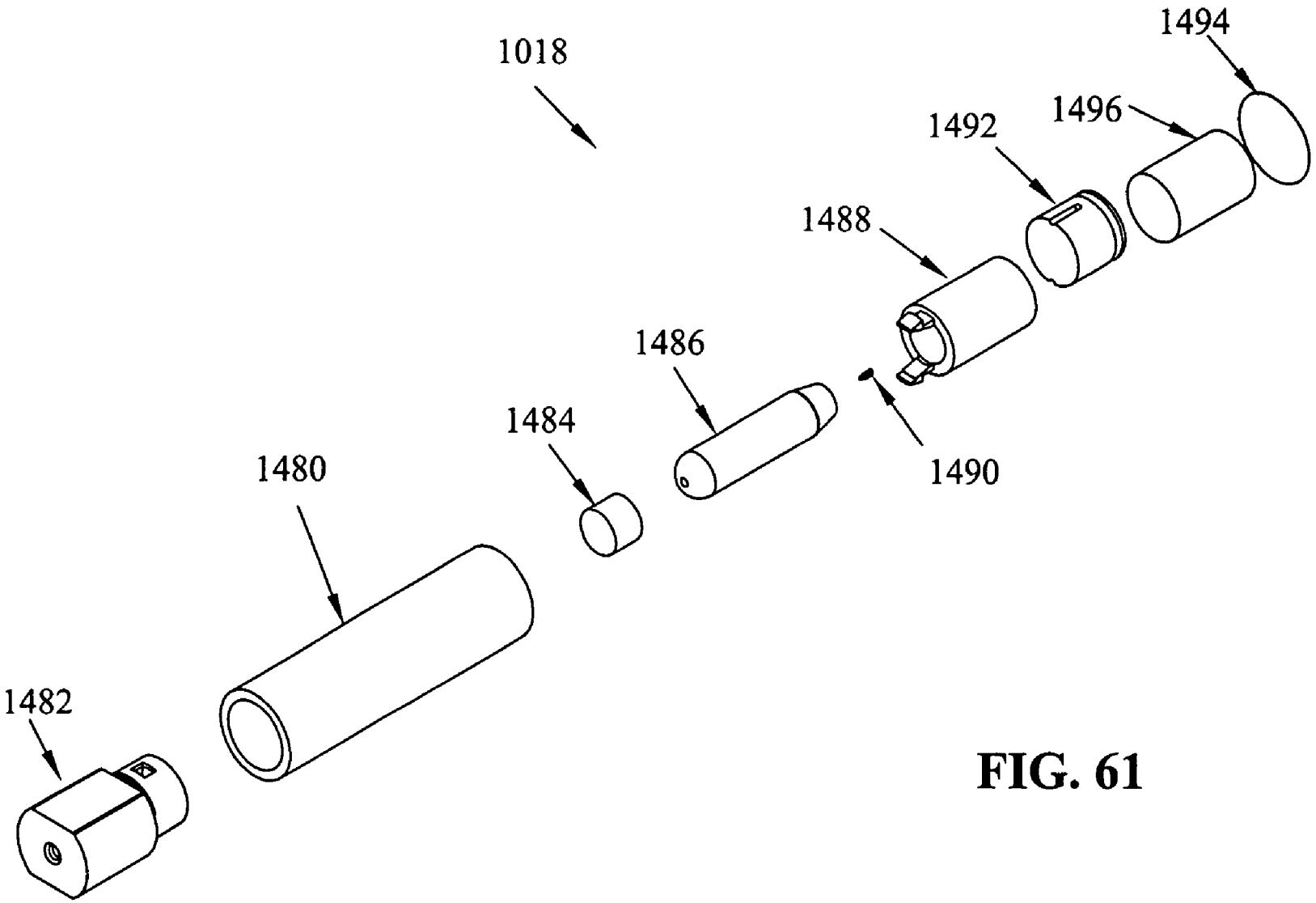
FIG. 61 depicts an exploded perspective view of the cartridge assembly utilized in the embodiment of the invention depicted in FIG. 44.

FIGS. 58 and 59 depict motor assembly 1224. In the present embodiment of the invention, motor assembly 1224 includes motor 1360, gear box frame 1362, gear train 1364 and drive gear 1366. Motor 1360 in the present embodiment of the invention is an electric motor commonly known in the art. As would be understood by one well known in the art, activation of motor 1360 creates rotational movement of drive shaft 1368.

In the present embodiment, gear box frame 1362 includes upper frame 1370 and lower frame 1372. In the present embodiment, upper and lower frames 1370, 1372 may be made from any sturdy material such as an injection molded plastic. With respect to FIG. 59, upper frame 1370 includes a base portion 1376 and a plurality of legs 1378. In the present embodiment, base portion 1376 is substantially planar shaped, and legs 1378 extend downward from the lower surface of base portion 1376. Base portion 1376 includes a main aperture 1380 and a plurality of mounting portions 1382 spaced throughout.

FIGS. 58 and 59 depict lower frame 1372. In the present embodiment, lower frame 1372 includes base portion 1386 and vertical wall 1388. Base portion 1386 is substantially planar with a slightly arcuate shape and includes a plurality of raised mounts indicated by numeral 1390 and a plurality of mounting areas indicated by numeral 1392. It should be noted that in the present embodiment, the raised mounts 1390 are sized and configured to mate with legs 1378 of upper frame 1370. In addition, mounting areas 1392 are positioned on base portion 1386 at locations essentially mirroring the locations of the mounting portions 1382 of upper frame 1370. Lower frame 1394 also includes a bushing mounting area indicated by numeral 1394.

In the present embodiment of lower frame 1372 vertical wall 1388 extends upward from base portion 1386 along an edge thereof. Vertical wall 1388 includes a central aperture 1396, a pair of mounting apertures each indicated by numeral 1398 and locating pins 1400. Mounting apertures 1398 are located on opposite sides of central aperture 1396. Locating pins 1400 extend upward from the top surface of vertical wall 1388.

As shown in FIGS. 58 and 59, gear train 1364 includes a worm driver 1410, worm 1412, second gear 1414, mid gear 1416 and output gear 1418. In the present embodiment, gear train 1364 has the effect of transforming the high speed low torque spin of motor 1360 into a low speed high torque spin as will be demonstrated by the following description. It should be noted that one skilled in the art may modify gear train 1364 in accordance with the present invention based upon the type and function of motor 1360 employed in the invention.

In the present embodiment, worm driver 1410 is configured to engage motor drive shaft 1368. Worm driver 1410 also engages worm 1412 in a well known manner thereby ensuring that rotation of shaft 1368 creates rotation of worm 1412.

Second gear 1414 represents the type of gear generally referred to as a worm gear in the art. Second gear 1414 includes larger diameter portion 1420, smaller diameter 1422 and an intermediate portion 1424. In the present embodiment, larger diameter portion 1420 engages worm 1412. Second gear 1414 further includes an aperture (not shown) sized and configured to receive pin 1426. Pin 1426 may be of any type known in the art allowing for the rotation of second gear 1414.

Mid gear 1416 includes larger portion 1428 and smaller portion 1430. In the present embodiment of the invention, larger portion 1428 has teeth (not shown) configured to engage smaller diameter portion 1422 of second gear 1414. Mid gear 1416 further includes an aperture (not shown) through which pin 1432 extends. Pin 1432 is configured to allow rotation of mid gear 1416.

Referring still to FIGS. 58 and 59, output gear 1418 includes a larger portion 1434, a smaller portion 1436, a lower bushing 1438 and an upper bushing 1440 in the present embodiment of the invention. Larger portion 1434 includes an aperture 1441 sized and configured to receive lower bushing 1438. In addition, larger portion 1434 is sized to engage smaller portion 1430 of mid gear 1416. Smaller diameter portion 1436 is sized to extend through the center of upper bushing 1440, and smaller portion 1436 includes a receiving area generally indicated by numeral 1442. Upper bushing 1440 is sized and configured to be received within main aperture 1380 of upper frame 1370. The bushings 1438, 1440 allow for rotation of gear 1418 without binding.

Motor assembly 1224 includes drive gear 1366. Drive gear 1366 comprises any gear type known in the art. In the present embodiment, drive gear 1366 includes a downwardly extending portion sized and configured to be received within receiving area 1442 of output gear 1418.

Figure 51:
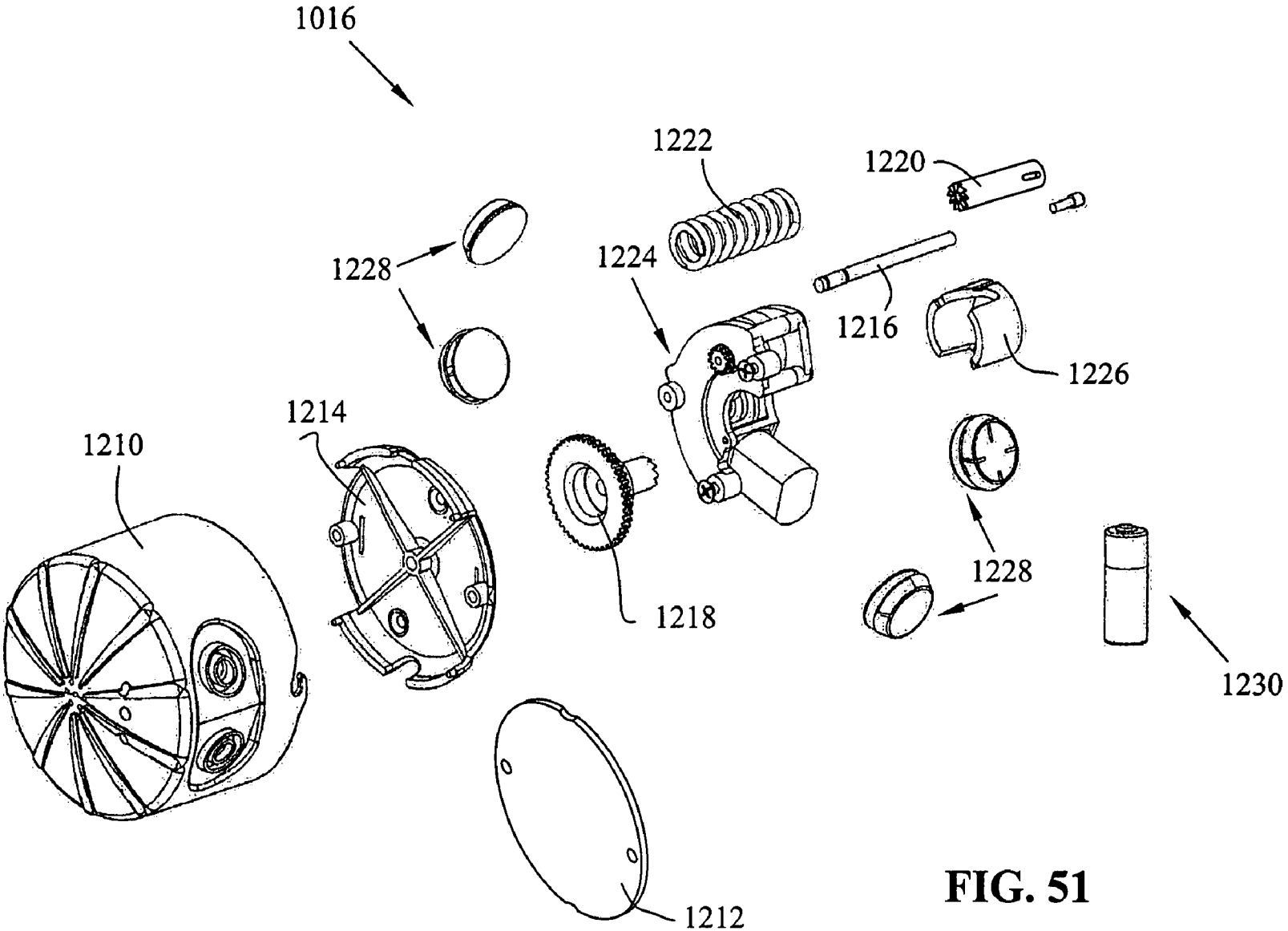
FIG. 51 depicts an exploded perspective view of an embodiment of the firing mechanism utilized in the embodiment of the invention depicted in FIG. 44.

FIG. 51 depicts the final configuration of motor assembly 1224. When fully assembled, upper frame 1370 is attached to lower frame 1372 with gear train 1364 being located intermediate thereof. An example of assembling motor assembly 1224 follows with reference to FIGS. 51, 58 and 59. It should be noted that one with ordinary skill in the art may alter these assembly steps and still achieve the same end result. Motor shaft 1368 of motor 1360 extends through central aperture 1396 in vertical wall 1388, and fasteners (not shown) may then be inserted into mounting apertures 1398 in order to affix motor 1360 to vertical wall 1388. Worm driver 1410 and worm 1412 are then attached to lower frame 1372 in a known manner. Worm driver 1410 should engage motor drive shaft 1368 in order to ensure that rotation of motor drive shaft 1368 creates rotation of worm 1412. Pin 1426 and second gear 1414 are attached to one of the mounting areas 1392 of lower frame 1372. Similarly, pin 1432 of mid gear 1416 is also attached to one of the mounting areas 1392 of lower frame 1372. Next, lower bushing 1438 is placed over bushing mounting area 1394 of lower frame 1372. Placement of lower bushing 1438 onto lower frame 1372 allows output gear 1418 to rotate about bushing 1438. Next, upper frame 1370 is placed upon lower frame 1372. When placed properly, pins 1400 are received by apertures (not shown) in upper frame 1370. In addition, legs 1378 should mate with raised mounts 1390, and pins 1426 and 1432 should also extend into mounting portions 1382. Furthermore, upper bushing 1440 now resides within main aperture 1380. Once upper frame 1370 has been placed on lower frame 1372, fasteners (not shown) may be utilized to ensure the two frame halves 1370, 1372 remain connected.

Figure 60:
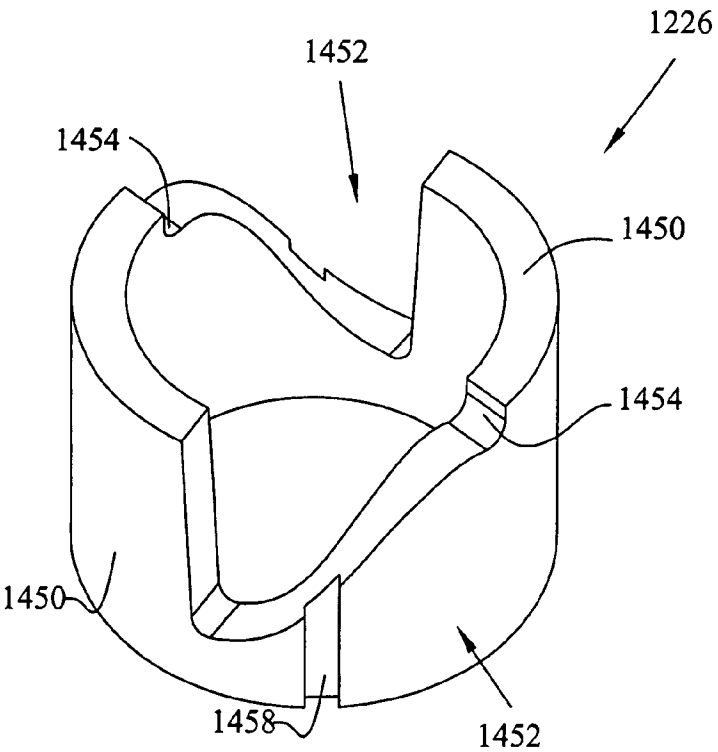
FIG. 60 depicts a perspective view of the cylindrical cam utilized in the firing mechanism depicted in FIG. 51.

FIG. 60 depicts cylindrical cam 1226. Cylindrical cam 1226 has a substantially cylindrical shape and may be manufactured of any sturdy material such as stainless steel. Cylindrical cam 1226 comprises a pair of full walls indicated by numeral 1450 and a pair of trace walls indicated by numeral 1452. In the present embodiment, full walls 1450 are substantially smooth and extend from the upper edge to the lower edge of cam 1226.

In the present embodiment of cam 1226, the upper surface of trace walls 1452 are similar to the traces present within cams of previous embodiments of the invention. Trace walls 1452 also include pin stop area 1454 defined by full walls 1450 and raised trace area 1456 and include a notch 1458. As can be seen in FIG. 60, notches 1458 extend substantially vertically in a direction parallel to the longitudinal axis of cam 1226.

FIG. 51 depicts a plurality of piezo buzzers indicated by numeral 1228. In the present embodiment, piezo buzzers 1228 create a buzzing sound when supplied an electric current. In addition, piezo buzzers 1228 are sized and configured to be inserted and retained within apertures 1264 by any known manner.

As shown in FIG. 51, battery pack 1230 includes a plurality of batteries 1460 and an electrical connection indicated by numeral 1462. Batteries 1460 may be of any type known in the art capable of generating enough voltage to satisfy the needs of the present invention. In addition, electrical connection 1462 may be of any type known in the art for allowing an electrical interaction of the batteries 1460. Electrical connection 1462 further includes wiring (not shown) connecting batteries 1460 to controller PCB 1212.

As shown in FIGS. 61 through 69, cartridge assembly 1018 includes a cartridge housing 1480, cap 1482, pusher 1484, cartridge 1486, cartridge cradle 1488, a needle 1490, a piston 1492, seal 1494 and aluminum powder 1496. Cartridge housing 1480 has a cylindrical shape and may be manufactured of any durable material such as stainless steel that resists corrosion. In the present embodiment, cartridge housing 1480 has a substantially smooth inner bore. The outer diameter of cartridge housing 1480 is sized and configured to be received within bore 1022 of housing 1012.

Figure 63:
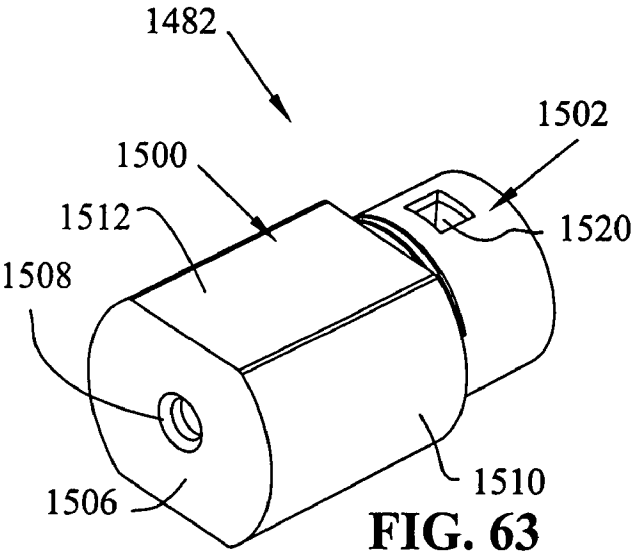
FIG. 63 depicts an underside perspective view of the cap utilized in the cartridge assembly depicted in FIG. 61.
Figure 62:
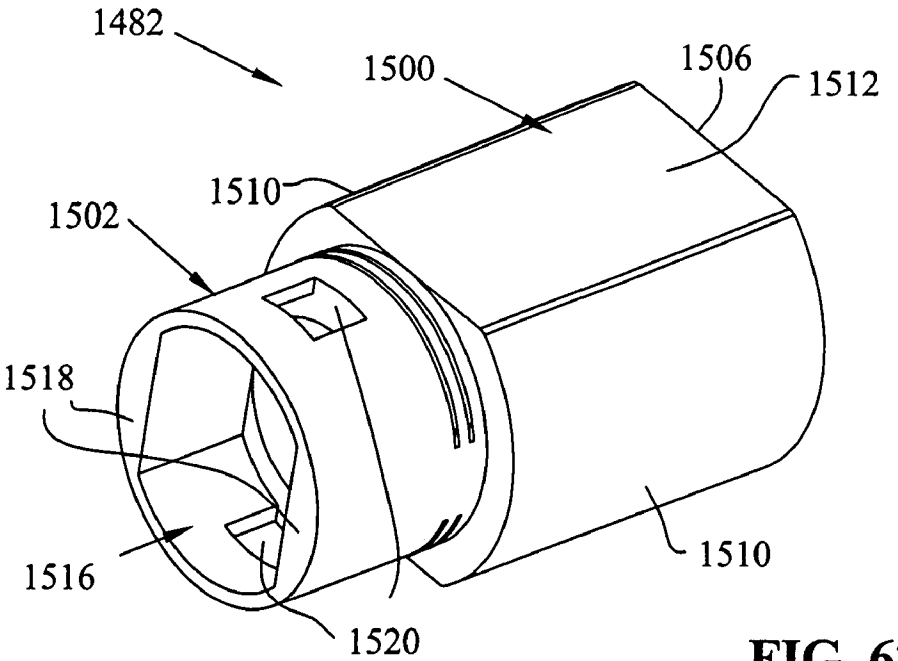
FIG. 62 depicts a perspective view of the cap utilized in the cartridge assembly depicted in FIG. 61.

FIGS. 62 and 63 depict cap 1482. In the present embodiment, cap 1482 includes a larger portion 1500 and a smaller portion 1502. Larger portion 1500 includes a top surface 1506, arcuate walls 1510 and flat walls 1512. Top surface 1506 includes aperture 1508. The arcuate walls 1510 and the flat walls 1512 extend downward from top surface 1506 and meet smaller portion 1502.

In the present embodiment, smaller portion 1502 has a substantially cylindrical shape with a smooth outer surface as shown in FIGS. 62 and 63. Interior bore 1516 of smaller portion 1502 includes flat surfaces 1518 running the length of the bore 1516. Smaller portion 1502 also includes a pair of openings 1520 that provide access to the bore from the exterior. In the embodiment depicted, openings 1520 are located on opposite sides of bore 1516 below flat surfaces 1518.

Figure 64:
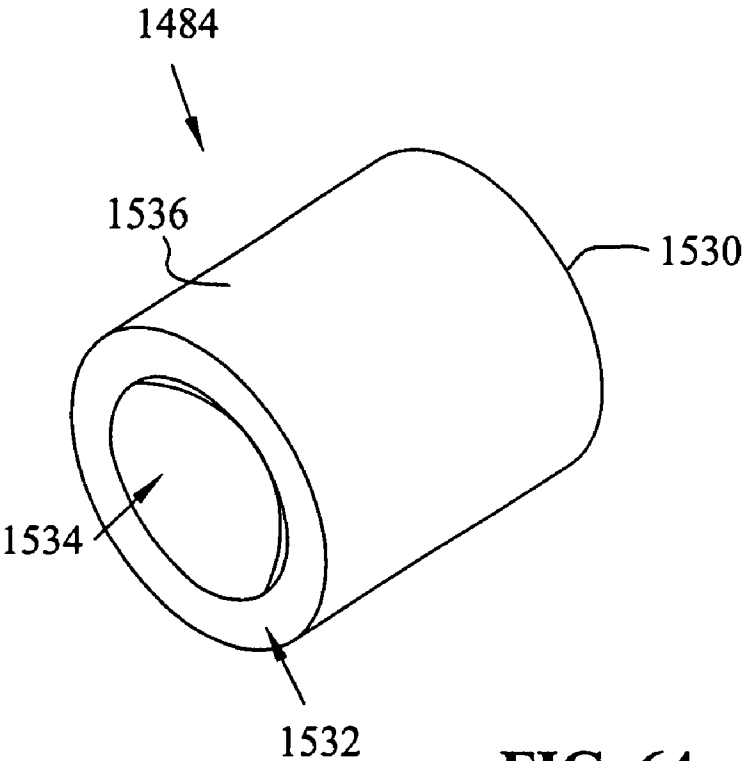
FIG. 64 depicts a perspective view of the pusher utilized in the cartridge assembly depicted in FIG. 61.

FIG. 64 depicts pusher 1484. Pusher 1484 may be comprised of any strong material and has a substantially cylindrical shape. Pusher 1484 includes top surface 1530 and bottom surface 1532. In the embodiment depicted, top surface 1530 is substantially smooth and planar, and bottom surface 1532 has an arcuate portion indicated by numeral 1534. Pusher 1484 further includes smooth walls 1536 located intermediate top surface 1530 and bottom surface 1532.

Figure 65:
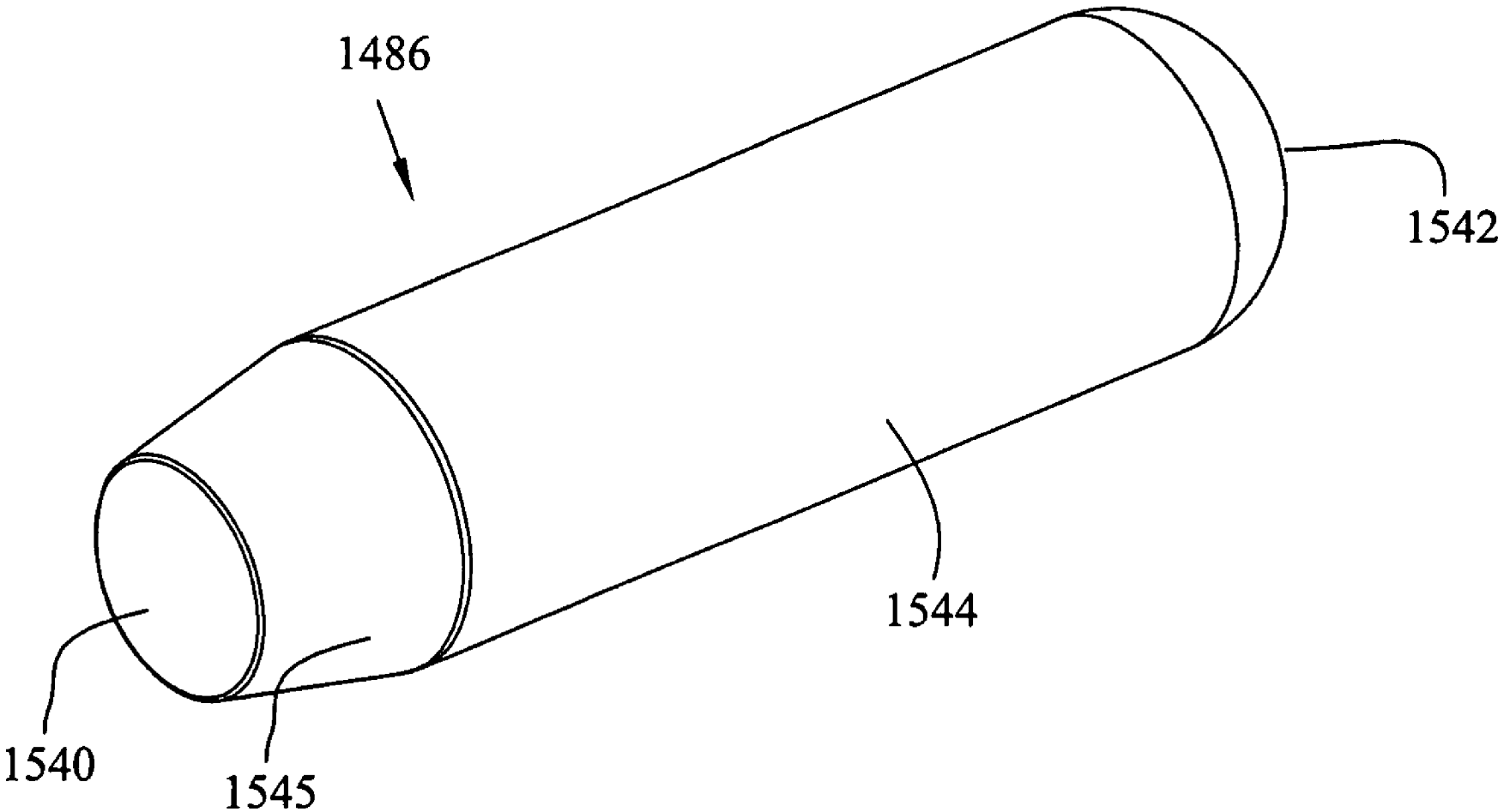
FIG. 65 depicts an underside perspective view of the cartridge utilized in the cartridge assembly depicted in FIG. 61.

FIG. 65 depicts cartridge 1486. Cartridge 1486 is similar to cartridges described in previous embodiments of the invention in that cartridge 1486 houses a pressurized inert gas, such as carbon dioxide. In the present embodiment, cartridge 1486 is orientated 180 degrees from previous embodiments. As shown in FIG. 65, cartridge 1486 has a substantially cylindrical shape and includes a thinner walled portion indicated by numeral 1540 and an arcuate thicker walled portion indicated by numeral 1542 with substantially smooth side walls indicated by numeral 1544 located intermediate. Thinner wall 1540 should be sufficiently strong as to maintain the pressurized gas within cartridge 1486 but must be thin enough as to be pierced when desired. Thicker wall 1542 has an arcuate shape complementary to that of the arcuate portion 1534 of pusher 1484. In the present embodiment, side walls 1544 include tapered portion 1545.

Figure 67:
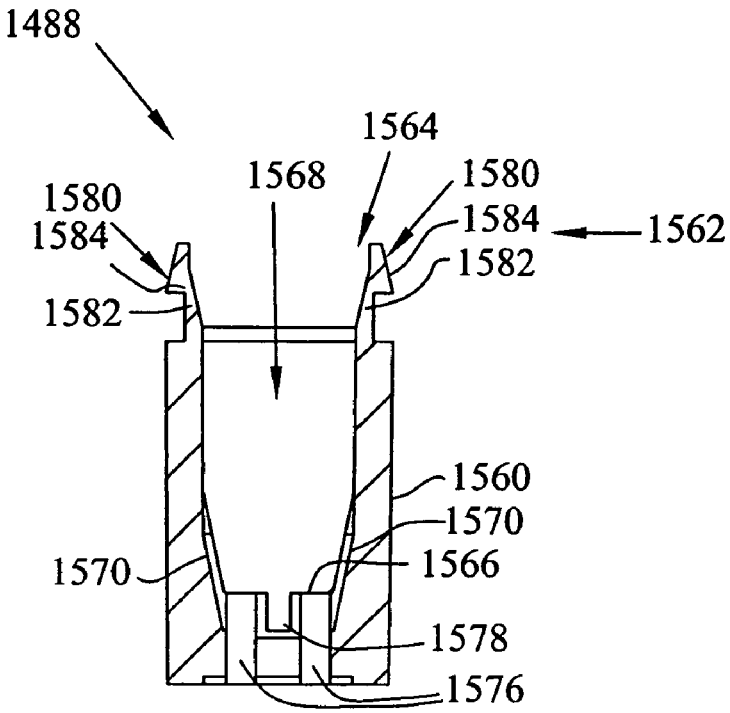
FIG. 67 depicts a section view of the cartridge cradle depicted in FIG. 66.
Figure 66:
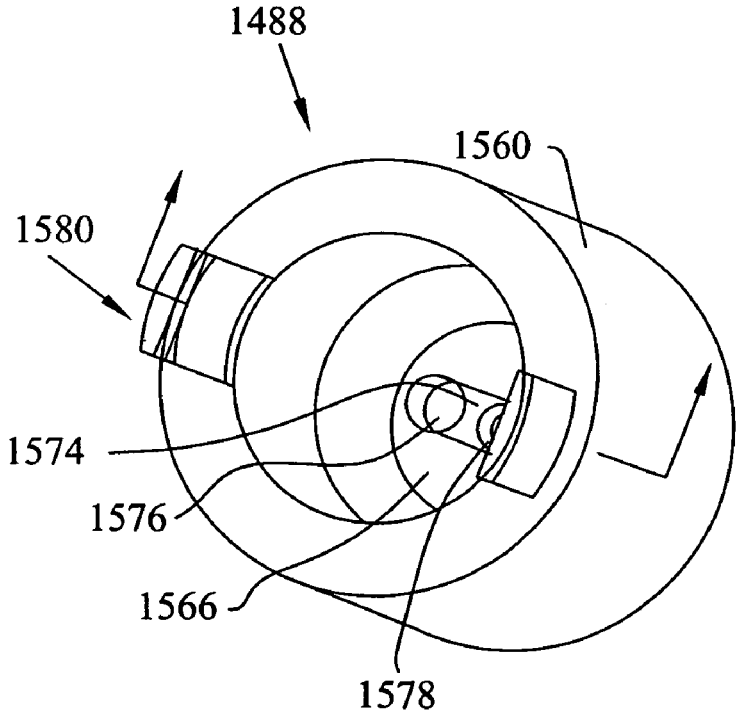
FIG. 66 depicts a perspective view of the cartridge cradle utilized in the cartridge assembly depicted in FIG. 61.

FIGS. 66 and 67 depict cartridge cradle 1488. In the present embodiment, cartridge cradle 1488 may be manufactured from injection molded plastic or similar type material. Cartridge cradle 1488 includes body 1560 and attachment portion 1562. In the present embodiment, body 1560 has a substantially cylindrical shape. At its first end, body 1560 includes an opening generally indicated by numeral 1564, and at its second end body 1560 includes a floor 1566. Opening 1564 defines a bore 1568 extending along the longitudinal axis of body 1560. As shown in FIG. 67, bore 1568 includes a tapered area indicated by numeral 1570 sized to receive tapered portion 1545, thereby giving bore 1568 a profile complementary to that of cartridge 1486.

As shown in FIGS. 66 and 67, floor 1566 includes a trough indicated by numeral 1574. In the present embodiment of the invention, trough 1574 includes a pair of apertures 1576 located at the ends thereof and a recess 1578 located substantially intermediate the two apertures 1576. As shown in FIG. 67, the apertures 1576 extend through floor 1566 in its entirety, whereas recess 1578 extends approximately half way into floor 1566.

In the present embodiment of the invention, attachment portion 1562 includes a pair of attachment mechanisms each generally indicated by numeral 1580 as depicted in FIGS. 66 and 67. The attachment mechanisms 1580 extend upwards from body 1560 on opposite sides of opening 1564. Each attachment mechanism 1580 includes an arm 1582 and a catch 1584. In the present embodiment, catch 1584 is positioned on the end of the arm located opposite body 1560. Each catch 1584 is sized and configured to be received within one of the openings 1520 of cap 1482.

Figure 68:
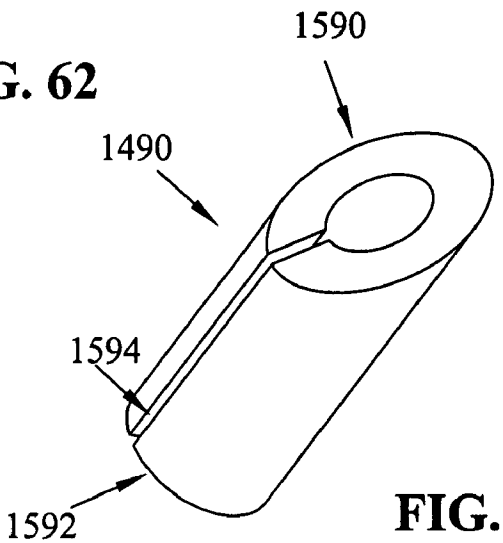
FIG. 68 depicts a perspective view of the needle utilized in the cartridge assembly depicted in FIG. 61.

FIG. 68 depicts needle 1490. In the present embodiment, needle 1490 may be manufactured from a sturdy, strong material not easily deformed. Needle 1490 includes a first end 1590 and a second end 1592. As can be seen in FIG. 68, first end 1590 has a tapered configuration, and second end 1592 is substantially flat. Second end 1592 is sized and configured to be received within recess 1578 of cartridge cradle 1488. Needle 1490 further includes a slot 1594 present within the side wall thereof. Slot 1594 runs from first end 1590 to second end 1592, and in the present embodiment, slot 1594 runs from the portion of tapered first end 1590 closest to second end 1592.

Figure 69:
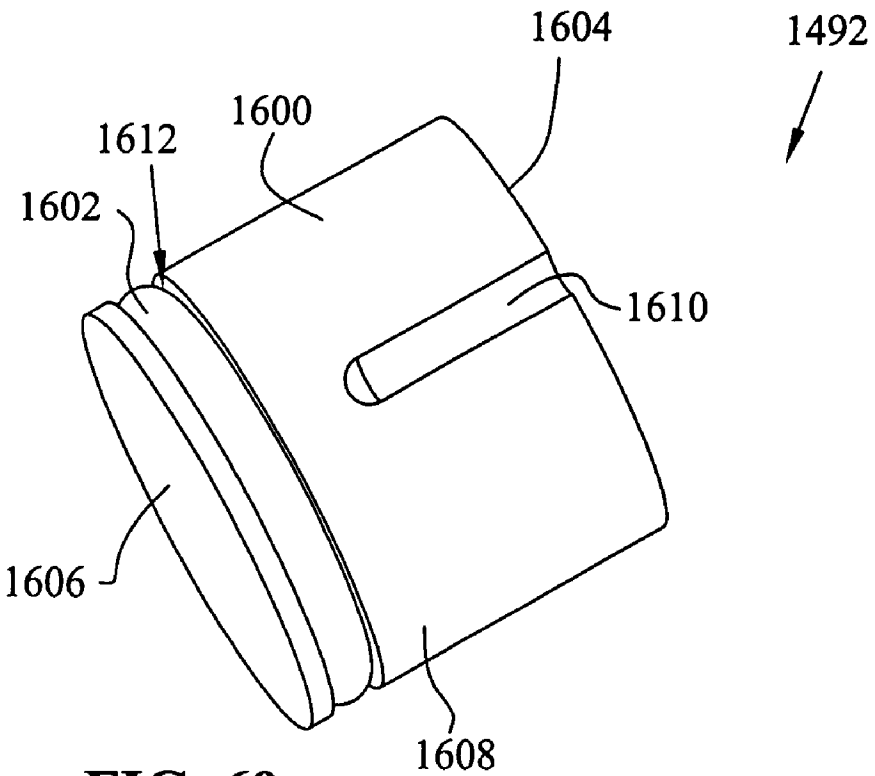
FIG. 69 depicts a perspective view of the piston utilized in the cartridge assembly depicted in FIG. 61.

FIG. 69 depicts piston 1492. Piston 1492 includes a body 1600 and o-ring 1602. In the present embodiment of the invention, body 1600 is comprised of a substantially sturdy material that does not deform easily. O-ring 1602 is generally manufactured from rubber and may be of any type known in the art. Body 1600 includes an upper surface 1604, lower surface 1606 and a sidewall 1608 located intermediate thereof. Upper surface 1604 and lower surface 1606 are both substantially planar surfaces.

Sidewall 1608 includes a pair of recesses 1610. In the present embodiment, recesses 1610 extend in a direction parallel to the longitudinal axis of piston 1492. Recesses 1610 extend from upper surface 1604 downward toward lower surface 1606. Recesses 1610 only extend approximately half way toward lower surface 1606 in the present embodiment.

Body 1600 further includes a recessed ring 1612 formed in the sidewall 1608. In the present embodiment, recessed ring 1612 is sized and configured to receive o-ring 1602.

FIGS. 70 through 73 depict the assembly of cartridge assembly 1018. It should be noted that the order of these steps are exemplary and may be altered as would be understood by one with ordinary skill in the art. In the present example, first seal 1494 is attached to an end of cartridge housing 1480 as indicated by arrow "A" in FIG. 70. Seal 1494 may be of any type known in the art similar to those described above and may be attached to cartridge housing 1480 by way of any known mechanism.

Figure 70:
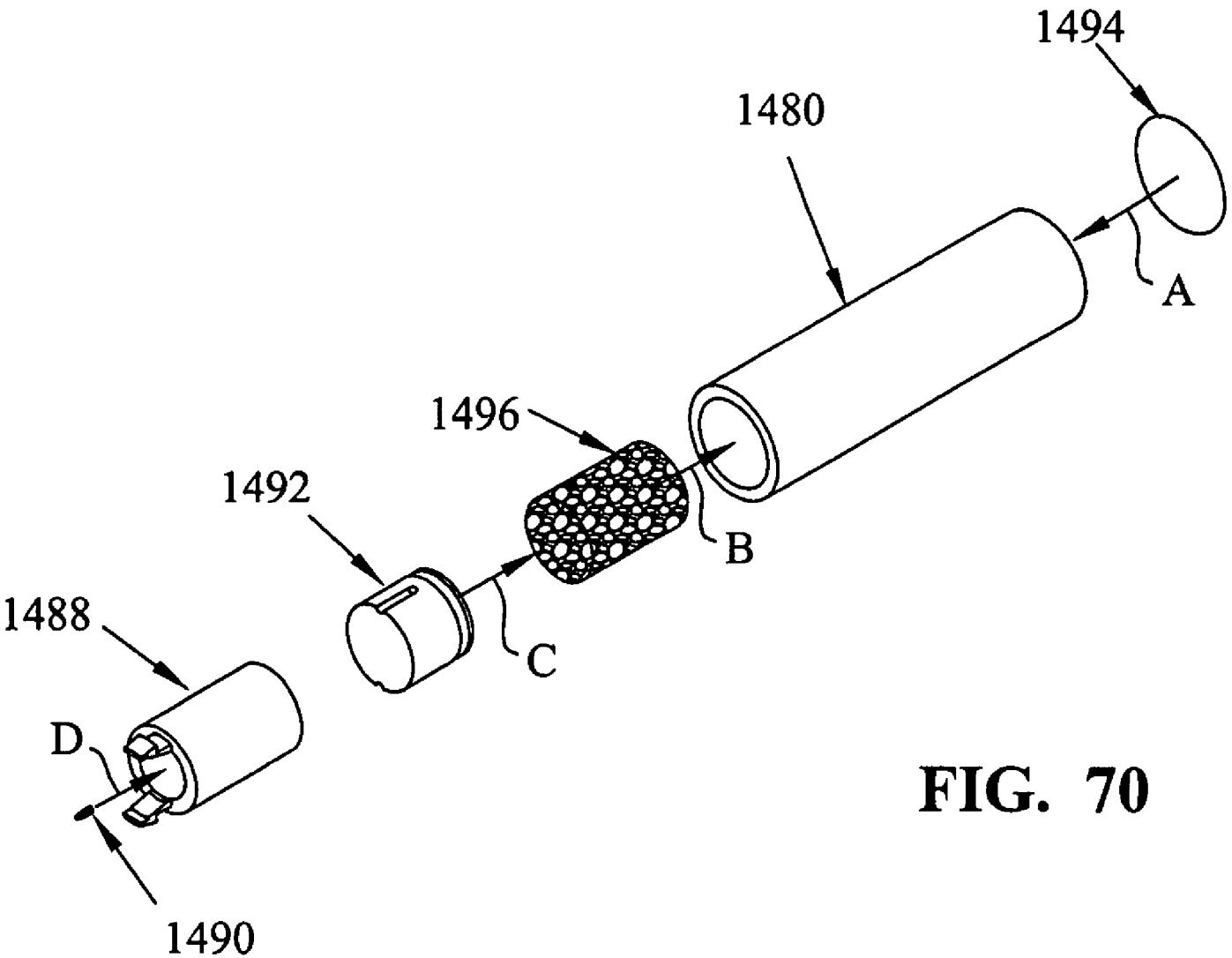
FIGS. 70 through 73 illustrate an example of the steps undertaken in assembling the cartridge assembly depicted in FIG. 61.

Once seal 1494 has been attached to one of the ends of cartridge housing 1480, aluminum powder 1496 is added to cartridge housing 1480 as indicated by arrow "B" in FIG. 70. Seal 1494 prevents aluminum powder 1496 from exiting the opposing end as the powder is added to the cartridge housing 1480. In the present embodiment, aluminum powder 1496 is similar to the powder described in previous embodiments. Once the aluminum powder 1496 has been added to the cartridge housing 1480, piston 1492 is inserted into cartridge housing 1480 as shown by arrow "C". In the present embodiment, lower surface 1606 is directed toward the aluminum powder 1496.

Needle 1490 may now be affixed to cartridge cradle 1488 in a known manner as indicated by arrow "D" in FIG. 70. When properly placed, second end 1592 of needle 1490 resides within recess 1578.

Figure 71:
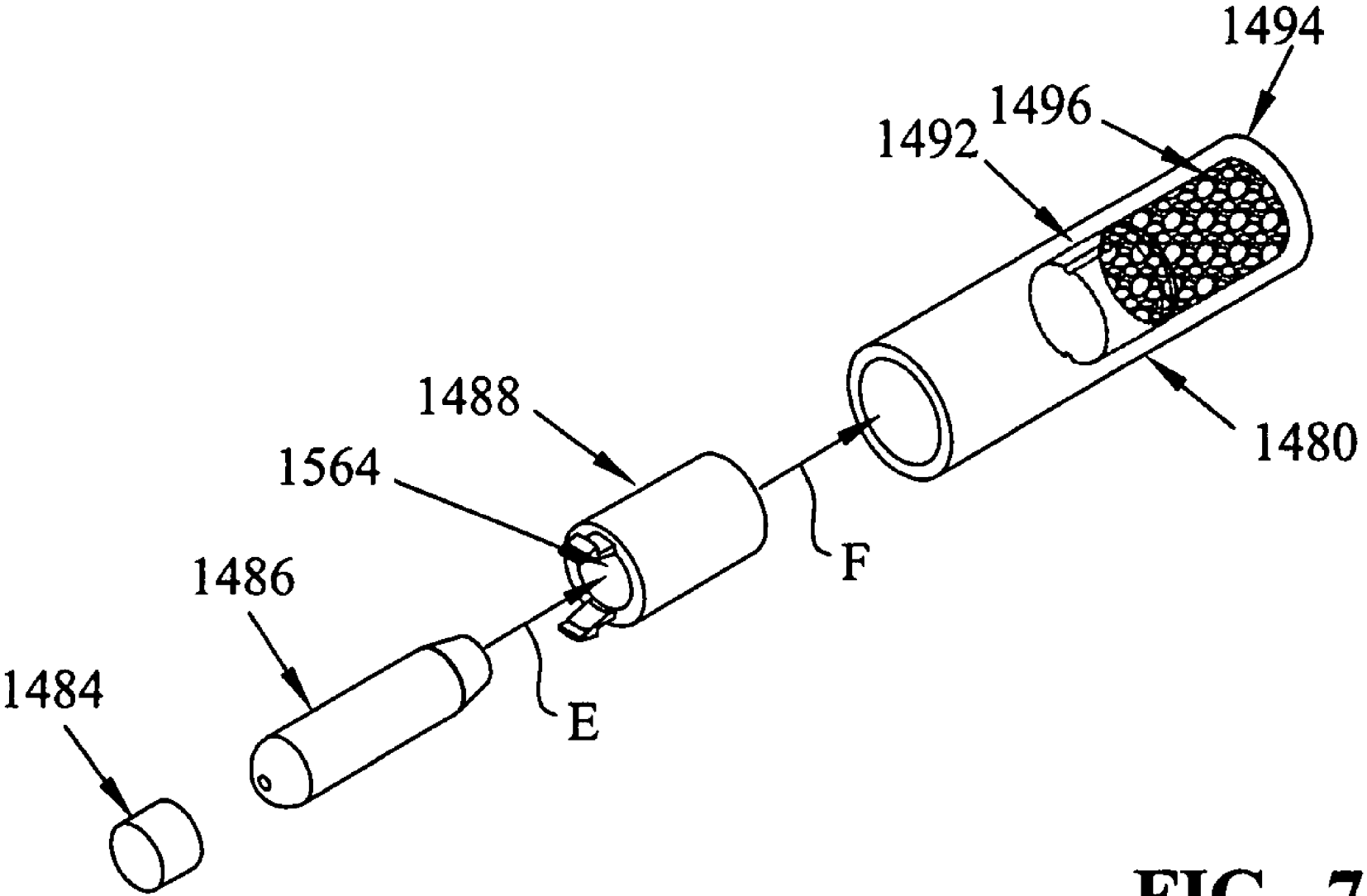

With the needle 1490 positioned with in cartridge cradle 1488, cartridge 1486 is inserted into the cartridge cradle 1488 as indicated by arrow "E" in FIG. 71. Specifically, cartridge 1486 is inserted into opening 1564. It should be noted that even when fully inserted, cartridge 1486 extends partially out of opening 1564. It should also be noted that the weight of cartridge 1486 is insufficient to allow needle 1490 to pierce cartridge 1486. Cartridge cradle 1488 is now inserted into cartridge housing 1480, as indicated by arrow "F".

Figure 72:
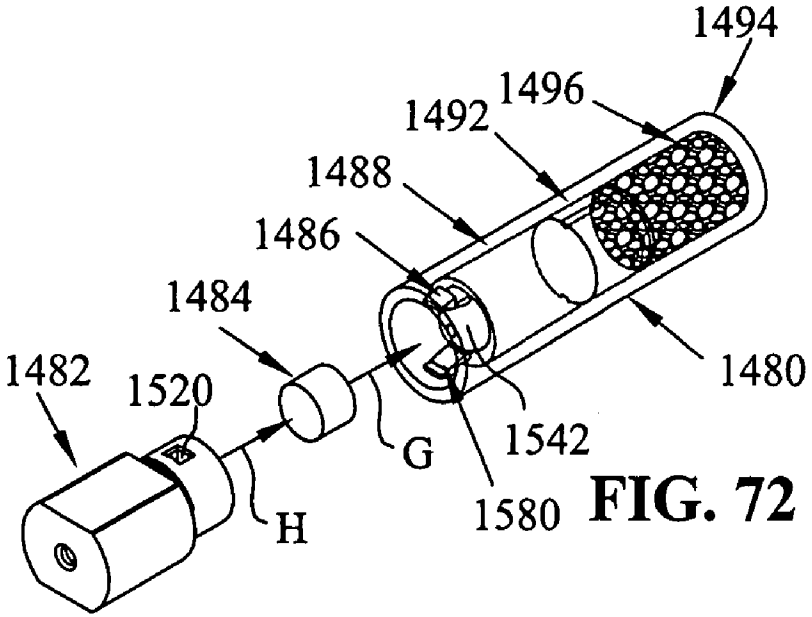
Figure 73:
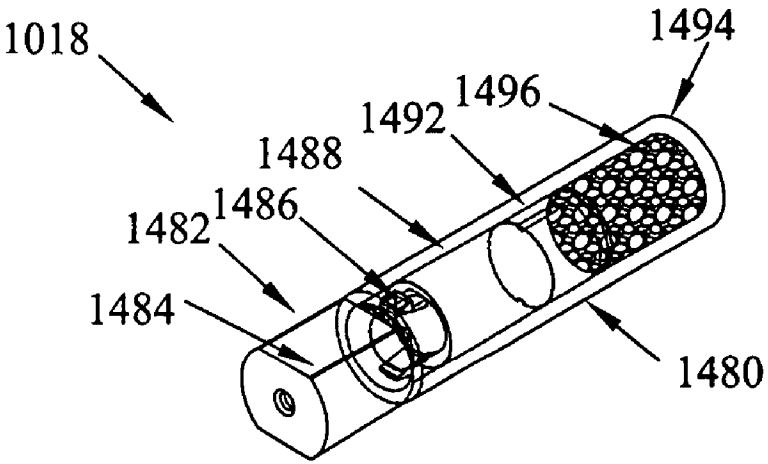

Pusher 1484 is then placed upon cartridge 1486 as indicated by arrow "G" in FIG. 72. Specifically, arcuate portion 1534 (see FIG. 64) is placed upon thicker wall portion 1542 of cartridge 1486. Once pusher 1484 has been arranged upon cartridge 1486, smaller portion 1502 of cap 1482 is inserted into cartridge housing 1480 as indicated by arrow "H". As cap 1482 is inserted into the cartridge housing 1480, smaller portion 1502 will contact attachment mechanism 1580 of cartridge cradle 1488. When cap 1482 has been fully inserted into cartridge housing 1480, catches 1584 of the cartridge cradle 1488 should be located within the openings 1520 of cap 1482. In addition, larger portion 1500 of cap 1482 should form a seal with the top surface of cartridge housing 1480. In the present example, this step completes the assembly of cartridge assembly 1018.

Now that the major components of device 1010 have been described, assembly of device 1010 will be set forth in detail. It should be noted that the following steps in assembling device 1010 are merely exemplary and may be altered as understood by one with ordinary skill in the art. When assembling device 1010, cartridge assembly 1018 should be assembled as described immediately above. In addition, dispersal mechanism 1014 should be assembled as explained above with respect to previous embodiments. The only change between the current version of dispersal mechanism 1014 and previous embodiments of dispersal mechanism relate to changes in nozzle interface 1046. These changes do not affect the assembly of the dispersal mechanism 1014.

With reference to FIGS. 74 through 77, in the present example illustrating the assembly of device 1010, firing mechanism 1016 must first be assembled. An example of the steps for assembling firing mechanism 1016 will now be described. First, controller PCB 1212 is affixed to PCB cover 1214 in any manner known as indicated by arrow "I".

Pivot shaft 1216 is then inserted into PCB cover 1214. Pivot shaft 1216 may be retained within PCB cover 1214 in any known manner. Next, central drive gear 1218 is attached to pivot shaft 1216 as indicated by arrow "K". Again, central drive gear 1218 may be affixed to pivot shaft 1216 in any known manner. If desired, a thrust bearing may be positioned on pivot shaft 1216 intermediate the PCB cover 1214 and central drive gear 1218.

Motor assembly 1224 may also be connected to PCB cover 1214 by a plurality of fasteners (not shown). Fasteners may be asserted into apertures in the PCB cover 1214 which align with the apertures in legs 1378 of motor assembly 1224. Battery pack 1230 may also be affixed to PCB cover 1214 (arrow "M") by way of any manner known. Once battery pack 1230 has been affixed to PCB cover 1214, electrical connections should be made with both the controller PCB 1212 and motor 1360 of motor assembly 1224. These electrical connections may be accomplished in any known manner.

Figure 75:
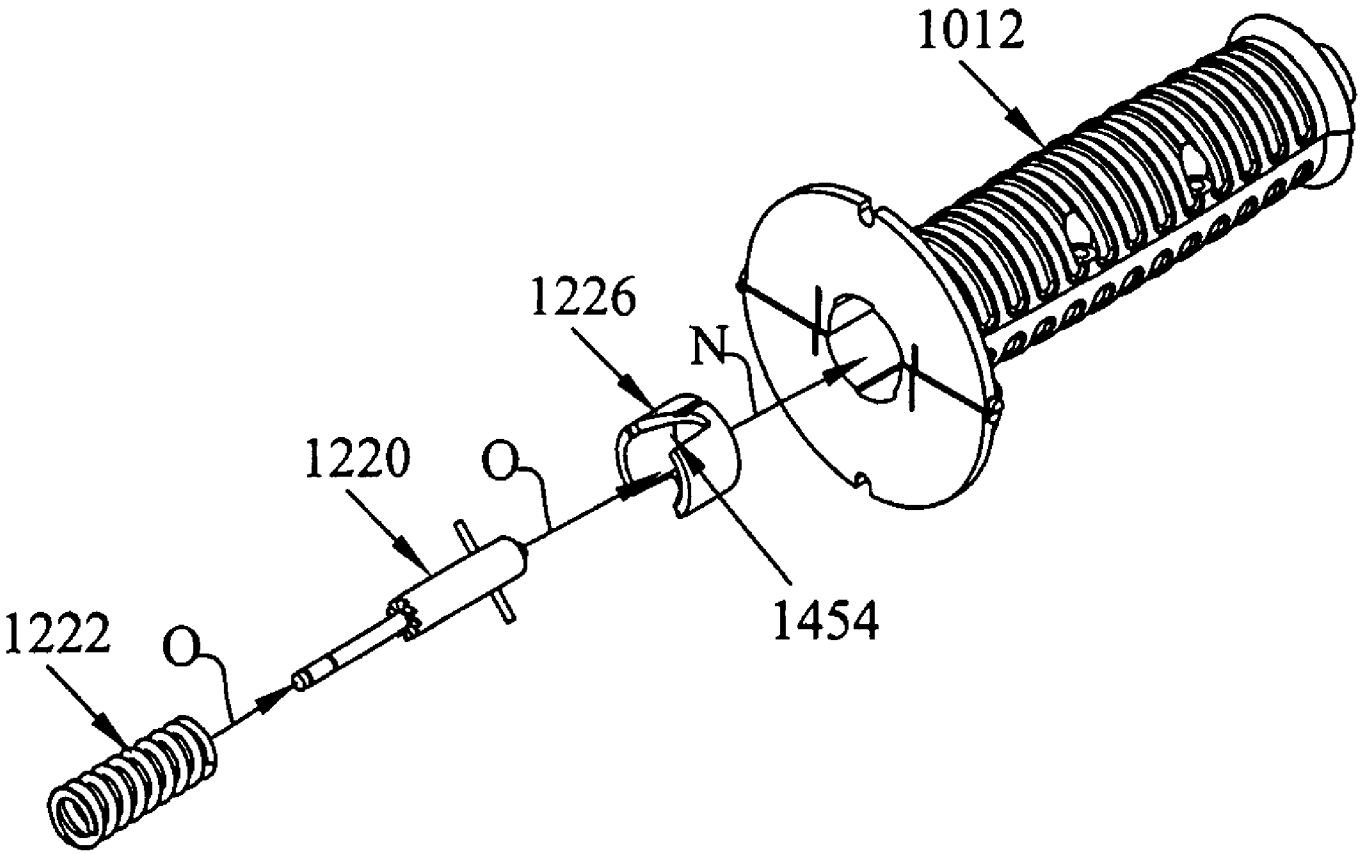

In order to complete assembly of firing mechanism 1016, cylindrical cam 1226 is dropped into the bore 1022 of housing 1012 as indicated by arrow "N" in FIG. 75. Cylindrical cam 1226 should be arranged with pin stop area 1454 directed upward. Following the insertion of cylindrical cam 1226 into bore 1022, firing pin 1220 is inserted into the cylindrical cam 1226. Specifically, cross pin 1332 should be received by pin stop area 1454. Next, spring 1222 is placed upon firing pin 1220, contacting cross pin 1332 (arrow "O"). It should be noted that, if desired, a thrust bushing may be placed intermediate spring 1222 and cross pin 1332.

Figure 74:
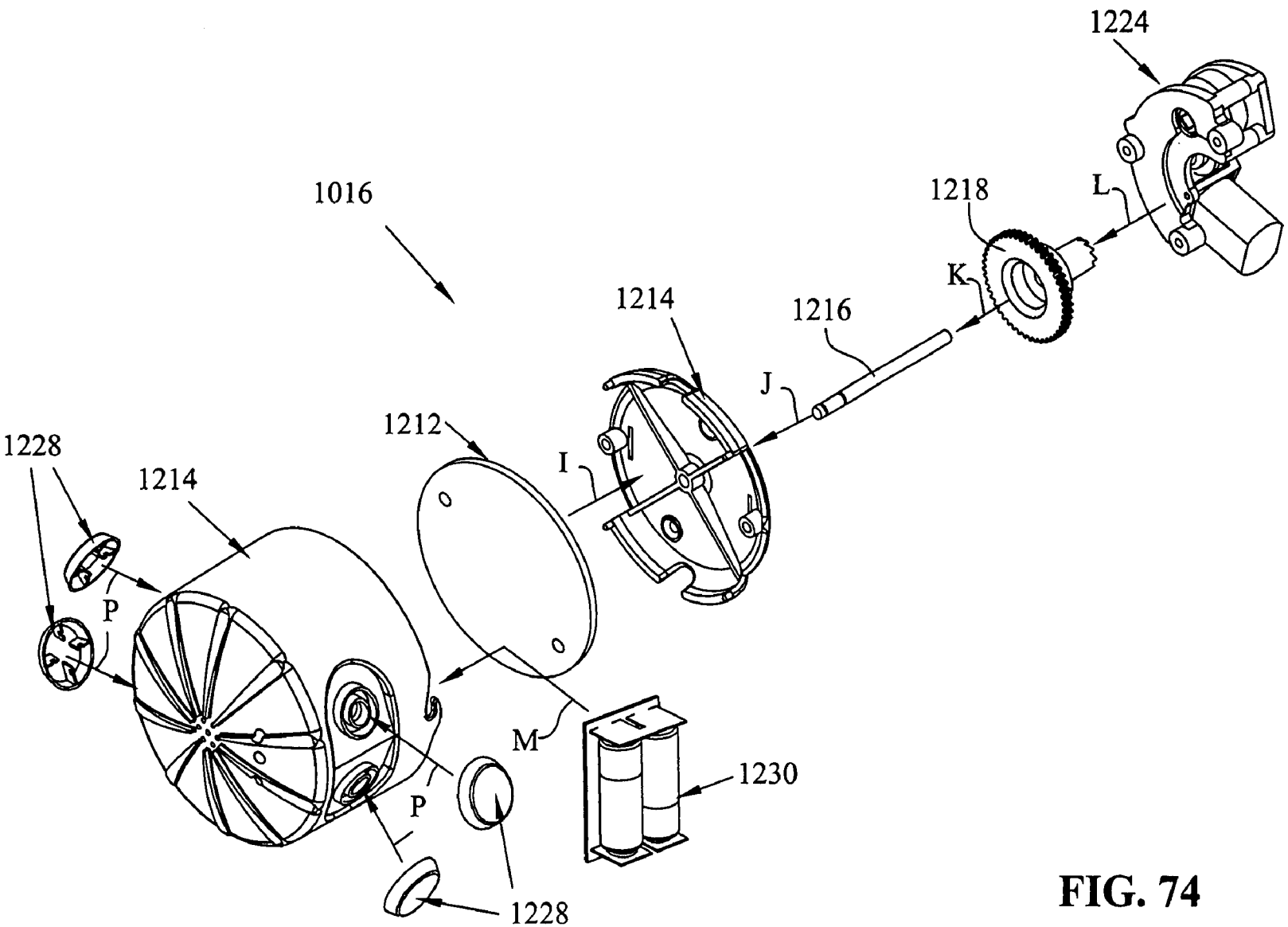
FIGS. 74 through 77 illustrate an example of the steps undertaken in assembling the embodiment of the invention depicted in FIG. 44.

The piezo buzzers 1228 may now be affixed to timer housing 1210 as shown by arrow "P" in FIG. 74. The piezo buzzers 1228 are connected to apertures 1264 in a known manner. Timer housing 1210 is now attached to PCB cover 1214 in any manner known in the art. It should be noted that when properly attached, pin 1290 of PCB cover 1214 are received by receiving area 1268 of timer housing 1210. Piezo buzzers 1228 should also be electrically connected to PCB 1212.

Figure 76:
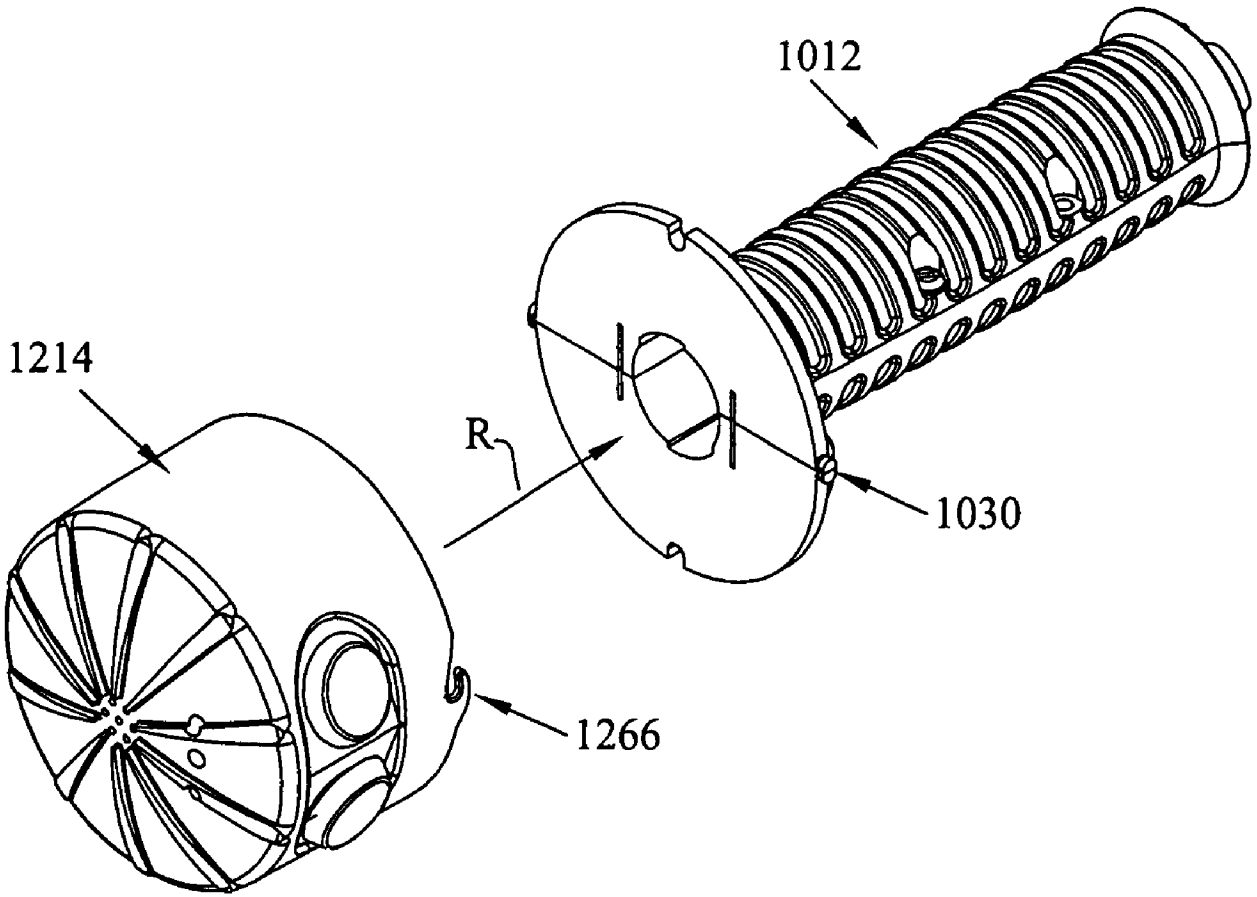

Timer housing 1210 may now be attached to housing 1012 by rotating timer housing 1210 such that the hooks 1266 catch upon protrusions 1030 as indicated by arrow "R" in FIG. 76. The force provided by spring 1222 should be sufficient to ensure that the protrusions 1030 are retained within the hooks 1266, thereby permanently affixing firing mechanism 1016 to housing 1012. If desired, one skilled in the art may employ fasteners to further ensure the firing mechanism 1016 remains connected to housing 1012.

Figure 77:
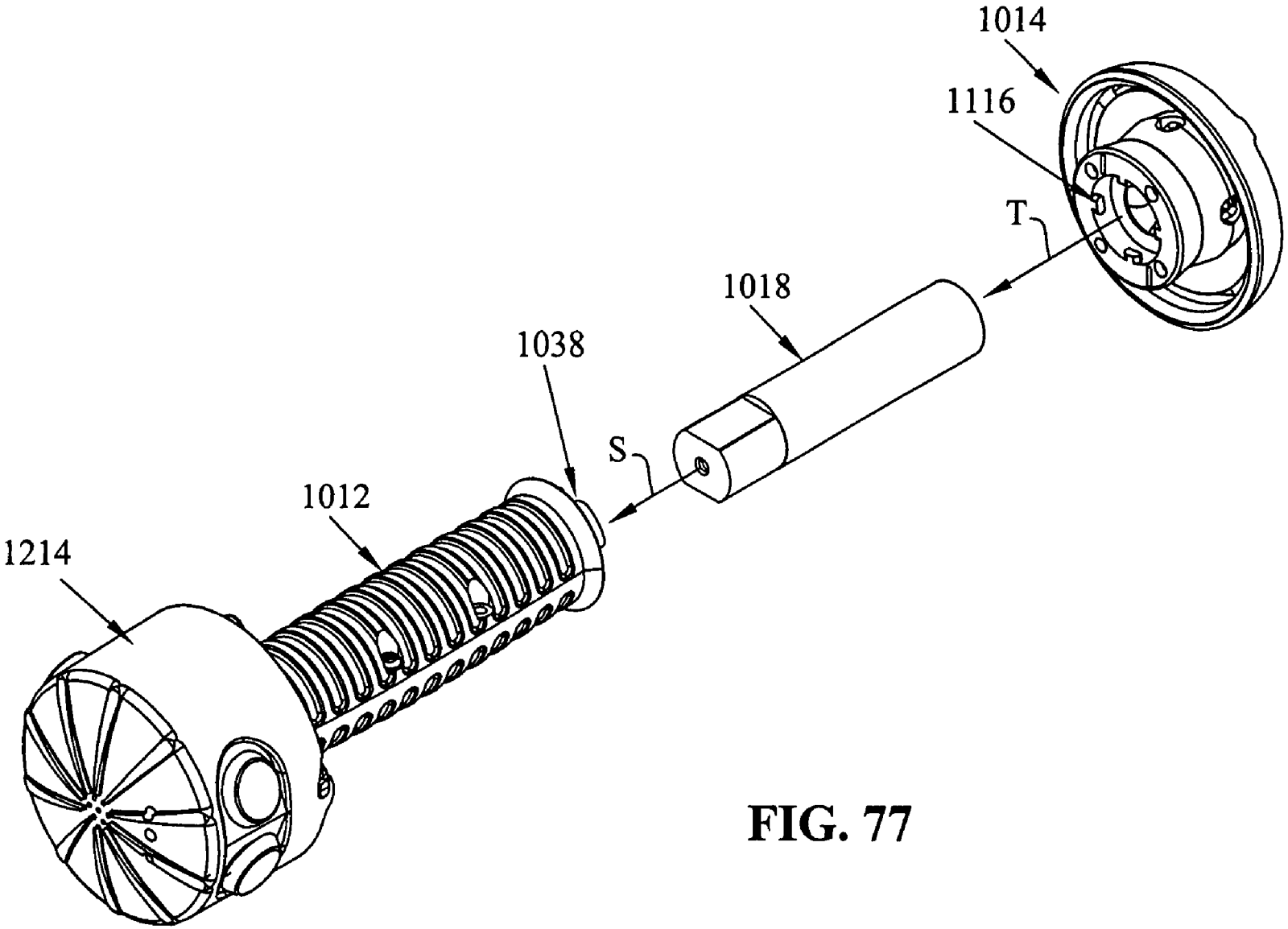

Cartridge assembly 1018 may be inserted into bore 1022 of housing 1012 through second end 1026 as indicated by arrow "S" in FIG. 77. It should be noted when cartridge assembly 1018 has been properly inserted, aperture 1508 of top 1482 should be aligned with firing pin 1220.

Once the cartridge assembly 1018 has been inserted into bore 1022, dispersal mechanism 1014 is attached to the housing 1012 (arrow "T"). This is accomplished by rotating dispersal mechanism 1014 until protrusion 1116 comes into engagement with slot 1038 of affixing members 1032. If desired, any type of known mechanism capable of ensuring dispersal mechanism 1014 remains connected to housing 1012 may be employed. This completes the assembly of the device.

Figure 78:
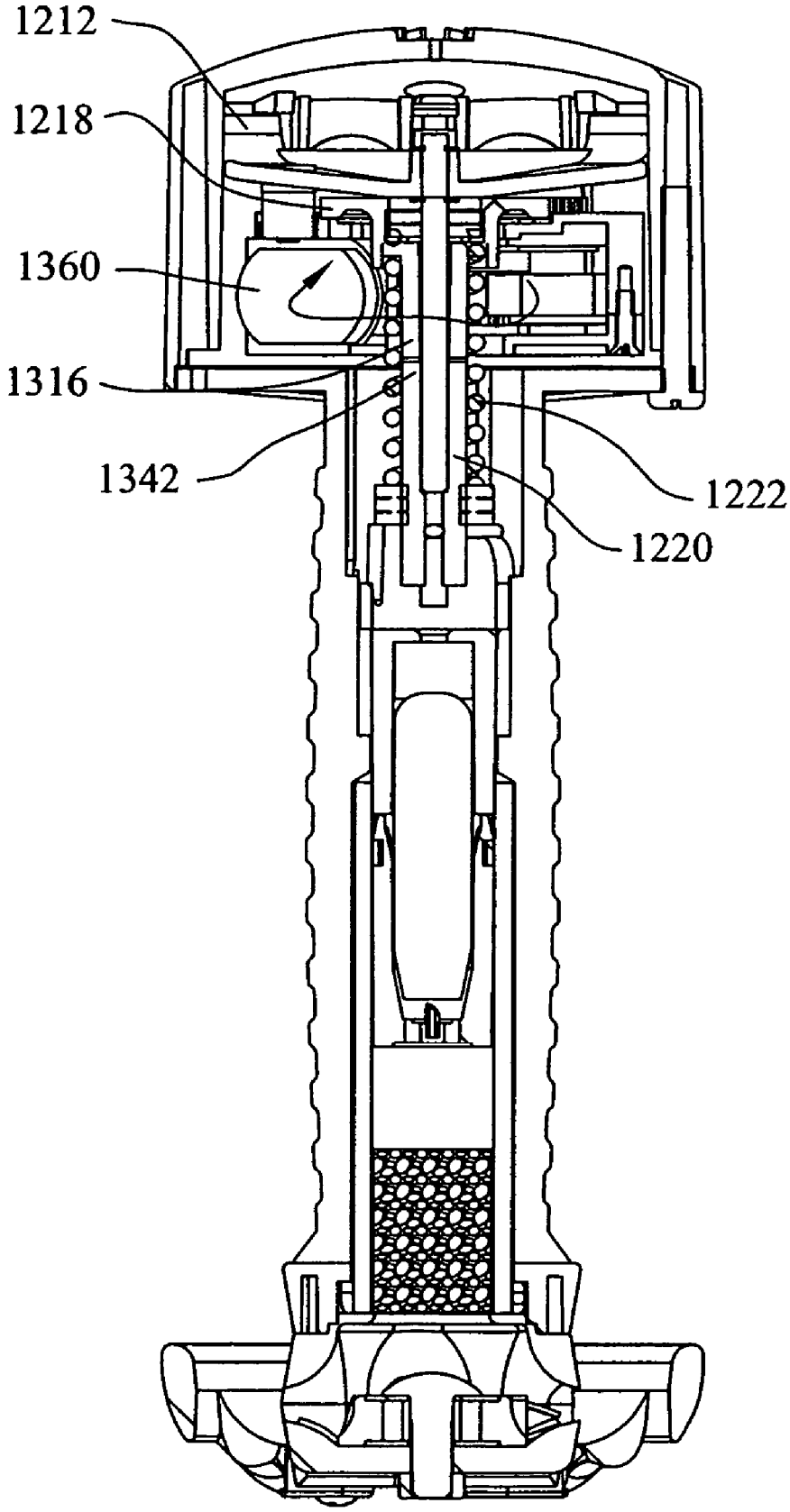
FIGS. 78 through 81 illustrate the configuration of the device depicted in FIG. 44 at various times during operation.
Figure 79:
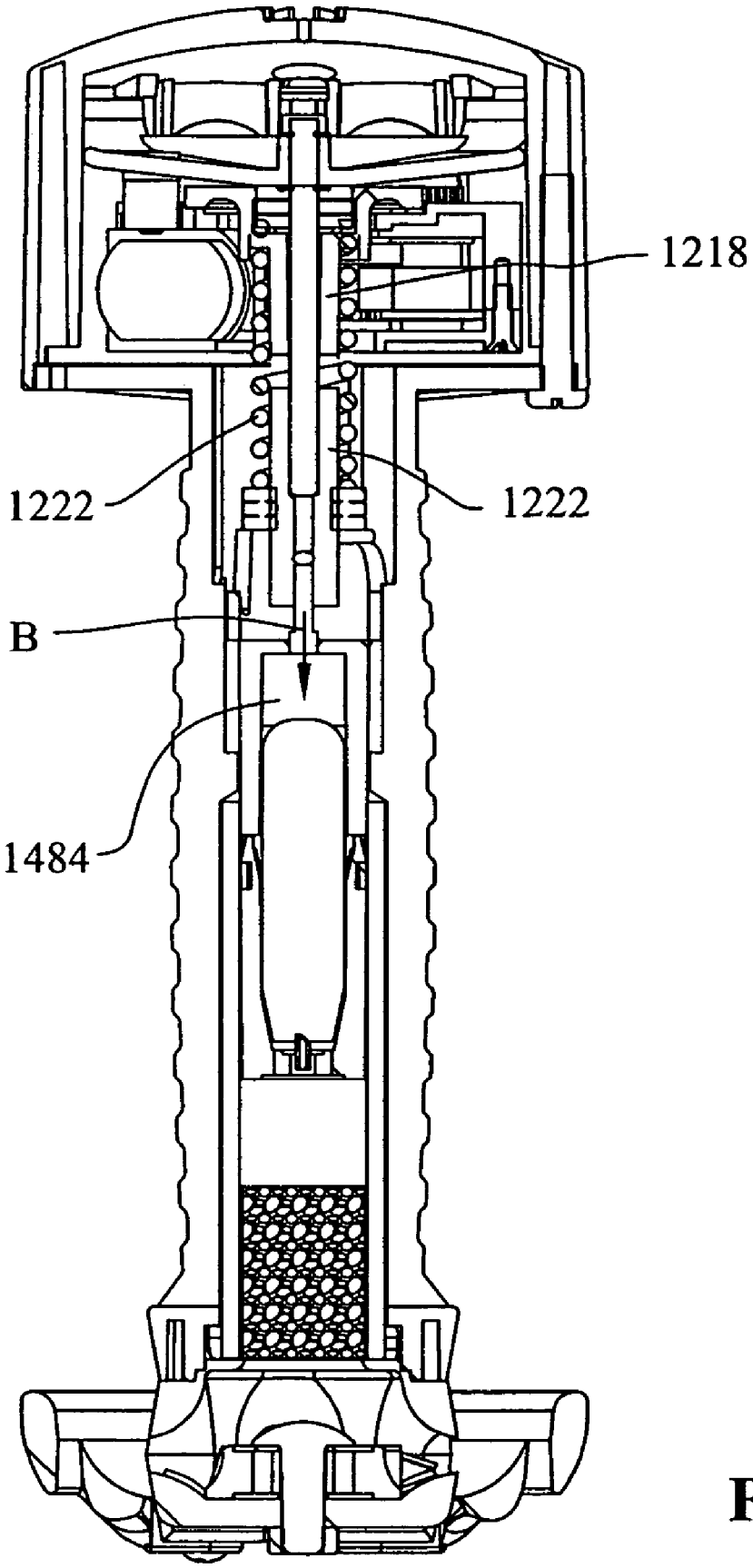
Figure 80:
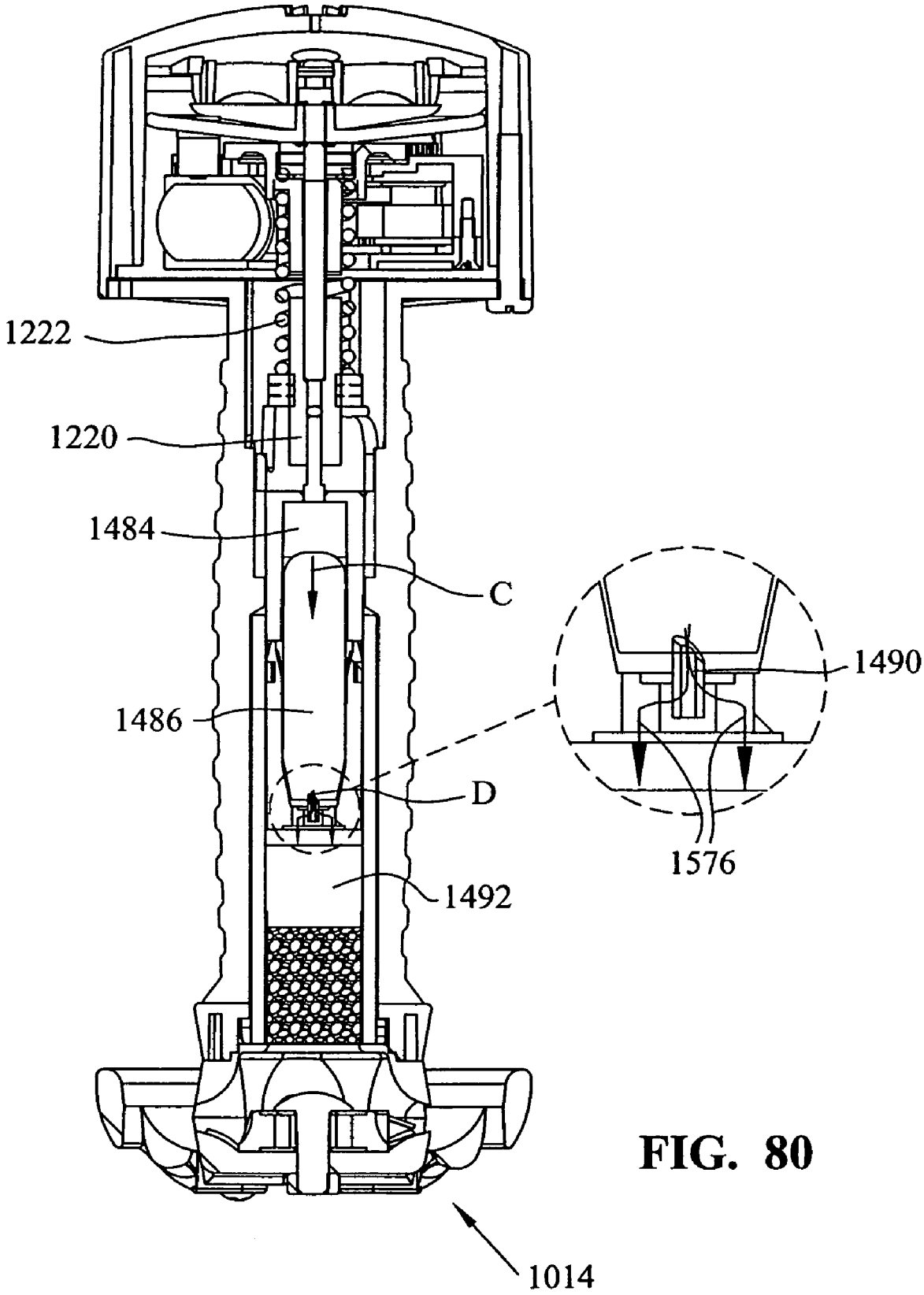
Figure 81:
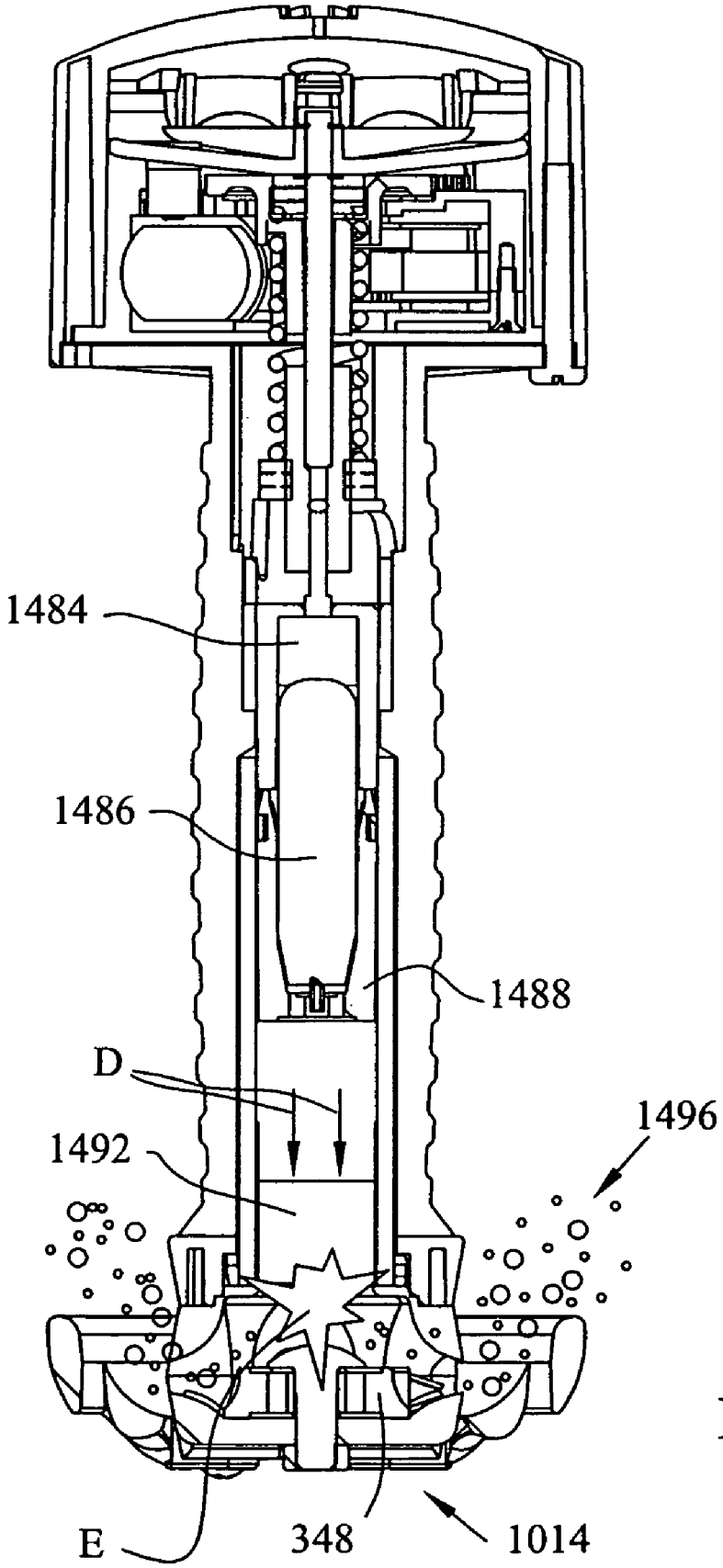

Now that the assembly of the device has been fully described, actuation of the device will be described in detail. In order to fire the device, the operator must arm the firing device by way of any known mechanism. Examples of arming the device are described with respect to previous embodiments. Once the device has been armed, an operator may then throw the device. Referring now to FIG. 78, after the predetermined time delay has been expired, controller PCB 1212 will actuate motor 1360. The rotational movement of motor drive shaft 1368 translates through gear trail 1364 and drive gear 1366, thereby causing rotation of central drive gear 1218. As central drive gear 1218 begins rotation, splines 1316 of central drive gear 1218 interact with splines 1342 of firing pin 1220. This results in the rotation of firing pin 1220 as indicated by arrow "A" in FIG. 78, in a manner similar to that described in detail with respect to previous embodiments. As firing pin 1220 rotates, cross pin 1332 moves beyond pin stop area 1454 in cam 1226. As soon as cross pin 1332 passes beyond the pin stop area 1454, spring 1222 acts upon the firing pin 1220, pushing the firing pin 1220 vertically downward with cross pin 1332 traveling on the upper surfaces of the trace walls 1452 as indicated by arrow "B" in FIG. 79.

Spring force 1222 is sufficient to cause firing pin 1220 to act upon pusher 1484. Pusher 1484 thereby forces cartridge 1486 downward, as indicated by arrow "B" in FIG. 80, into needle 1490. As cartridge 1486 is forced upon needle 1490, needle 1490 punctures cartridge 1486 and releases the pressurized inert gas contained therein as indicated by arrows "D". Cartridge 1486 seals against the cartridge cradle 1488, forcing the gas through apertures 1576 of cartridge cradle 1488. The gas acts upon the piston 1492, thereby driving the piston toward the aluminum powder 1496. If configured properly and so desired, interference with land 1028 (FIG. 48) prevents the cartridge 1486 and cartridge cradle 1488 from traveling with piston 1492. The expansion of the gas provides a sufficient force to drive the piston 1492 toward the aluminum powder 1496 and break seal 1494. In a manner as described above with respect to previous embodiments, aluminum powder 1496 exits dispersal mechanism 1014 and forms a cloud. Once piston 1492 has forced all of the aluminum powder 1496 from the housing 1012, piston 1492 contacts dispersal mechanism 1014, thereby igniting the igniter assembly 348 and causing a spark, indicated by "E" in FIG. 81, that ignites the aluminum powder 1496 which has been expelled from the device 1010. The ignition of the aluminum powder 1496 creates a disorienting flash.

At the same time, controller PCB 1212 sends an electrical current to the piezo buzzers 1228 in order to create a loud buzzing disorienting sound. The combination of the loud buzzing sound in addition to the flash caused by the sparking of the aluminum powder creates a disorienting effect and a diversion upon the target.

The device 1010 may be reused once recovered. In order to accomplish this, an operator of the device 1010 removes the dispersal mechanism 1014 by rotating the mechanism 1014 with respect to housing 1012 thereby allowing the operator to remove the dispersal mechanism 1014. The operator than removes the spent cartridge assembly 1018 and inserts a fresh cartridge assembly 1018 with aluminum powder 1496. In doing so, the operator also resets the firing pin 1220 in cylindrical cam 1226 in a manner consistent with that described above with respect to previous embodiments. When cylindrical cam 1226 drops down with cartridge assembly 1018 in the present embodiment, cross pin 1220 rests upon a ramp 1029 (see FIG. 48) present within bore 1022. The configuration of the ramp moves cross pin 1220 into position to be received within pin stop area 1454. Once reset, cross pin 1332 of the firing pin 1220 again resides within pin stop area 1454 of the cam 1226. The operator now reattaches the dispersal mechanism 1014, and the device 1010 is ready to be fired again, when desired.

While the invention has been taught with specific reference to the above described embodiments, someone skilled in the art will recognize that changes can be made in form and detail without departing from the spirit and scope of the invention. For example, changes in the shape of the above described hardware may be made. Furthermore, the location, size and shape of apertures for mounting and assembling the keyless entry system may be changed as required depending upon the specific application. As such, the described embodiments are to be considered in all respects only as illustrative and not restrictive. The scope of the invention is therefore, indicated by the following claims rather than by the description.

What is claimed is:

1. A device for creating a diversion comprising:

a housing including a cavity, a first end and a second end;

a firing mechanism comprising a firing device, said firing mechanism being attached to said first end;

a dispersal mechanism attached to said second end and connected to said cavity;

an inert gas within said cavity, a powder within said cavity;

a piston located intermediate said inert gas and said powder; and a cartridge positioned within said cavity, said inert gas residing within a cavity of said cartridge, said inert gas escaping said cartridge upon activation of said firing device;

wherein activation of said firing device causes said piston to force said powder from said cavity through said dispersal mechanism.

2. The device for creating a diversion as set forth in claim 1 wherein said firing device acts upon said inert gas so that said inert gas asserts a force on said piston of sufficient magnitude to cause said piston to force said powder through said dispersal mechanism.

3. The device for creating a diversion as set forth in claim 1 wherein said firing mechanism further includes at least one acoustic device allowing said inert gas to exit said cavity upon activation of said firing device, said inert gas creating an audible emission as said inert gas flows through said acoustic devices.

4. The device for creating a diversion as set forth in claim 3 wherein said audible sound has a magnitude of at least 90 decibels.

5. The device for creating a diversion as set forth in claim 4 wherein said magnitude of said audible sound is at least 135 decibels.

6. The device for creating a diversion as set forth in claim 3 wherein said firing mechanism includes four of said acoustic devices.

7. The device for creating a diversion as set forth in claim 1 wherein said firing mechanism further includes a printed circuit board for controlling said firing device.

8. The device for creating a diversion as set forth in claim 7 wherein said firing mechanism further includes at least one switch for entering a delay time whereby, upon activation, said printed circuit board does not fire said firing device until said delay time expires.

9. The device for creating a diversion as set forth in claim 1 wherein said dispersal mechanism includes a plurality of baffles for directing said powder in an encompassing pattern around said device.

10. The device for creating a diversion as set forth in claim 9 wherein a spark ignites said powder thereby causing said powder to ignite.

11. The device for creating a diversion as set forth in claim 10 wherein said dispersal mechanism further includes a piezoelectric component capable of creating said spark when said piezoelectric component is contacted by said piston.

12. The device for creating a diversion as set forth in claim 1 wherein said inert gas is carbon dioxide.

13. The device for creating a diversion as set forth in claim 1 wherein said powder is aluminum.

14. The device for creating a diversion as set forth in claim 1 further comprising a cartridge housing said inert gas.

15. The device for creating a diversion as set forth in claim 14 wherein said cartridge includes a first end, a second end, a cavity and at least one aperture extending through one of said ends, said inert gas being retained within said cavity in a pressurized manner.

16. The device for creating a diversion as set forth in claim 15 wherein said firing device engages at least one of said apertures thereby preventing said inert gas from escaping said cartridge whereupon activation of said firing device causes said firing device to cease engagement of said apertures thereby allowing said inert gas to escape said cartridge.

17. The device for creating a diversion as set forth in claim 16 wherein said inert gas propels said cartridge into contact with said piston as said inert gas escapes said cavity.

18. The device for creating a diversion as set forth in claim 17 wherein said firing mechanism further includes at least one acoustic device and said inert gas travels through said acoustic devices after escaping from said cavity whereby said acoustic devices create an audible emission as said inert gas passes through said acoustic device.

19. A device for creating a diversion comprising:

a firing mechanism;

a handle portion;

a dispersal mechanism;

a powder capable of producing a disorientating flash when ignited by a spark;

a least one igniter to ignite the powder dispersed from the device;

a cartridge containing a pressurized inert gas;

wherein movement of said cartridge relative to said firing mechanism causes said cartridge to release said pressurized inert gas which forces said powder from said device through said dispersal mechanism.

20. The device for creating a diversion as set forth in claim 19 wherein said dispersal mechanism includes a plurality of piezo igniters capable of producing a spark of sufficient magnitude to ignite a portion of said powder leaving the device.

21. The device for creating a diversion as set forth in claim 19 wherein said dispersal mechanism directs said powder into a pattern encompassing the device as said powder exits said dispersal mechanism.

22. The device for creating a diversion as set forth in claim 19 wherein said firing mechanism includes a member moveable with respect to said canister along the longitudinal axis of said device.

23. The device for creating a diversion as set forth in claim 22 wherein said moveable member comprises a solenoid.

24. The device for creating a diversion as set forth in claim 22 wherein said firing mechanism further comprises a cylindrical cam including a trace and said moveable member includes a dowel engaging said trace.

25. The device for creating a diversion as set forth in claim 24 further including a spring capable of providing a sufficient force on said moveable member to force said dowel to travel along said trace.

26. The device for creating a diversion as set forth in claim 24 wherein said trace includes a dowel retaining area comprising a stop for retaining said dowel in a fixed position until a rotational force acts upon said moveable member.

27. The device for creating a diversion as set forth in claim 26 wherein said firing mechanism further includes at least one motor, a central gear and a gear connecting said at least one motor to said central gear, said central gear engaging and rotating said moveable member upon actuation of said motor.

28. The device for creating a diversion as set forth in claim 27 wherein said firing mechanism further includes a gear train connecting said motor to said gear.

29. The device for creating a diversion as set forth in claim 28 wherein said gear train comprises at least three gears.

30. The device for creating a diversion as set forth in claim 24 wherein said moveable member comprises a point capable of piercing said gas canister.

31. The device for creating a diversion as set forth in claim 30 wherein said moveable member includes a plurality of flutes proximate said point.

32. The device for creating a diversion as set forth in claim 30 wherein the piercing of said gas canister releases said pressurized gas and creates movement of said gas canister away from said moveable member and toward said powder thereby forcing said powder out of said device through said dispersal mechanism.

33. The device for creating a diversion as set forth claim 32 further including a piston intermediate said canister and said powder, said canister acting upon said piston to force said powder from said device through said dispersal mechanism.

34. The device for creating a diversion as set forth in claim 32 wherein said firing mechanism includes a central gear comprising a plurality of vanes, said gas passing through said vanes causing rotation of said central gear.

35. The device for creating a diversion as set forth in claim 32 wherein said compressed gas exists said device through at least one component capable of creating sound as said gas passes through said component.

36. The device for creating a diversion as set forth in claim 30 further including a piercing component located intermediate said canister and said piston, said moveable member forcing said canister against said piercing component thereby puncturing said canister.

37. The device for creating a diversion as set forth in claim 36 further including a piston positioned intermediate said piercing component and said powder wherein said pressurized gas acts upon said piston to drive said powder out of said device.

38. The device for creating a diversion as set forth in claim 36 wherein said piercing component includes a flat end, a tapered end and a slot running from said flat end to said tapered end.

* * * * *